US011607015B2

(12) United States Patent
Hopkins et al.

(10) Patent No.: US 11,607,015 B2
(45) Date of Patent: Mar. 21, 2023

(54) LOCK FOR AN ADJUSTMENT CORD OF A WEARABLE ARTICLE

(71) Applicant: NIKE, Inc., Beaverton, OR (US)

(72) Inventors: Timothy P. Hopkins, Lake Oswego, OR (US); Elizabeth Langvin, Sherwood, OR (US); Haley L. Toelle, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 17/880,480

(22) Filed: Aug. 3, 2022

(65) Prior Publication Data

US 2022/0369769 A1 Nov. 24, 2022

Related U.S. Application Data

(63) Continuation of application No. 17/068,067, filed on Oct. 12, 2020, now Pat. No. 11,439,203.

(60) Provisional application No. 62/923,004, filed on Oct. 18, 2019.

(51) Int. Cl.
*A43C 11/20* (2006.01)
*A43C 3/00* (2006.01)

(52) U.S. Cl.
CPC ..... *A43C 11/20* (2013.01); *A43C 3/00* (2013.01)

(58) Field of Classification Search
CPC ..... A43C 11/20; A43C 3/00; A43C 7/00
See application file for complete search history.

(56) References Cited

U.S. PATENT DOCUMENTS 4,288,891 A * 9/1981 Boden ..... F16G 11/101 24/115 G
5,956,823 A * 9/1999 Borel ..... A43C 7/00 24/712.9
6,185,798 B1 * 2/2001 Ton ..... F16G 11/101 24/712.1
6,334,240 B1 * 1/2002 Li ..... F16G 11/101 24/712.1
6,381,816 B1 * 5/2002 Lai ..... A43C 7/00 24/712.9
6,662,415 B1 * 12/2003 Lin ..... A43C 7/00 24/712.9
7,243,399 B2 * 7/2007 Liao ..... B65D 63/14 24/712.9
9,241,748 B2 * 1/2016 Bernstein ..... A61B 17/823
D758,836 S * 6/2016 Symons ..... D8/383
D758,837 S * 6/2016 Symons ..... D8/383
(Continued)

*Primary Examiner* — David M Upchurch
(74) *Attorney, Agent, or Firm* — Quinn IP Law

(57) ABSTRACT

A lock for an adjustment cord of a wearable article includes a body defining a first passage extending through the body from an entrance opening of the body to a first exit opening of the body, and the body defining a second passage extending from an intermediate portion of the first passage to a second exit opening of the body. The body is configured with a segment of the first passage extending from the intermediate portion to the first exit opening in communication with the second passage. At least a portion of the second passage is narrower than the first passage so that a portion of the cord disposed in the segment of the first passage is movable relative to the first passage when tensioned and is repositionable to the second passage where the cord locks to the body and retains tension. A wearable article including a lock is disclosed.

19 Claims, 47 Drawing Sheets

(56) References Cited

U.S. PATENT DOCUMENTS

| | | | | |
|---|---|---|---|---|
| 9,936,767 | B2 * | 4/2018 | Theuvenet | A43B 3/36 |
| 2008/0115334 | A1 * | 5/2008 | Chen | A43C 7/00 24/115 G |
| 2010/0115744 | A1 * | 5/2010 | Fong | A43C 7/00 24/712.1 |
| 2010/0192411 | A1 | 8/2010 | Leick | |
| 2011/0271556 | A1 | 11/2011 | Dillenbeck | |
| 2013/0104346 | A1 * | 5/2013 | Kawaguchi | F16G 11/101 24/115 G |

* cited by examiner

LOCK FOR AN ADJUSTMENT CORD OF A WEARABLE ARTICLE

CROSS-REFERENCE TO RELATED APPLICATION

This application is a continuation of U.S. Nonprovisional application Ser. No. 17/068,067, filed Oct. 12, 2020, which claims the benefit of priority to U.S. Provisional Application No. 62/923,004, filed Oct. 18, 2019, and both of which are hereby incorporated by reference in its entirety.

TECHNICAL FIELD

The present disclosure generally relates to a lock for an adjustment cord of a wearable article, and to a wearable article with the lock.

BACKGROUND

Wearable articles, such as apparel and footwear, may have an adjustable covering to ensure proper fit to the wearer. A tensioning member may be used to adjust the fit. For example, footwear may include laces for adjusting the upper to the wearer's foot. The ease of adjusting the fit and the ability to retain the adjusted fit during wear improves the utility of the wearable article.

BRIEF DESCRIPTION OF THE DRAWINGS

The drawings described herein are for illustrative purposes only, are schematic in nature, and are intended to be exemplary rather than to limit the scope of the disclosure.

DESCRIPTION

Figure 1:
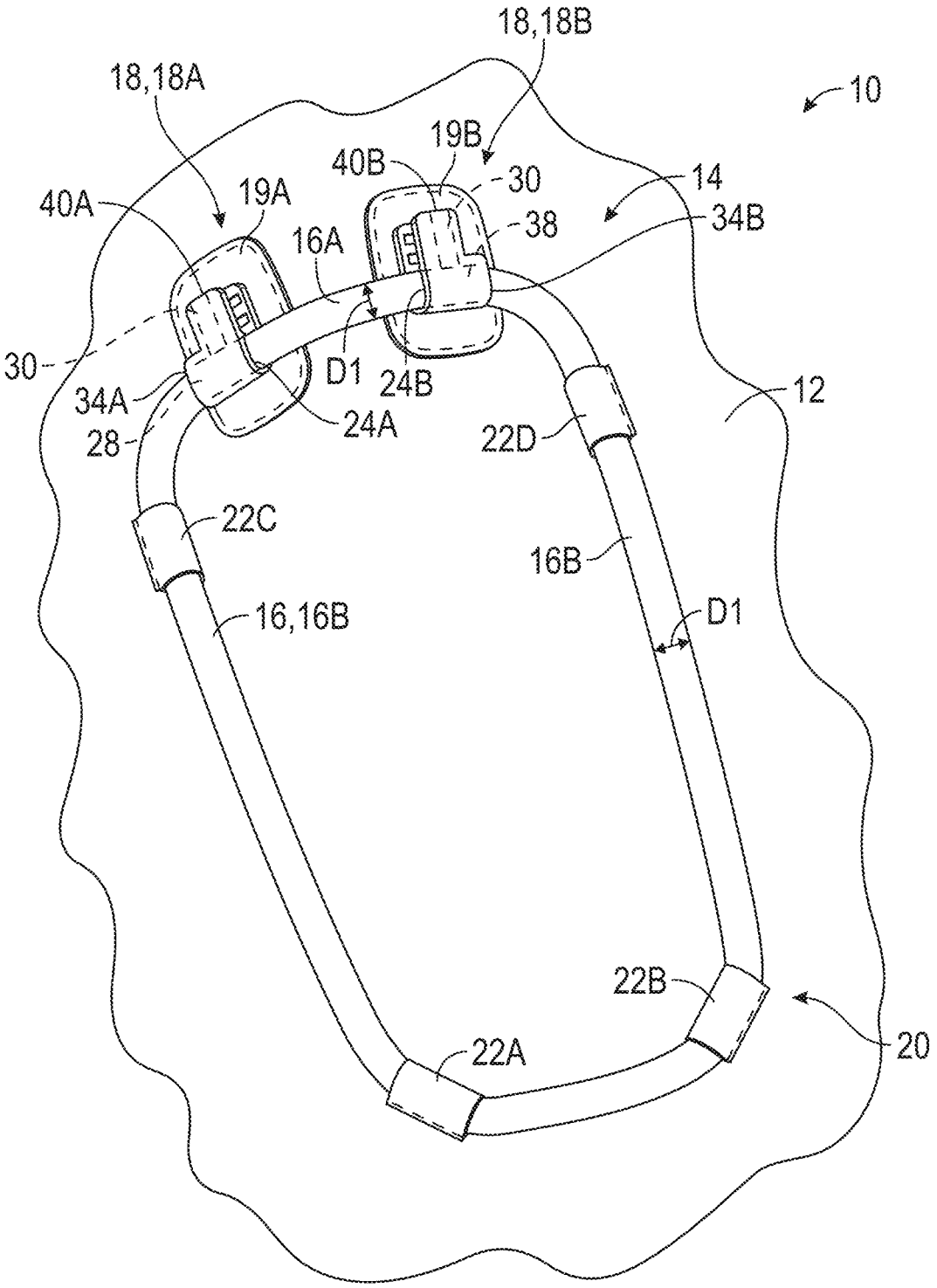
FIG. 1 is a fragmentary perspective view of a wearable article with a cord lock secured to an adjustable covering and an adjustment cord in an untensioned state.

The present disclosure generally relates to a cord lock for a wearable article that enables a tensioned adjustment cord to be quickly and easily locked in place to maintain an adjustment of the closure or fit of the article.

In an example, a lock for an adjustment cord of a wearable article is disclosed, the lock comprising a body that defines a first passage and a second passage. The first passage may extend through the body from an entrance opening of the body to a first exit opening of the body. The second passage may extend from an intermediate portion of the first passage to a second exit opening of the body. The body may be configured with a segment of the first passage extending from the intermediate portion to the first exit opening in communication with the second passage. At least a portion of the second passage may be narrower than the first passage so that a portion of the adjustment cord disposed in the segment of the first passage is movable relative to the first passage when tensioned and is selectively repositionable to the second passage where the adjustment cord locks to the body and retains tension.

In one or more configurations, the body is a first body, and the lock further comprises a second body symmetrical to the first body so that the adjustment cord extends from the first exit opening of the first body to a respective first exit opening of the second body when the adjustment cord is disposed in the segment of the first passage of each body. The adjustment cord extends from the second exit opening of the first body to a respective second exit opening of the second body when the adjustment cord is disposed in the second passage of each body. In some embodiments, the first and second bodies are integral with the same, single mounting flange so that the cord lock, including both of the first and the second bodies and the single mounting flange, is a unitary, one-piece component.

For example, a loop portion of the adjustment cord may extend between the two bodies. Such a configuration enables a user to pull on the loop portion of the adjustment cord extending from the first body to the second body to tighten the cord and the article attached thereto, and then pivot the loop portion of the cord to align with and enter the second passages, locking the cord to the first body and the second body in the second passages. For example, the looped configuration may allow adjustment (tightening) and locking to be accomplished with one hand. A loop portion may be continuous, or may be first and second end portions of the tensioning cord tied to one another. Alternatively, the cord may have first and second end portions that are not connected as a loop portion. The first and second end portions may be pulled and pivoted simultaneously to tighten the cord and the article, and then pivoted to align with and enter the second passages of the first and second bodies, respectively.

In another example, a wearable article comprises an adjustable covering, an adjustment cord, and the lock for the adjustment cord. The adjustment cord may be operatively secured to the adjustable covering at an anchor location. The lock may include a first body and a second body both secured to the adjustable covering and spaced apart from the anchor location. In one or more implementations, the wearable article may be an article of footwear, and the adjustable covering may be a footwear upper. For example, the first body may be disposed on a medial side of the footwear upper, and the second body may be disposed on a lateral side of the footwear upper. In some embodiments, the first body may be disposed on the medial side of a tongue region of the footwear upper, and the second body may be disposed on the lateral side of the tongue region of the footwear upper.

The above features and advantages and other features and advantages of the present teachings are readily apparent from the following detailed description of the modes for carrying out the present teachings when taken in connection with the accompanying drawings.

Referring to the drawings, wherein like reference numbers refer to like components throughout the views, FIG. 1 shows one example of a wearable article 10 that includes an adjustable covering 12 and a tensioning system 14 configured for quick and easy adjustment of the closure or fit of the wearable article 10. As used herein, a wearable article is an article that is configured to be worn on a human body, and does not include durable goods not intended to be worn on a human body. Non-limiting examples of wearable articles include footwear, apparel, carry bags such as backpacks, purses, duffel bags, fanny packs, and other types of portable containment structures intended to be worn on a human body. The adjustable covering 12 may be a variety of materials, such as leather, textiles, polymers, cotton, foam, composites, etc.

The tensioning system 14 includes the adjustment cord 16 and a lock 18 (also referred to as a cord lock) for the adjustment cord. Adjustment is made by simply pulling the adjustment cord, such as a loop portion 16A of the adjustment cord 16, to tension the cord 16, and pivoting the loop portion 16A of the cord from a first position (an untensioned state) in FIG. 1 to a second position (a locked position) shown in FIG. 2. Pulling the loop portion 16A concurrently pulls or cinches the covering 12 to adjust its fit over a portion of a wearer. Moving the loop portion 16A to the second position while maintaining the pulling force locks the cord 16 to the lock 18, which retains tension in the cord 16 even when the pulling force is removed. As used herein, an adjustment cord (such as adjustment cord 16) is a flexible, resiliently elastic or inelastic, elongated tensile element, and is a structure capable of withstanding a tensile load and may include, but is not limited to, a lace, a strand, a wire, a cord, a thread, or a string, among others. A loop portion of an adjustment cord (such as loop portion 16A) is a portion that is continuous, and may form a curve but need not be circular or semicircular. For example, a loop portion may be configured as two end portions of the cord 16 secured to one another. In other embodiments, the portion 16A need not be a loop portion, and may instead include a medial end portion of the cord 16 extending through the first body 18A, and a lateral end portion of the cord 16 extending through the second body 18B.

The adjustment cord 16 is operatively secured to the adjustable covering 12 at an anchor location 20. For example, the anchor location 20 may be the area on the covering 12 where two cord guides 22A, 22B are stitched or otherwise secured to the covering 12. The cord guides 22A, 22B may be sleeves through which the cord 16 extends. The cord 16 engages the cord guides 22A-22D when the cord 16 is tensioned by pulling loop portion 16A. For example, if the covering 12 is secured at its edges to another component or to itself (e.g., forming a tube or a sack), the covering 12 will be pulled tighter over the wearer. In still other embodiments, cord guides may be apertures, such as eyelets extending through a footwear upper as the adjustable covering. In other embodiments, the cord guides may be looped tensioning cables, such as looped tensioning cables secured to the upper or to a sole structure of an article of footwear. Additional cord guides 22C, 22D may be stitched or otherwise secured to the covering 12 nearer to the lock 18. Although four cord guides are shown arranged generally in a rectangular spacing, the anchor location and the number and type of cord guides may vary in different embodiments. For example, instead of cord guides 22A-22D, only a single cord guide may be used, such as a cord guide disposed at an anchor location between where cord guides 22A and 22B are shown.

In some embodiments, an aperture may be disposed in the area of the covering 12 shown surrounded by the cord 16 (e.g., the aperture may be inward of the rectangular shape formed by the cord guides 22A-22D). For example, the aperture may be an opening in the cavity 12 for an appendage of a wearer, such as a foot-receiving cavity of an article of footwear, a neck opening of a hood, or an access opening of a carry bag. Tensioning and locking the cord 16 will pull the covering 12 inward toward the opening, decreasing the size of the opening. When tensioned, the cord guides 22A, 22B may be shifted closer together to one another and/or to the lock 18 due to the cinching effect of the tensioned cord 16 as illustrated by the shifted positions in FIG. 2 relative to FIG. 1.

The lock 18 in the embodiment shown includes two symmetrical lock portions, referred to as first and second bodies 18A, 18B (also referred to as lock bodies), that are mirror images of one another, and are spaced apart from the anchor location 20 and from one another on the covering 12. The bodies 18A, 18B are separate and disconnected from one another. In other embodiments shown and described herein, a cord lock may have symmetrical first and second bodies that are made integral with one another as a unitary, one-piece component. Each of the bodies 18A, 18B includes a flange 19A, 19B, respectively. The flange 19A is integral with the first body 18A, and the flange 19B is integral with the second body 18B, each as a unitary, one-piece component. In other embodiments, the bodies 18A, 18B may be secured to the respective flanges 19A, 19B to be made integral therewith. For example, the bodies 18A, 18B and flanges 19A, 19B may include a thermoplastic material such as Nylon 12 (PA), also referred to as Nylon polyamide 12 or Nylon (PA12) available from Arkema Inc. in King of Prussia, Pa. USA. Additionally, the thermoplastic material may be reinforced, such as with glass, or may not be reinforced. As another alternative, the bodies 18A, 18B and flanges 19A, 19B may include a molded rubber material. The flanges 19A, 19B are stitched, adhered, thermally bonded, or otherwise secured to the covering 12. In some embodiments, both of the first and second bodies of a cord lock are made integral with the same flange so that the cord lock (including the first and second bodies and the single flange) is a unitary, one-piece component.

In some embodiments, the cord 16 may be an elastic cord that resiliently stretches to a greater overall length when tensioned, simultaneously reducing in thickness, and then returns to an untensioned thickness and length when tension is released. For example, the cord 16 may include an elastic core of rubber or other resiliently stretchable material surrounded by a woven sheath but slidable relative to the sheath. The sheath may be loosely woven or otherwise configured so that it may also stretch to a greater length as the cord 16 is tensioned. In other embodiments, the cord 16 may be an inelastic material. For example, an inelastic cord 16 may be tensioned and may lock to the lock 18 by a friction fit, such as by compressing when manually pushed into the lock 18. In FIG. 1, the cord 16 is shown in an untensioned state, as is apparent by the generally equal and uniform thickness of a portion 16B of the cord 16 extending through the cord guides 22A-22D, and a portion 16A of the cord 16 extending from a first exit opening 24A of the first body 18A to a first exit opening 24B of the second body 18B. The portion 16A is integral with the portion 16B and is referred to herein as the loop portion. In the untensioned state of FIG. 1, the cord 16 may have a uniform thickness or diameter D1 both in the loop portion 16A and in the remaining portion 16B. The cord 16 may be a hollow, solid, or stranded core cable. The cord 16 may have a circular cross-section of diameter D1 or may have a non-circular cross-section with a cross-sectional area equal to that of a circular cross-section of D1. For example, the cord 16 may be round with a round cross-section, or may be "flat", e.g., with a rectangular cross-section, or may have another cross-sectional shape. In embodiments in which the cord 16 is flat, for example, it may be manually folded along its length at the loop portion 16A when pivoted to a locked position in the cord lock 18 or in any of the other cord lock embodiments described herein. Such a flat cord 16 may be elastic or inelastic.

Figure 2:
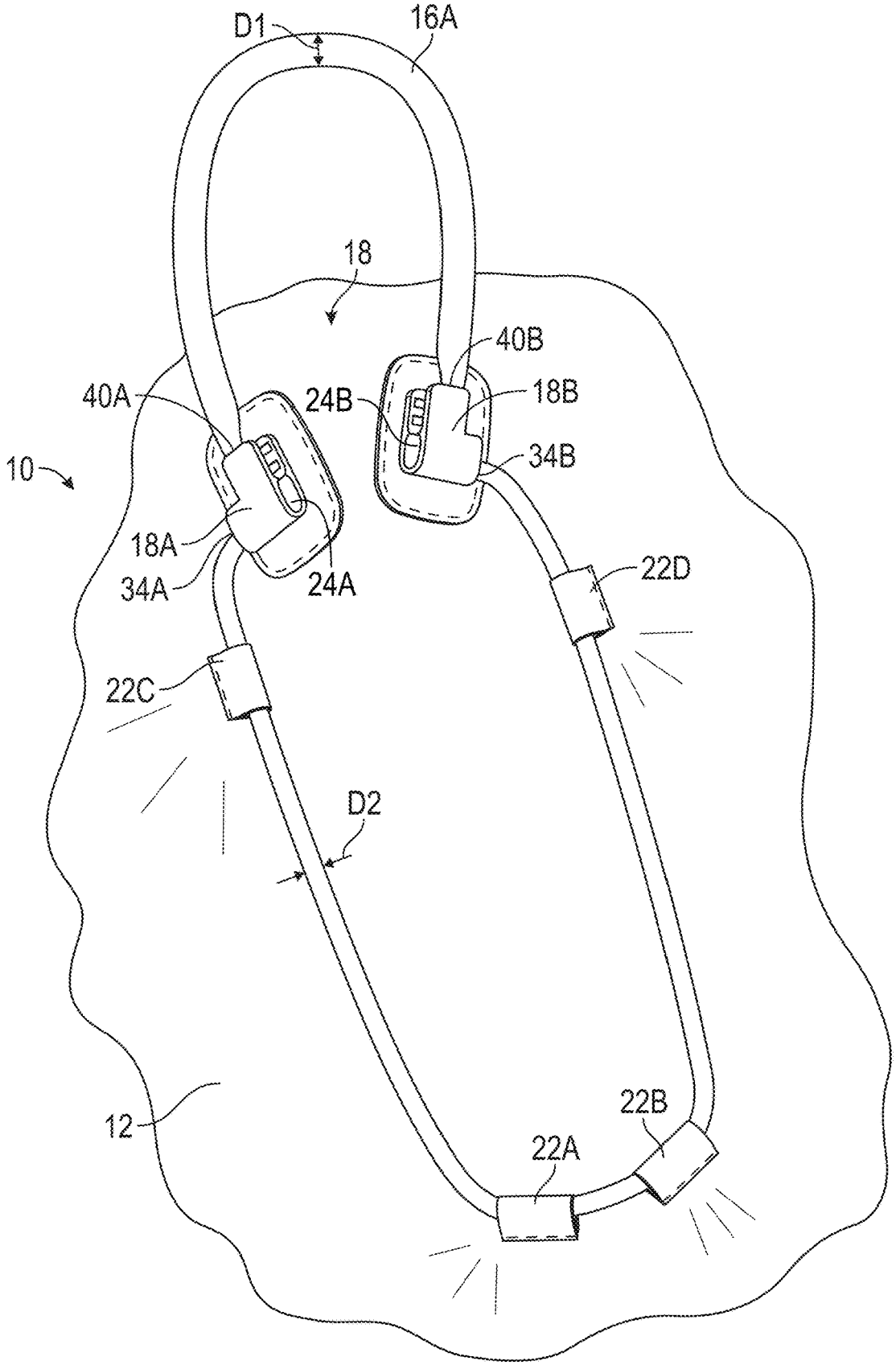
FIG. 2 is a fragmentary perspective view of the wearable article of FIG. 1 with the adjustment cord in a tensioned state and locked to the cord lock.

In the tensioned and locked state of FIG. 2, the cord 16 locks to the bodies 18A, 18B, and the portion 16B of the cord 16 extending between entrance openings 34A, 34B of the bodies 18A, 18B (e.g., the portion extending from an entrance opening 34A of the body 18A, to the anchor location and then to an entrance opening 34B of the second body 18B) remains tensioned. This is evident in FIG. 2 by the portion 16B having the lesser thickness or diameter D2 than the diameter D1 of the loop portion 16A, indicating that it is tensioned and the loop portion 16A is not tensioned. In FIG. 2, the difference between the diameters D1 and D2 is exaggerated for purposes of illustration.

Figure 3:
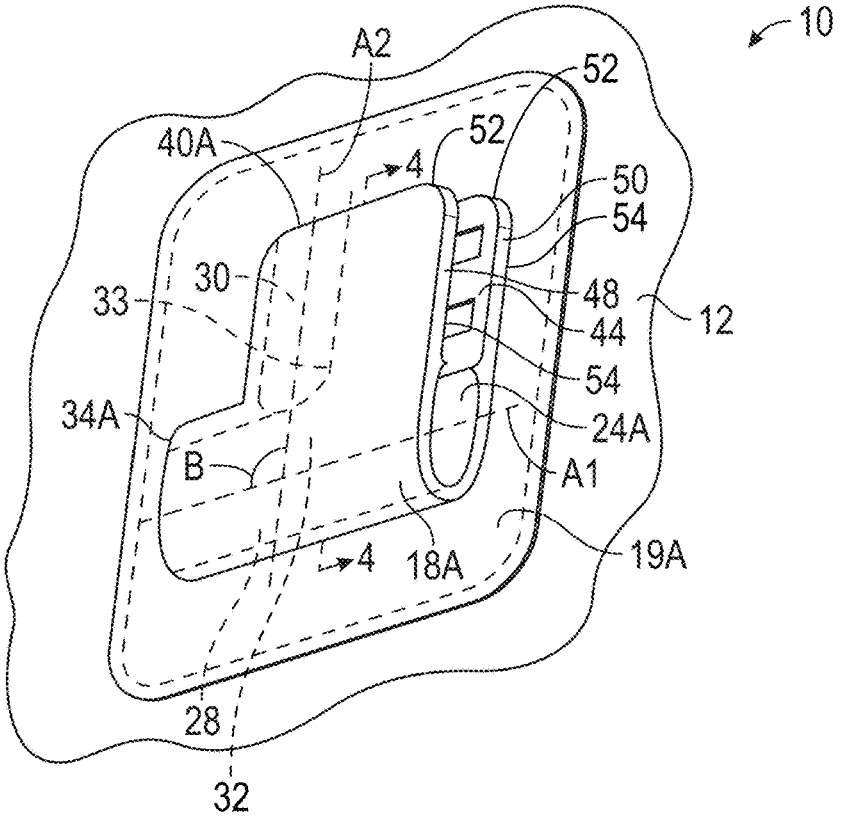
FIG. 3 is a fragmentary perspective view of one body of the cord lock secured to the wearable article.
Figure 4:
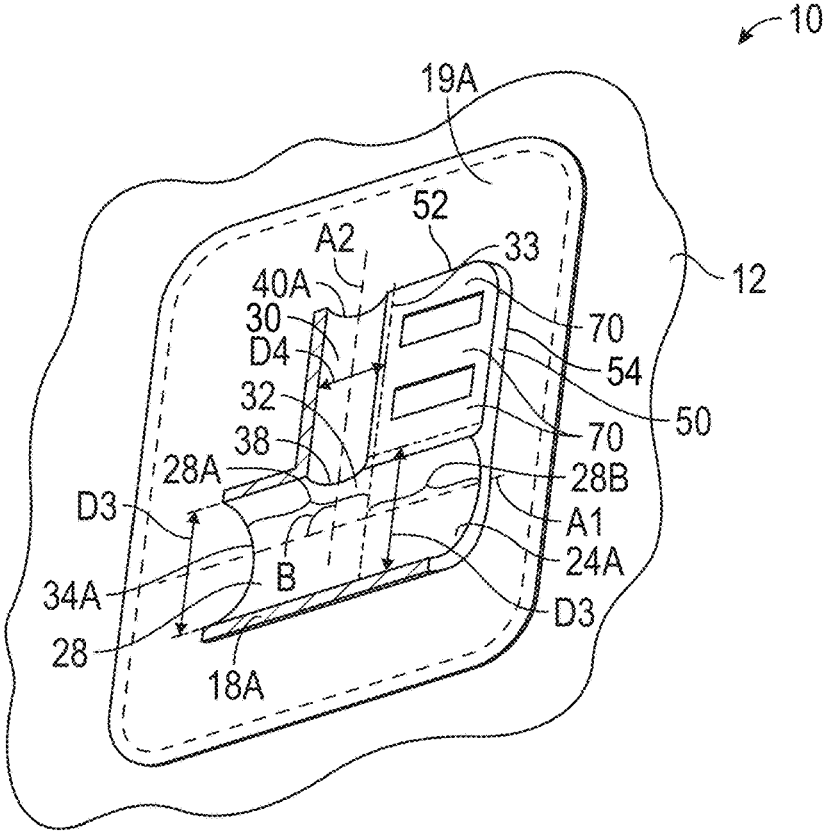
FIG. 4 is a cross-sectional fragmentary perspective view of the body of the cord lock of FIG. 3 secured to the wearable article and taken at lines 4-4 in FIG. 3.

With reference to FIGS. 3 and 4, the first body 18A is shown and described in greater detail. The description of the first body 18A applies equally to the second body 18B as the second body 18B is configured symmetrically to the first body 18A (e.g., the second body 18B is symmetrical to the first body 18A). Each body 18A, 18B includes a first passage 28 and a second passage 30 that branches from an intermediate portion 32 of the first passage 28. Stated differently, the passages 28, 30 are in communication with one another at the intermediate portion 32. The body 18A defines an entrance opening 34A and a first exit opening 24A. The first passage 28 extends from the entrance opening 34A to the first exit opening 24A. The second passage 30 extends from the first passage 28 to a second exit opening 40A defined by the body 18A. The first passage 28 includes a first segment 28A and a second segment 28B. The first segment 28A extends from the entrance opening 34A to that portion of the wall 33 of the second passage 30 furthest from the entrance opening 34A. The second segment 28B extends from that portion of the wall 33 of the second passage 30 furthest from the entrance opening 34 to the first exit opening 24A. In the embodiment shown, the first passage 28 is cylindrical, and the entire first passage 28 has a first diameter D3. A longitudinal axis A2 of the second passage 30 is disposed at an obtuse angle B with respect to the longitudinal axis A1 of the first passage 28, with the obtuse angle B being the angle from the longitudinal axis A1 at the entrance opening 34A to the longitudinal axis A2 at the second exit opening 40A. The second body 18B has corresponding first and second passages 28, 30 arranged in an identical manner relative to one another as in the first body 18A, with an entrance opening 34B, a first exit opening 24B, and a second exit opening 40B.

The second passage 30 is in communication with the first passage 28 because an entrance 38 of the second passage begins at and is open to the intermediate portion 32. The second body 18B has a corresponding second exit opening 40B. In the embodiment shown, the second passage 30 is cylindrical, and the entire second passage 30 has a second diameter D4 that is less than the first diameter D3 of the first passage 28. Accordingly, the first cross-sectional area of the first passage 28 is greater than the second cross-sectional area of the second passage 30 as both are proportional to the square of their respective diameters D3, D4. The cross-sectional area of each passage 28 or 30 is taken perpendicular to its longitudinal axis A1 or A2. In other embodiments, only a portion of the second passage 30 has a smaller diameter than the first passage. For example, only a narrowed portion somewhere along the second passage 30 need be narrower than the untensioned diameter D1 of the cord 16 in order to lock the loop portion 16A of the cord 16 to the body 18A in the second passage 30.

The adjustment cord 16 is configured so that its diameter D2 when tensioned is less than the diameter D3 of the first passage 28. In the embodiment shown, the cord 16 is elastic, and is cylindrical in cross-section (e.g., at a section through the cord 16 taken perpendicular to its longitudinal axis). Accordingly, the cross-sectional area of the cord 16 when tensioned is less than the cross-sectional area of the first passage 28. This allows the cord 16 to move longitudinally relative to the first passage 28 (e.g., slide within the first passage 28) when the loop portion 16A is pulled away from the bodies 18A, 18B, such as in a direction along the longitudinal axis A1 of the first passage 28. The cross-sectional area of the cord 16 when tensioned may also be at least slightly less than the cross-sectional area of the second passage 30 and slightly less than the narrowed portion at width D5 (discussed in FIG. 5) to allow the tensioned cord 16 to pass into the second passage 30 when the loop portion 16A is repositioned from the first passage 28 to the second passage 30. The cross-sectional area of the cord 16 when not tensioned (e.g., its cross-sectional area when it has a diameter D1) is greater than a cross-sectional area of the second passage 30. This configuration allows the cord 16 to fit into the second passage 30 when pivoted to the second position, and then lock to the second passage 30 when the force F is removed, with the cord 16 filling the second passage 30 as it tries to return to its untensioned diameter D1 but is prevented from doing so by the narrower second passage 30. In embodiments in which the cord 16 is inelastic, its cross-sectional area may remain relatively unchanged when tensioned, but it may lock to the lock 18 in the second passage 30 by a friction fit and/or may slightly compress when manually placed in the second passage 30 (e.g., such as by pushing the cord 16 into the second passage 30 when pivoted). In embodiments in which the cord 16 is "flat" (e.g., has a rectangular cross-section perpendicular to its length), the cord 16 may be folded along its length at the second passage 30 before or while being inserted into the second passage 30 by the pivoting motion. When the flat cord is elastic and is tensioned, the total cross-sectional of the flat cord is less than when it is untensioned. Additionally, folding a flat cord along its length will further enable it to lock in the lock body as its thickness will be doubled and it is biased to attempt to unfold and return to an unfolded state which will cause it to press against the lock body in the second passage 30. The second passages 30 of the lock bodies 18A, 18B thus act as pinch points on the cord 16, and the portion 16B between the anchor location 20 and the lock 18 remains tensioned. The portion of the cord 16 between the second exit opening 40A of the first body 18A and the second exit opening 40B of the second body 18B (e.g., the loop portion 16A) is untensioned (e.g., slack) and may have the diameter D1.

An exterior surface 42 of the body 18A defines a slot 44 that extends from the first exit opening 24A to the second exit opening 40A. The slot 44 also extends inward from the exterior surface 42 into the body 18A along the segment 28B of the first passage 28 and along the second passage 30. The slot 44 does not extend along the segment 28A of the first passage 28 that is between the entrance opening 34A and the beginning of the second passage 30 (e.g., first segment 28A). The slot 44 enables the loop portion 16A of the adjustment cord 16 to be repositionable by pivoting the cord 16 in the body 18A through the slot 44 from the first position (FIG. 1) in which the adjustment cord 16 extends through the first exit opening 24A to the second position (FIG. 2) in which the adjustment cord 16 extends through the second exit opening 40A. The adjustment cord 16 extends through the entrance opening 34A in both the first position and the second position.

Adjustment of the cord 16 begins with a manual force applied to the loop portion 16A, pulling the loop portion 16A away from the covering 12 in FIG. 1. An example showing the direction of the force F is in FIG. 7 in which the wearable article is an article of footwear 110. When the loop portion 16A is pivoted from the first position to the second position, the loop portion 16A exits the segment 28B and moves to the second passage 30 through the slot 44 in a pivoting motion, pivoting generally at a pivot axis at the intersection of the center axes A1, A2. The pivoting motion can begin while the cord 16 is still stretching under the force F applied to the loop portion 16A, or after stretching of the loop portion 16A along the axis A1 is complete and the force F is held while the pivoting motion occurs. When the loop portion 16A moves into the second passage 30 and the force F on the loop portion 16A is removed, the locking of the loop portion 16A to the body 18A and to the body 18B at the respective second passages 30 holds (e.g., retains) the tension in the portion 16B.

Figure 5:
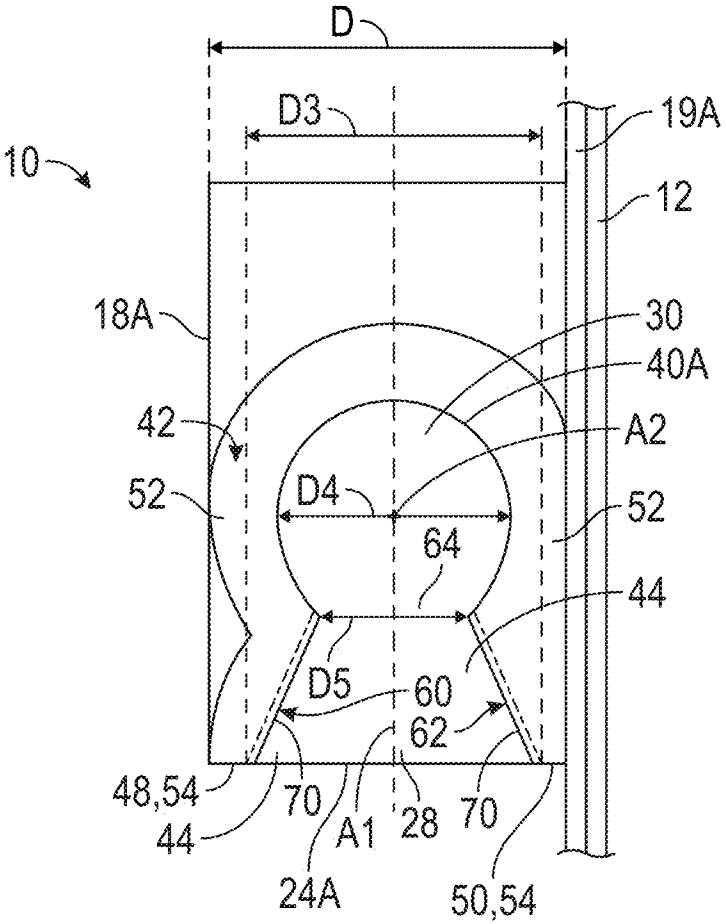
FIG. 5 is a fragmentary top view of the body of the cord lock and the wearable article of FIG. 3.

Referring to FIG. 5, it is apparent from the plan view that the body 18A includes a first side wall 48 and a second side wall 50 spaced apart from the first side wall 48 by the slot 44. The first side wall 48 and the second side wall 50 extend along the segment 28B of the first passage 28. Stated differently, the first side wall 48 and the second side wall 50 extend beyond the intermediate portion 32 (where the second passage 30 branches from the first passage 28) all the way to the first exit opening 24A. The first side wall 48 and the second side wall 50 also extend along the second passage 30 to the second exit opening 40A. As best shown in FIG. 3, a top 52 of each of the side walls 48, 50 extends forward from the second exit opening 40A the length of the segment 28B. A front 54 of each of the side walls 48, 50 extends upward to meet the top 52. The second passage 30 and the segment 28B are thus completely within the body 18A. A forward portion of the first passage 28 (e.g., the second segment 28B, closest to the front 54) and an upper portion of the second passage 30 (e.g., a portion closest to the top 52) open to the slot 44 along their lengths and may be accessed through the slot 44 to allow the cord 16 to exit the first segment 28A and be pivoted to the second passage 30 when tightening the cord 16. Similarly, when releasing the cord 16 to loosen the covering 12, the slot 44 enables the cord 16 to exit the second passage 30 when the cord 16 is pivoted back to the segment 28B.

As best shown in FIG. 5, the first side wall 48 and the second side wall 50 are configured such that the slot 44 is narrower at an axial opening 64 of the second passage 30 bordering the slot 44 than at the front 54 of the body 18A. For example, the inner surface 60 of the first side wall 48 angles inward (e.g., into the slot 44) toward the second side wall 50 from the exterior surface 42 at the front 54 to the second passage 30 to narrow the slot 44. The inner surface 62 of the second side wall 50 angles inward toward the first side wall 48 in a similar manner. In other embodiments, only the first side wall 48 or only the second side wall 50 angles inward. In any embodiment, the axial opening 64 of the second passage 30 to the slot 44 has a width D5 that is less than the diameter D4 of the second passage 30. When the cord 16 is in the second passage 30 and a manually-applied tensioning force is removed, the elastic cord 16 begins expanding to its untensioned diameter D1 which is greater than the diameter D4, and will be locked to the body 18A in the second passage 30, being constrained by the second passage 30 from fully expanding to the untensioned diameter D1. The narrowing of the slot 44 to the width D5 will further help to retain the cord 16 in the second passage 30 until it is again tensioned by an applied pulling force to thin the cord 16 to its tensioned diameter D2, which is less than the width D5, allowing the cord 16 to be pivoted back to the first passage 28 through the axial opening 64, and to thereby loosen the covering 12. If the cord 16 is inelastic, the cord 16 may lock in the second passage 30 by a friction fit when manually forced therein, and may be removable under sufficient pulling and/or pivoting force.

Figure 6:
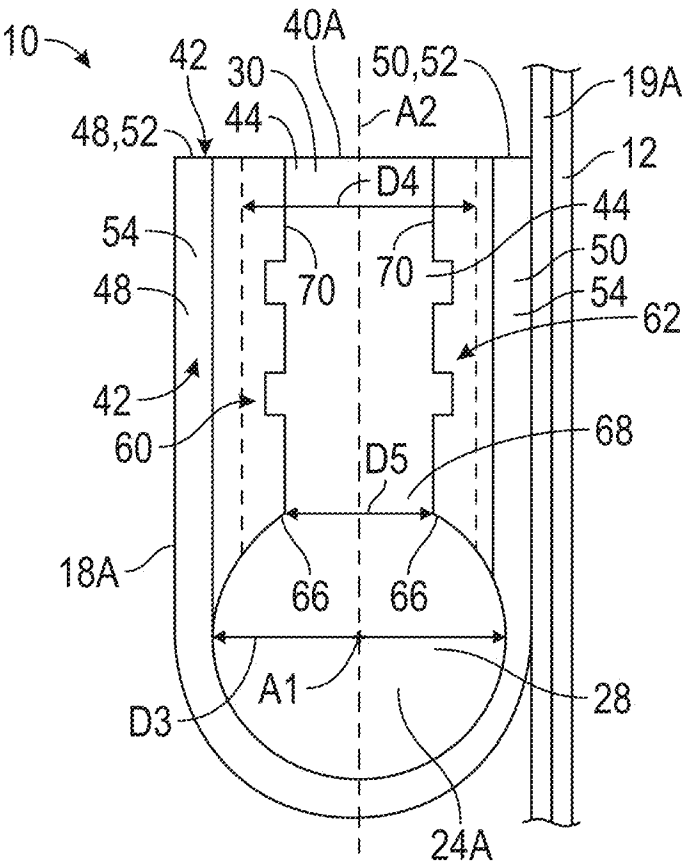
FIG. 6 is a fragmentary front view of the body of the cord lock and the wearable article of FIG. 3.

As best shown in FIG. 6, the inner surfaces 60, 62 of the side walls 48 and 50 protrude inward just above the first passage 28, as shown at the protrusions 66. The protrusions 66 may be edges of the body 18A formed at the intersection of the passage 28 with the slot 44. The protrusions 66 ensure that the slot 44 also has only the width D5 at the axial opening 68 of the first passage 28 to the slot 44. In some embodiments, a series of protrusions 70 configured as ribs may extend along the inner surfaces 60, 62 of the side walls 48 and 50 in a direction from the front 54 toward the axial opening 64. These protrusions 70 may help prevent the cord 16 from moving from the second passage 30 to the first passage 28 without a manually-applied tensioning force narrowing the cord 16 or otherwise enabling the cord 16 to be intentionally removed from the second passage 30. In other embodiments, the inner surfaces 60, 62 may be smooth, without protrusions 70. Depending upon the material used for the body 18A, the first side wall 48 may be configured to flex away from the second side wall 50 when the adjustment cord 16 encounters the protrusions 66 and/or 70 during repositioning of the adjustment cord 16.

It is apparent in FIGS. 5 and 6 that the lock body 18A extends outward from the flange 19A by a distance D greater than the diameter D3 of the first passage 28. The distance D by which the lock body 18A or any other lock body described herein extends from the covering 12 or footwear upper 112, etc., to which it is secured may be referred to as a neck height. The distance D, or neck height, is at least partially dependent upon the thickness of the cord 16 to be locked to the lock body. The lock body and cord used with the lock body may be selected so that the neck height does not interfere with the utility of the apparel, footwear, or other object to which the lock body is secured.

Figure 7:
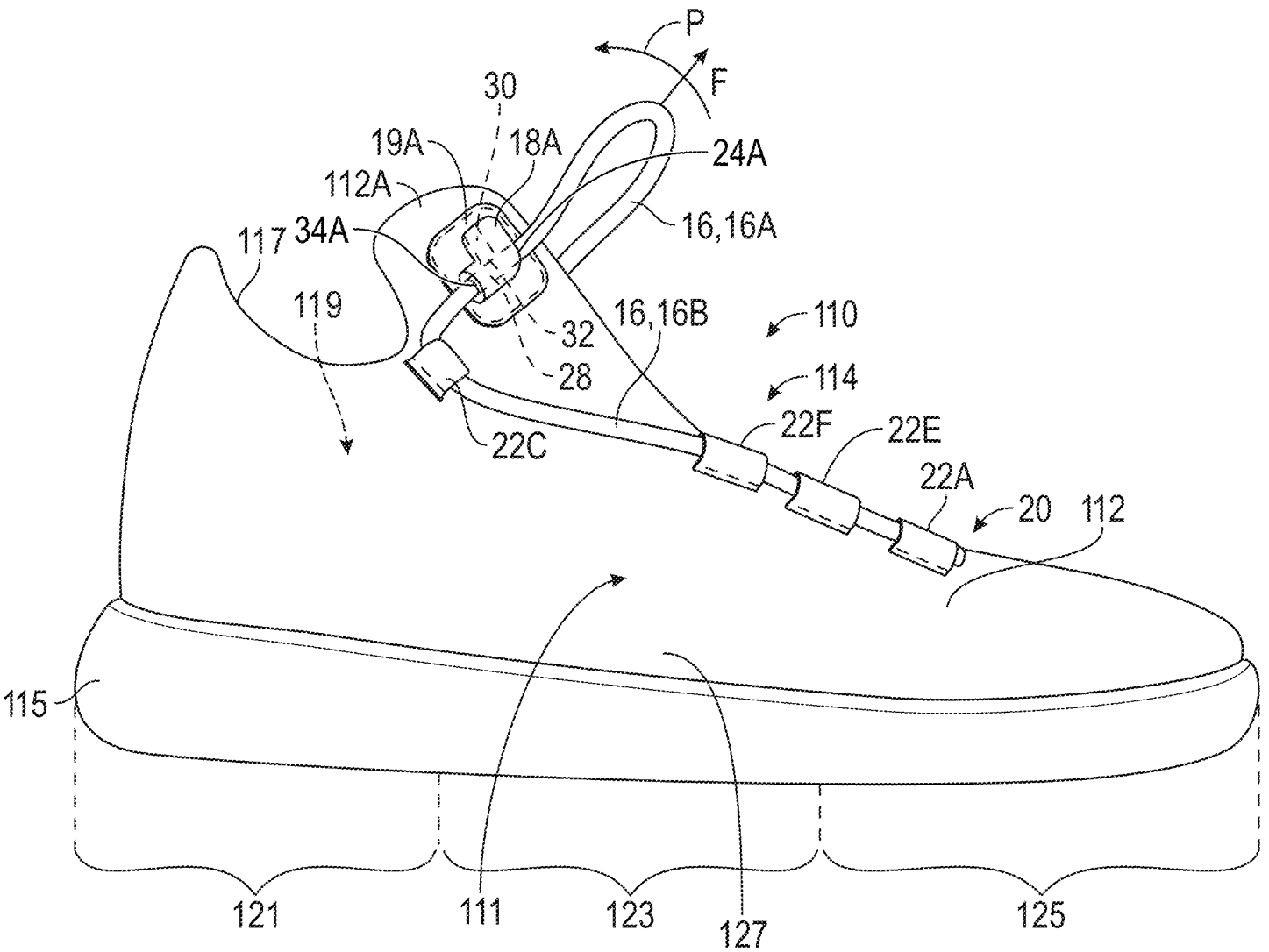
FIG. 7 is a lateral side view of an article of footwear including the cord lock and the adjustment cord of FIG. 1 with the adjustment cord in an untensioned state.
Figure 8:
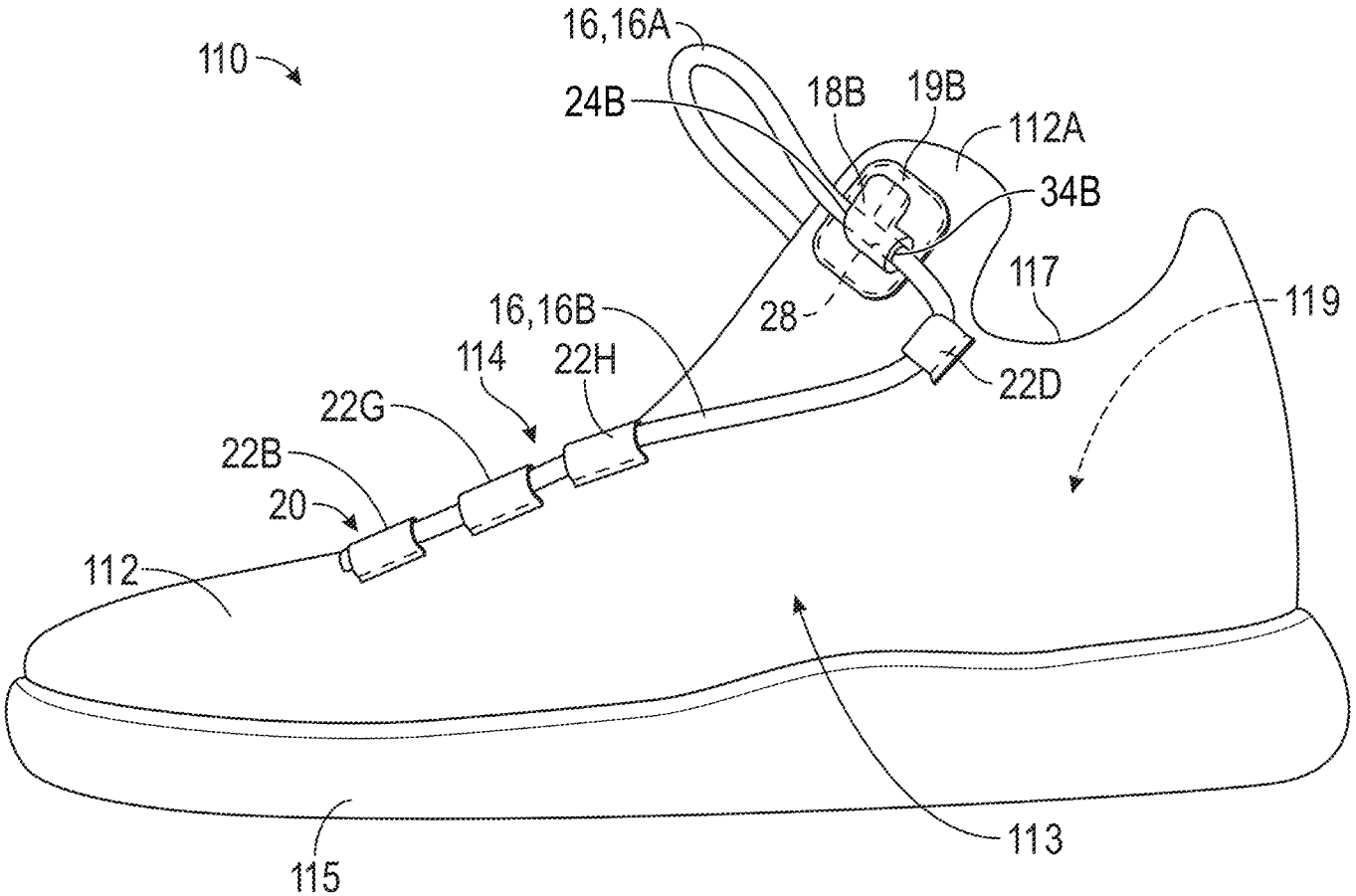
FIG. 8 is a medial side view of the article of footwear of FIG. 7.

FIG. 7 shows a lateral side 111 of an embodiment of a wearable article 110 that is an article of footwear, and FIG. 8 shows a medial side 113 of the article of footwear 110. The article of footwear 110 includes a sole structure 115 to which a footwear upper 112 is secured. The footwear upper 112 is an adjustable covering that forms a foot opening 117 (e.g., an ankle opening) in communication with a foot-receiving cavity 119 to receive a foot in the foot-receiving cavity 119.

The article of footwear 110 herein is depicted as a work shoe, a leisure shoe or an athletic shoe, but the present teachings also include an article of footwear that is a dress shoe, a sandal, a slipper, a boot, or any other category of footwear. The article of footwear 110 has a heel region 121, as well as a midfoot region 123 and a forefoot region 125. The heel region 121 generally includes portions of the article of footwear 110 corresponding with rear portions of a human foot, including the calcaneus bone, when the human foot of a size corresponding with the article of footwear 110 is disposed in the foot-receiving cavity 119 and is supported on the sole structure 115. The forefoot region 125 of the article of footwear 110 generally includes portions of the article of footwear 110 corresponding with the toes and the joints connecting the metatarsals with the phalanges of the human foot (interchangeably referred to herein as the "metatarsal-phalangeal joints" or "MPJ" joints). The midfoot region 123 of the article of footwear 110 is disposed between the heel region 121 and the forefoot region 125 and generally includes portions of the article of footwear 110 corresponding with an arch area of the human foot, including the navicular joint. The lateral side 111 and the medial side 113 both extend from the heel region 121 to the forefoot region 125, and are generally opposite sides of the footwear 110 divided by a longitudinal midline of the footwear 110.

The sole structure 115 includes one or more sole components that may be sole layers, such as an outsole, a midsole, or a unitary combination of an outsole and a midsole that may be referred to as a unisole. The sole structure 115 underlies the upper 112. A lower portion 127 of the upper 112 may be secured to the sole structure 115 around the entire periphery of the lower portion 127 (e.g., on both the lateral and medial sides 111, 113, and around the front and the rear), such as by stitching, adhesive or otherwise.

The sole structure 115 may comprise, for example, a midsole of an elastomeric foam such as a polyurethane or ethylvinylacetate foam to attenuate ground reaction forces (e.g., provide cushioning) when compressed between the foot and the ground during walking, running, or other ambulatory activities. In further configurations, the sole structure 115 may incorporate fluid-filled chambers, plates, moderators, or other elements in the midsole that further attenuate forces, enhance stability, or influence the motions of the foot. In the embodiment shown, a midsole may be at least partially a polyurethane foam, and/or a polyurethane ethylene-vinyl acetate (EVA) foam, and may include heat-expanded and molded EVA foam pellets. The midsole may generally include phylon (ethylene vinyl acetate or "EVA") and/or polyurethane ("PU") base resins. If EVA is used, it may have a vinyl acetate (VA) level between approximately 9% and approximately 40%. Suitable EVA resins include Elvax®, provided by E. I. du Pont de Nemours and Company, and Engage™ provided by the Dow Chemical Company, for example. In certain embodiments, the EVA may be formed of a combination of high melt index and low melt index material. For example, the EVA may have a melt index of from about 1 to about 50. The EVA resin may be compounded to include various components including a blowing agent and a curing/crosslinking agent. The blowing agent may have a percent weight between approximately 10% and approximately 20%. The blowing agent may be thermally decomposable and is selected from ordinary organic and inorganic chemical blowing agents. The nature of the blowing agent is not particularly limited as long as it decomposes under the temperature conditions used in incorporating the foam into the virgin resin. Suitable blowing agents include azodicarboamide, for example. In certain embodiments, a peroxide-based curing agent, such as dicumyl peroxide may be used. The amount of curing agent may be between approximately 0.6% and approximately 1.5%. The EVA may also include homogenizing agents, process aids, and waxes. For example, a mixture of light aliphatic hydrocarbons such as Struktol® 60NS, available from Schill+Seilacher "Struktol" GmbH, may be included to permit other materials or scrap EVA to be more easily incorporated into the resin. The EVA may also include other constituents such as a release agent (e.g., stearic acid), activators (e.g., zinc oxide), fillers (e.g., magnesium carbonate), pigments, and clays. In embodiments that incorporate multiple materials, each material may be formed from a material that is compatible and readily bonds with the other material. For example, the materials may each be formed from an EVA resin with suitable blowing agents, crosslinking agents, and other ancillary components, pigments, fillers, and the like. Other suitable materials will become readily apparent to those skilled in the art, given the benefit of this disclosure.

A midsole of the sole structure 115 may comprise one or more bladder elements that may be blow-molded or formed from polymeric sheets that may comprise a variety of materials including various polymers that can resiliently retain a fluid such as air or another gas. Examples of polymer materials for the polymeric sheets include thermoplastic urethane, polyurethane, polyester, polyester polyurethane, and polyether polyurethane. Moreover, the polymeric sheets can each be formed of layers of different materials. In one embodiment, each polymeric sheet is formed from thin films having one or more thermoplastic polyurethane layers with one or more barrier layers of a copolymer of ethylene and vinyl alcohol (EVOH) that is impermeable to the pressurized fluid contained therein as disclosed in U.S. Pat. No. 6,082,025, which is incorporated by reference in its entirety. Each polymeric sheet may also be formed from a material that includes alternating layers of thermoplastic polyurethane and ethylene-vinyl alcohol copolymer, as disclosed in U.S. Pat. Nos. 5,713,141 and 5,952,065 to Mitchell et al. which are incorporated by reference in their entireties. Alternatively, the layers may include ethylene-vinyl alcohol copolymer, thermoplastic polyurethane, and a regrind material of the ethylene-vinyl alcohol copolymer and thermoplastic polyurethane. The polymeric sheets may also each be a flexible microlayer membrane that includes alternating layers of a gas barrier material and an elastomeric material, as disclosed in U.S. Pat. Nos. 6,082,025 and 6,127,026 to Bonk et al. which are incorporated by reference in their entireties. Additional suitable materials for the polymeric sheets are disclosed in U.S. Pat. Nos. 4,183,156 and 4,219,945 to Rudy which are incorporated by reference in their entireties. Further suitable materials for the polymeric sheets include thermoplastic films containing a crystalline material, as disclosed in U.S. Pat. Nos. 4,936,029 and 5,042,176 to Rudy, and polyurethane including a polyester polyol, as disclosed in U.S. Pat. Nos. 6,013,340, 6,203,868, and 6,321,465 to Bonk et al. which are incorporated by reference in their entireties. In selecting materials for the polymeric sheets, engineering properties such as tensile strength, stretch properties, fatigue characteristics, dynamic modulus, and loss tangent can be considered. The thicknesses of polymeric sheets can be selected to provide these characteristics.

The sole structure 115 may include the outsole or outsole portions that may be formed from materials that may generally include natural or synthetic rubber or other suitably durable materials. The material or materials for the outsole may be selected to provide a desirable combination of durability and flexibility. Synthetic rubbers that may be used include ethylene propylene rubber (EPR), styrene isoprene styrene (SIS) copolymer rubber, and styrene butadiene rubber.

A tensioning system 114 secured to the upper 112 cinches the upper 112 to adjust the size of the foot-receiving cavity 119, securing the upper 112 around a foot therein. The tensioning system 114 includes the lock 18, the adjustment cord 16, and a plurality of cord guides 22A, 22B, 22C, 22D all as described with respect to FIG. 1, as well as additional cord guides 22E, 22F, 22G, and 22H. The cord guides 22A-22H are depicted as flexible but relatively non-elastic loops stitched to the upper 112. For example, the cord guides 22A-22H may be a woven or mesh nylon material or may be other materials or configurations, such as webbing, rigid hooks, or eyelets. The lock 18 includes the first and second bodies 18A, 18B secured to the upper 112 via respective integral mounting flanges 19A, 19B all of which are configured as described with respect to FIGS. 1-6.

The first body 18A is disposed on the lateral side 111 of a tongue region 112A of the footwear upper 112, and the second body 18B is disposed on the medial side 113 of the tongue region 112A. The anchor location 20 is forward of the first body 18A and the second body 18B on the footwear upper 112. More specifically, the anchor location 20 is in the forefoot region 125, with the cord guide 22A on the lateral side 111 and the cord guide 22B on the medial side 113, and the adjustment cord 16 routing through and engaging each cord guide. The adjustment cord 16 engages the cord guide 22C between the anchor location 20 and the first body 18A, and engages the cord guide 22D between the anchor location 20 and the second body 18B. The cord guide 22C may be referred to as a first cord guide, and is disposed slightly rearward of and below the first body 18A, as shown in FIG. 7. The cord guide 22D may be referred to as a second cord guide and is disposed slightly rearward of and below the second body 18B, as shown in FIG. 8.

In the embodiment of FIGS. 7 and 8, the bodies 18A, 18B are disposed on the upper 112 so that the first passage 28 of each of the first body 18A and the second body 18B extends forward and upward from the entrance opening 34A, 34B to the first exit opening 24A, 24B, respectively. In FIGS. 7 and 8, the cord 16 is in the untensioned state, with the loop portion 16A disposed in the first passages 28 and extending out of the first exit openings 24A, 24B. The adjustment cord 16 thus makes a forward and upward turn from the cord guides 22C and 22D to route through the respective first passages 28 and extending out of the first exit openings 24A, 24B. In this arrangement, the first body 18A, the first cord guide 22C, and the cord guide 22A at the anchor location 20 are arranged in a triangular spacing. Pulling the loop portion 16A in the direction of the force F (upward and forward) along the axes A1 of the first passages 28, and while maintaining the force F, subsequently or simultaneously pivoting the loop portion 16A (as represented by pivot arrow P) rearward through the slot 44 of each of the bodies 18A, 18B to the second passage 30 moves the loop portion 16A to the locked position of FIGS. 8 and 9, in which the tension in the portion 16B of the cord 16 is maintained, as described with respect to the tensioning system 14. The retained tension is indicated by the narrower width (e.g., diameter) of portion 16B in FIGS. 9 and 10 compared to FIGS. 7 and 8, whereas the portion 16B is of the same thickness as portion 16A in the untensioned state of FIGS. 7 and 8.

Figure 9:
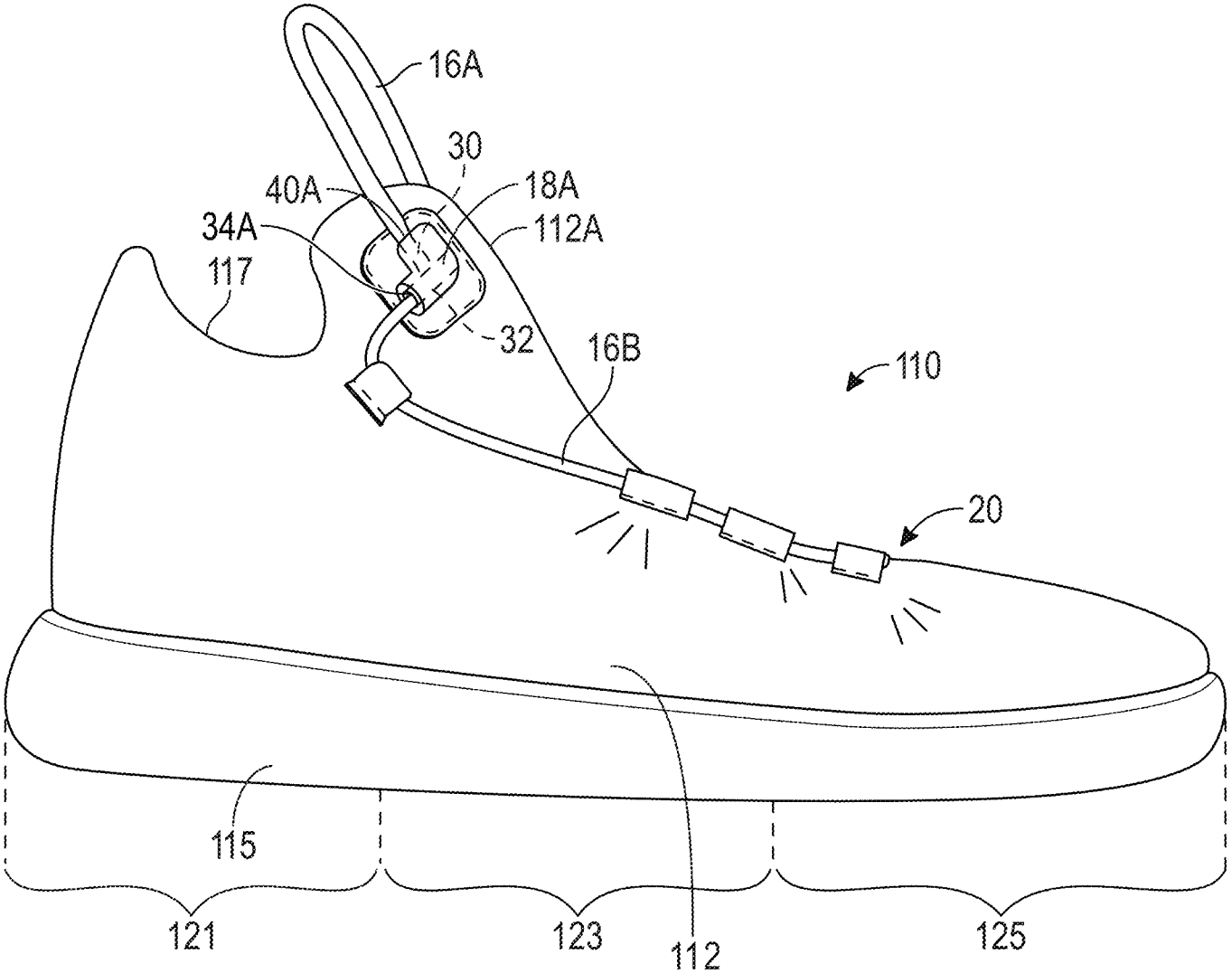
FIG. 9 is a lateral side view of the article of footwear of FIG. 7 with the adjustment cord in a tensioned state.
Figure 10:
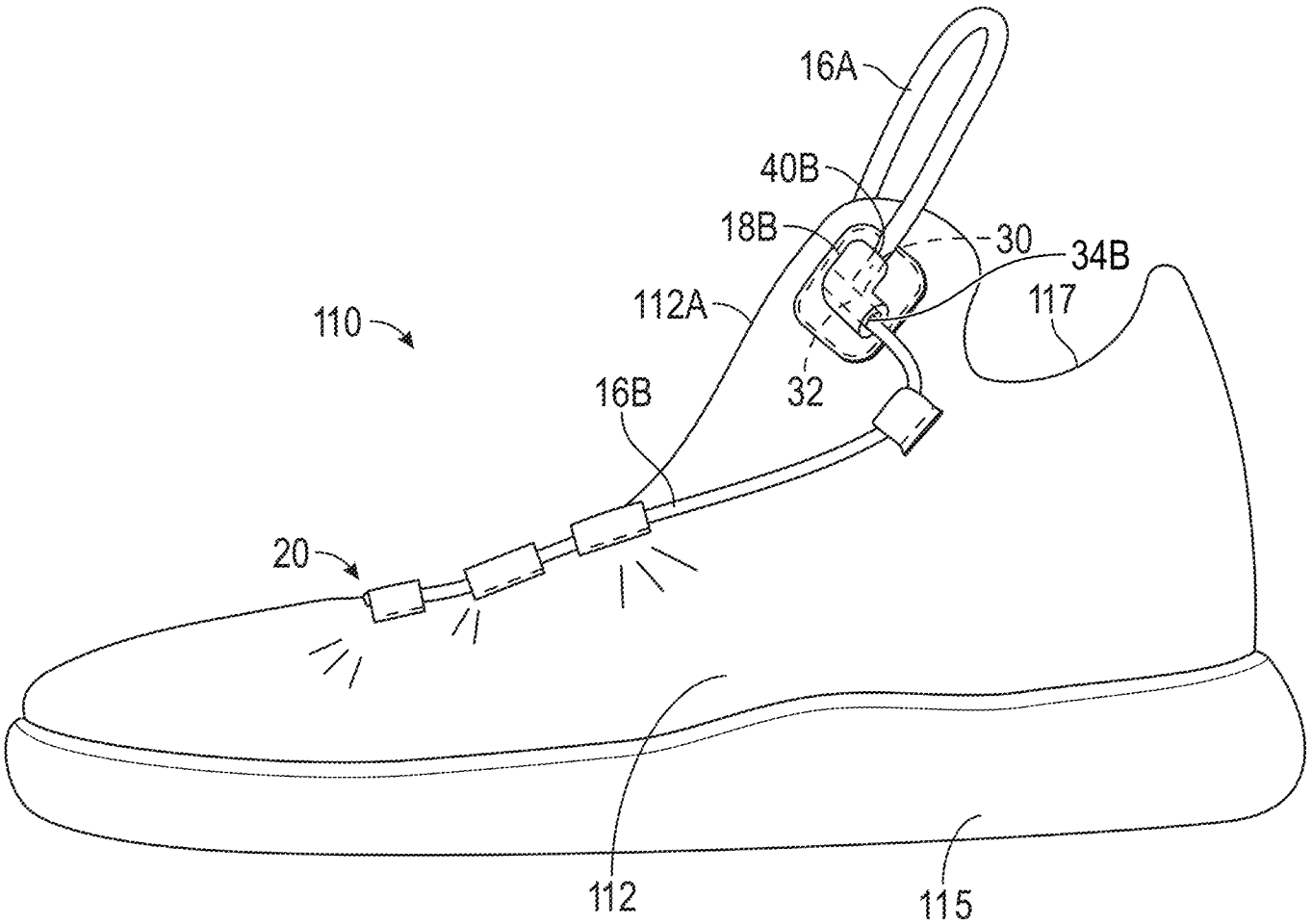
FIG. 10 is a medial side view of the article of footwear of FIG. 9.

As indicated in FIGS. 9 and 10, the second passage 30 of each of the first body 18A and the second body 18B extends rearward and upward from the intermediate portion 32 of each first passage 28 to the second exit opening 40A, 40B, respectively. In the tensioned state, FIGS. 9 and 10 show the upper 112 slightly closer to the sole structure 115 over the midfoot region 123 and the forefoot region 125 (e.g., at the anchor location 20), and the lock 18 (e.g., bodies 18A, 18B) shifted slightly rearward relative to their positions in FIGS. 7 and 8. To loosen the upper 112, the loop portion 16A is pulled upward and rearward along the axes of the second passage 30, and simultaneously or subsequently pivoted through the slot 44 in the opposite direction of P while maintaining the applied force F to return to the untensioned, first position of FIGS. 7 and 8, at which time the force F is released so that the adjustment cord 16 (including the loop portion 16A and the portion 16B) returns to its untensioned state. At least due to the loop portion 16A and the lock 18, both tightening and loosening of the cord 16 and the resulting adjustment of the upper 112 can occur by pulling and pivoting the cord 16 as described with only one hand. The other hand is not needed to complete the adjustment and need not even be in contact with the footwear 110 during the adjustment.

Figure 11:
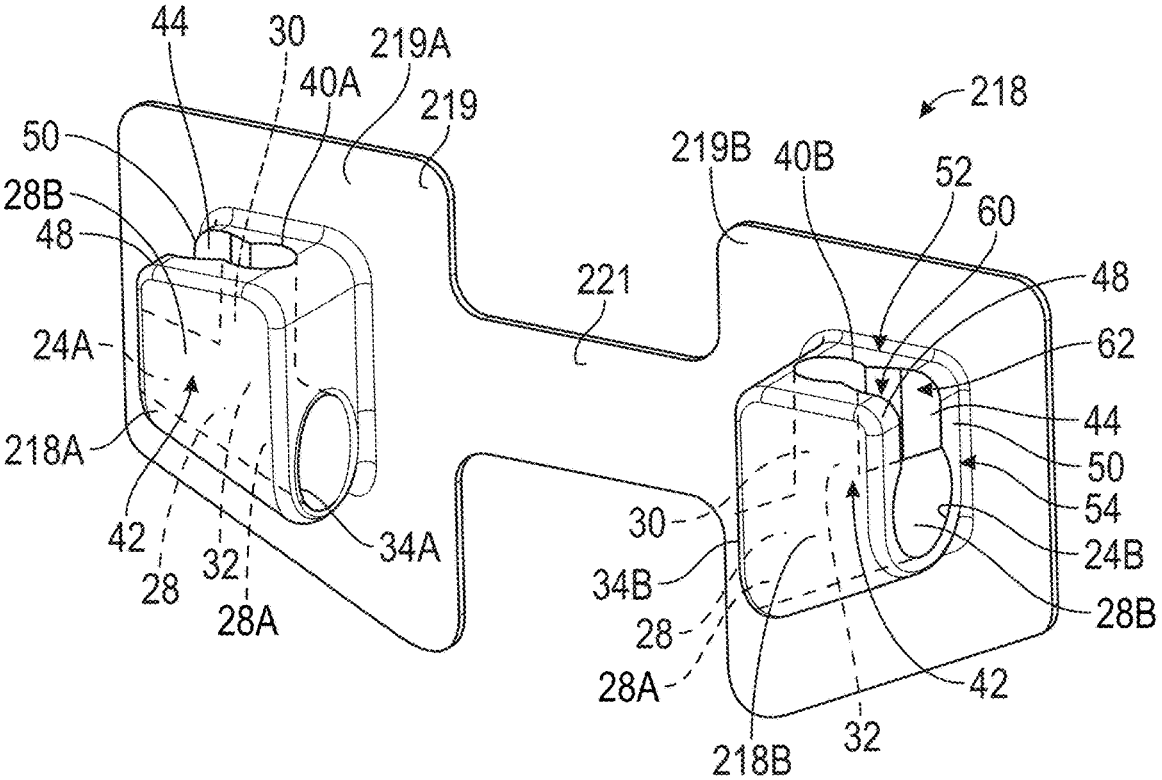
FIG. 11 is a front perspective view of another embodiment of a cord lock.
Figure 12:
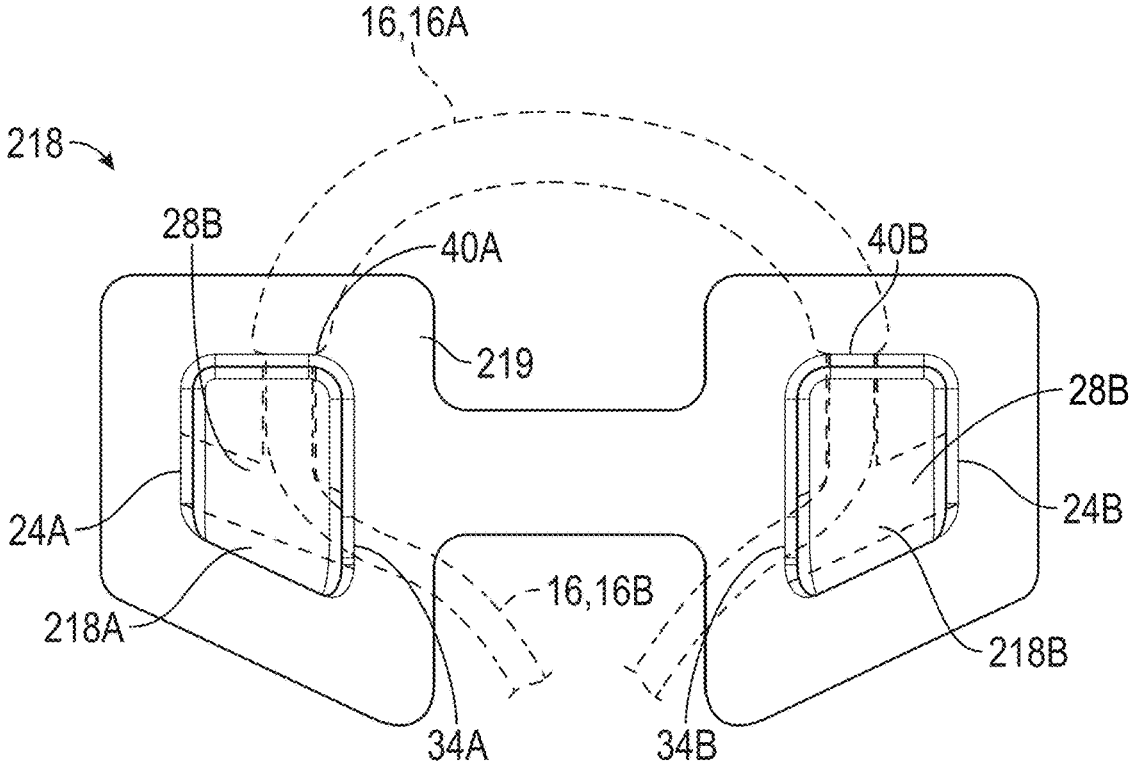
FIG. 12 is a front view of the cord lock of FIG. 11.

FIGS. 11 and 12 show another embodiment of a cord lock 218 having a first lock body 218A and a second lock body 218B. The second lock body 218B is integral with and configured symmetrically to the first lock body 218A. The cord lock 218 includes a single mounting flange 219 to which both the first lock body 218A and the second lock body 218B are connected and which is configured to mount to a wearable article. Accordingly, the cord lock 218 including the first lock body 218A, the second lock body 218B, and the mounting flange 219 is a single, unitary one-piece component as the first lock body 218A and second lock body 218B are integral with the mounting flange 219. The mounting flange 219 includes a relatively narrow center portion 221 and connecting end portions 219A and 219B connected to one another by the center portion 221 and from which the bodies 218A, 218B extend. The narrowed center portion 221 may be positioned over the top of a footwear upper forward of an ankle opening in the upper, with the end portions 219A, 219B at respective medial and lateral sides of the upper 112.

The bodies 218A, 218B are configured similarly to bodies 18A and 18B, respectively, with like reference numbers indicating like features. The description of the like features of the bodies 18A, 18B and their functions is applicable and is not repeated with respect to the bodies 218A, 218B for efficiency. The relative positions of the first entrance openings 34A and 34B, and the relative positions of the first exit openings 24A and 24B are switched relative to the bodies 18A and 18B shown in FIG. 1. More specifically, the first entrance openings 34A and 34B are disposed closer to one another in FIG. 11 (e.g., between the first exit openings 24A, and 24B) and the first exit openings 24A, 24B are disposed further from one another than the first entrance openings 34A and 34B are from one another. The adjustment cord 16 is shown in phantom in FIG. 12 in the locked position, retaining tension, after being repositioned through the slots 44 from the second segment 28B of the first passage 28 to the narrower second passage 30.

Figure 15:
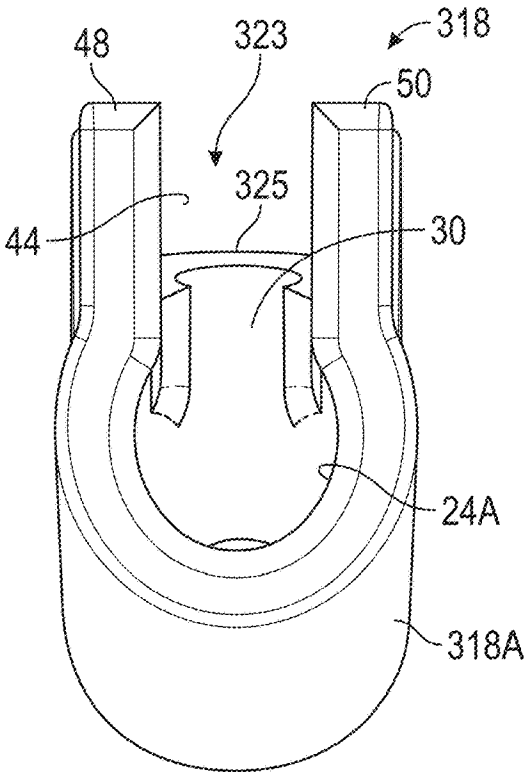
FIG. 15 is a front view of the cord lock of FIG. 13.
Figure 14:
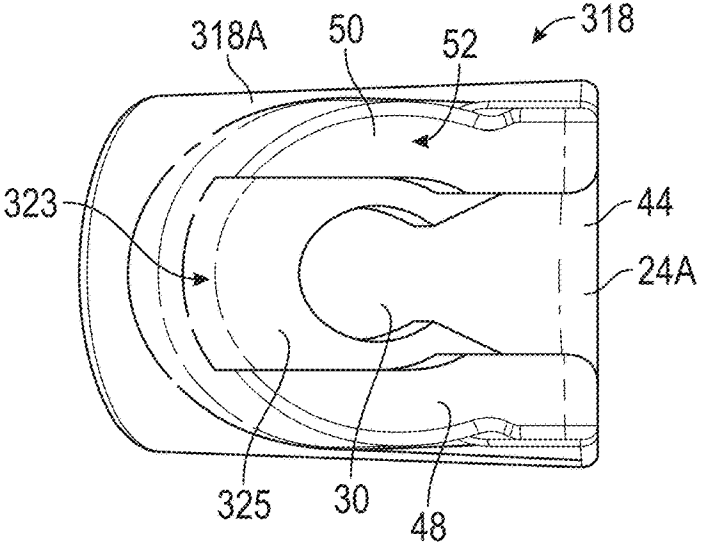
FIG. 14 is a top view of the cord lock of FIG. 13.
Figure 13:
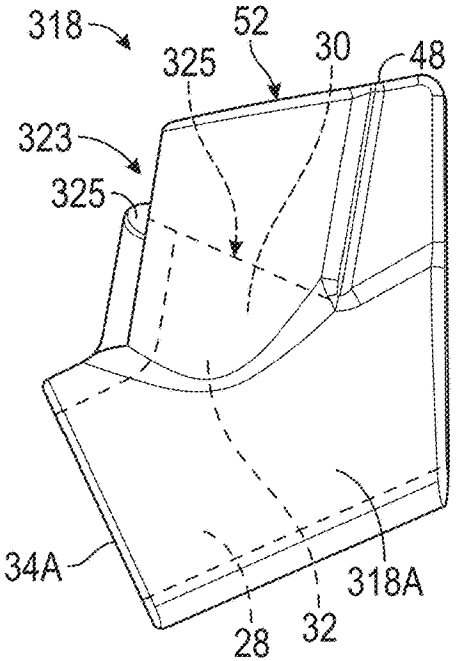
FIG. 13 is a side view of another embodiment of a cord lock.

FIGS. 13-15 show another embodiment of a lock body 318A of a cord lock 318 that is configured similarly to body 18A, with like reference numbers indicating like features. The description of the like features of the body 18A and their functions is applicable and is not repeated with respect to the body 318A for efficiency. The back of the lock body 318A forms a gap 323 along the second passage 30 opposite from the slot 44. This creates a sloped ledge 325 that is lower (e.g., closer to the first passage 28) than the top 52 of the side walls 48, 50. The gap 323 is sufficiently wide to allow the cord loop 16A to be pivoted 90 degrees further than the locked position of the second passage 30. Stated differently, the cord loop 16A can be pivoted to the second passage 30 to lock to the body 318A in a first locked position as described with respect to the body 18A, and optionally, by pivoting the cord loop 16A even further, the cord loop 16A can extend only partway through the second passage 30 and from the second passage 30 along the ledge 325 and out of the gap 323 rather than out at the top 52 of the body 318A. In the unlocked position and in both of the locked positions, the adjustment cord 16 extends through the first entrance opening 34A. A second lock body (not shown) configured symmetrically to the first lock body 318A may be provided and may be disconnected from the first lock body 318A or made integral with the first lock body 318A in any of the manners described herein with respect to one-piece cord lock embodiments.

Figure 16:
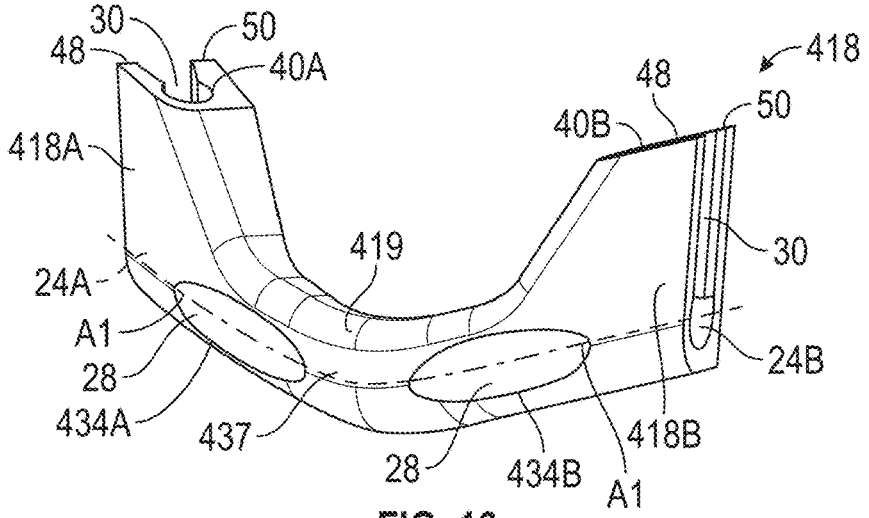
FIG. 16 is a front perspective view of another embodiment of a cord lock.
Figure 17:
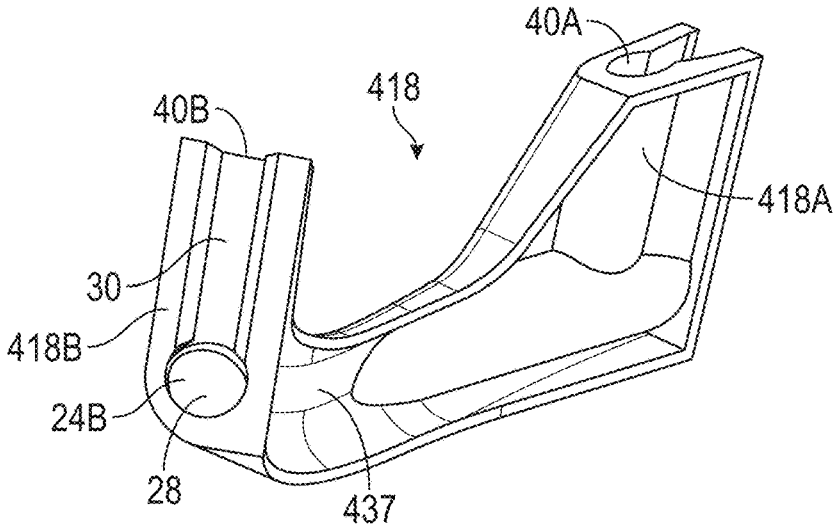
FIG. 17 is a rear perspective view of the cord lock of FIG. 16.
Figure 18:
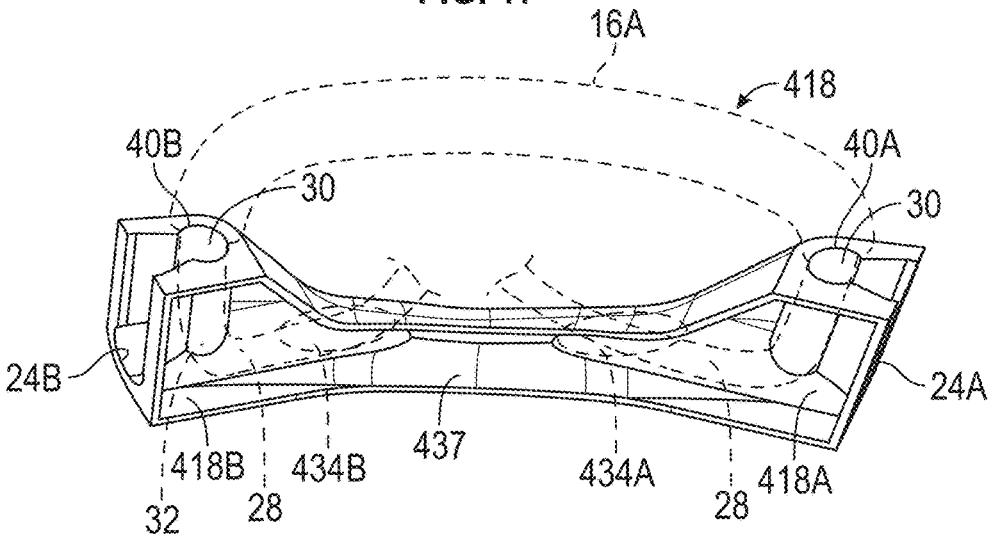
FIG. 18 is another rear perspective view of the cord lock of FIG. 16.

FIGS. 16-18 show another embodiment of a cord lock 418 that is a unitary, one-piece component with symmetrical first and second lock bodies 418A, 418B that are integral with one another. The relative positions of the first entrance openings 434A, 434B, the first exit openings 24A, 24B, and the second exit openings 40A, 40B is as described with respect to the corresponding openings of the cord lock 218. Instead of a single mounting flange, the lock bodies 418A, 418B are extended together to connect at a midportion 437 of the cord lock 418, and the longitudinal axes A1 of the first passages 28 are non-perpendicular to the outer surface 419 of the cord lock 418 so that the first entrance openings 434A, 434B are elliptical rather than circular. The adjustment cord 16 thus enters near the middle of the cord lock 418 (i.e., at entrance openings 434A, 434B) and exits near the ends of the cord lock 418 (i.e., either at first exit openings 24A, 24B or at second exit openings 40A, 40B).

Figure 19:
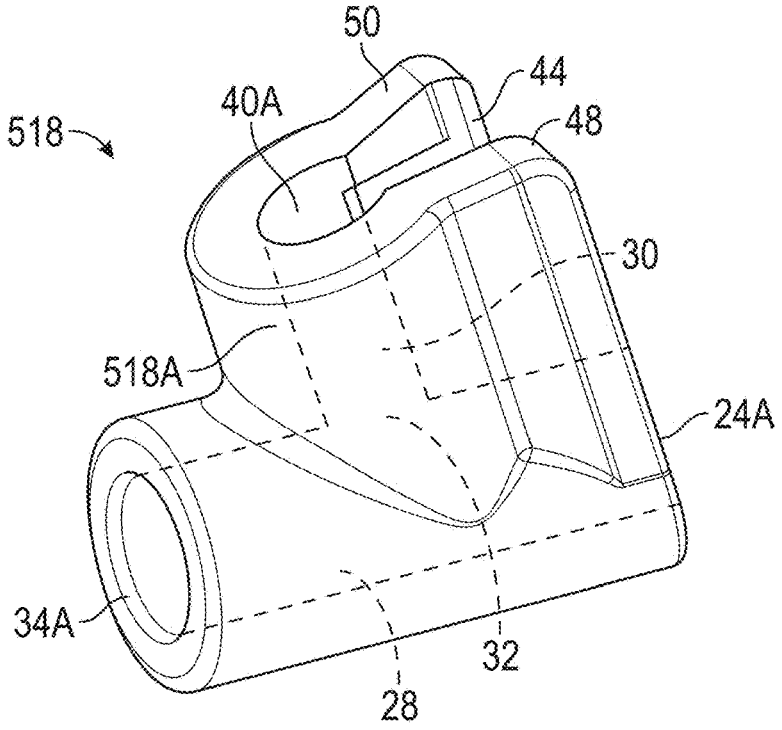
FIG. 19 is a side perspective view of another embodiment of a cord lock.
Figure 20:
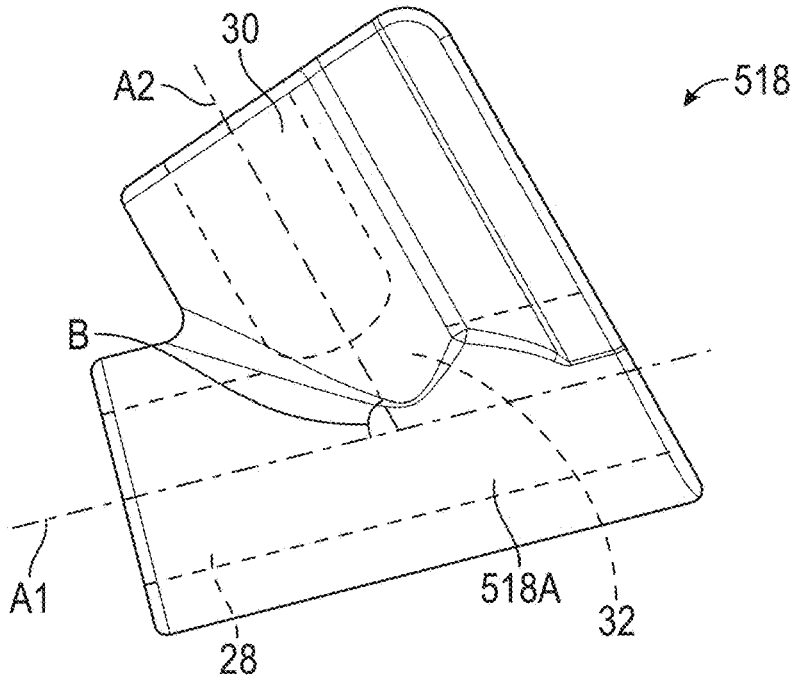
FIG. 20 is a side view of the cord lock of FIG. 19.

FIGS. 19-20 show another embodiment of a cord lock 518 and lock body 518A identical to cord lock 18 and lock body 18A except that the angle B between the longitudinal axis A2 of the second passage 30 and the longitudinal axis A1 of the first passage 28 is acute rather than obtuse. The adjustment cord 16 will thus be more severely angled when disposed in the locked position in the lock body 518A. This may be desirable in some applications in which a more rearward-extending locked position of the cord loop 16A is desired.

Figure 21:
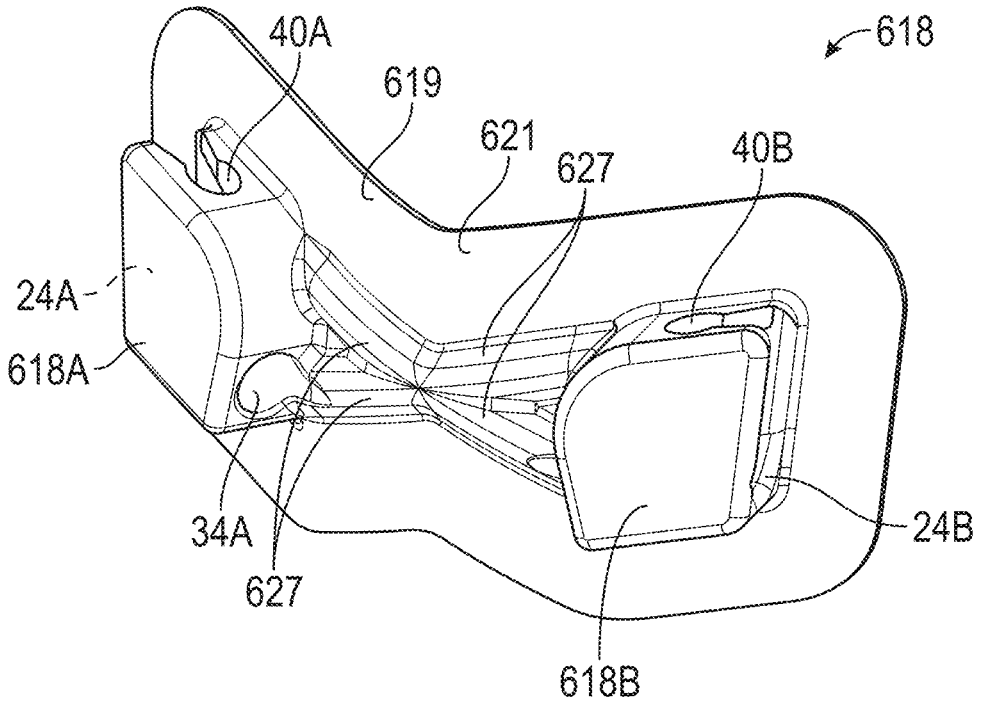
FIG. 21 is a front perspective view of another embodiment of a cord lock.
Figure 22:
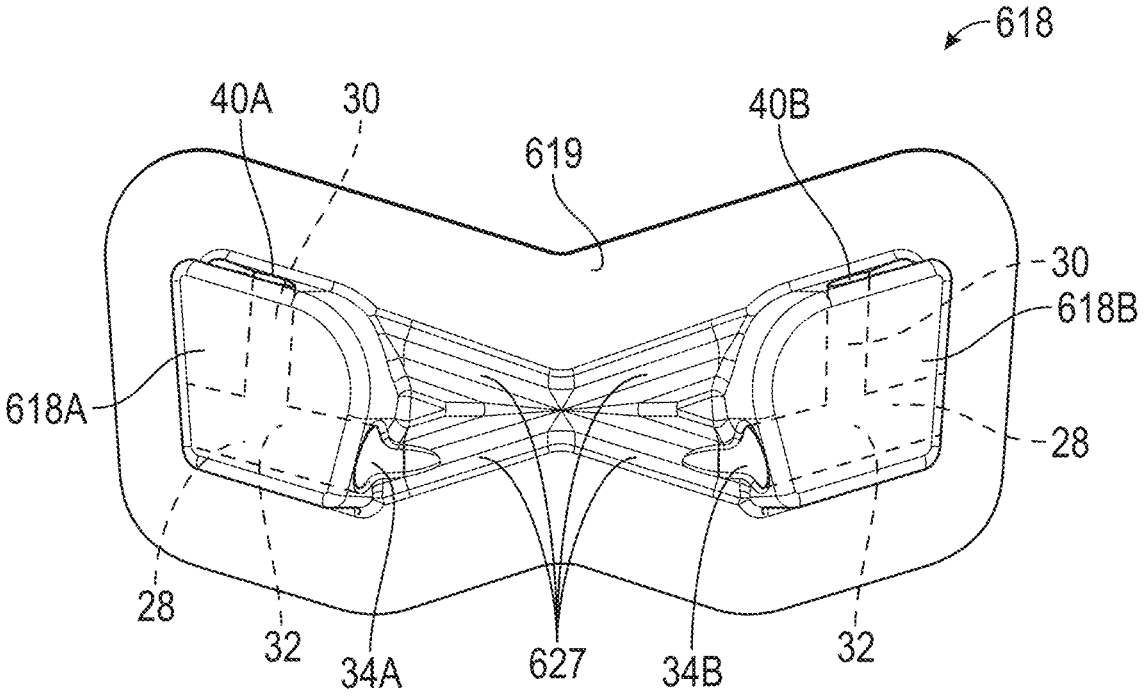
FIG. 22 is another front perspective view of the cord lock of FIG. 21.

FIGS. 21 and 22 show another embodiment of a cord lock 618 having a first lock body 618A and a second lock body 618B integral with and configured symmetrically to the first lock body 618A. The bodies 618A and 618B are configured similarly to bodies 18A and 18B, and also to bodies 218A, 218B, respectively, with like reference numbers indicating like features. The description of the like features of the bodies 18A, 18B and 218A, 218B and their functions is applicable and is not repeated with respect to the bodies 618A, 618B for efficiency.

The cord lock 618 includes a single mounting flange 619 to which both the first lock body 618A and the second lock body 618B are connected and which is configured to mount to a wearable article. Accordingly, the cord lock 618 including the first lock body 618A, the second lock body 618B, and the mounting flange 619 is a single, unitary one-piece component. The mounting flange 619 includes strengthening ribs 627 arranged in an X shape at a center portion 621 of the mounting flange 619. Similar to FIG. 11, the entrance openings 34A, 34B are nearer to one another than are the first exit openings 24A, 24B, and the adjustment cord 16 thus enters nearer to the center of the cord lock 618 than to the two ends of the cord lock 618.

Figure 25:
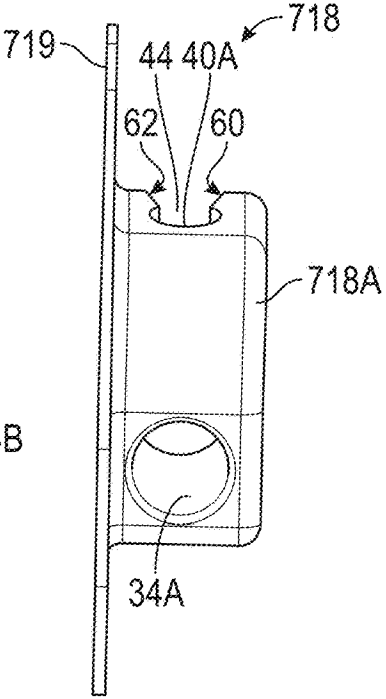
FIG. 25 is a side view of the cord lock of FIG. 23.
Figure 24:
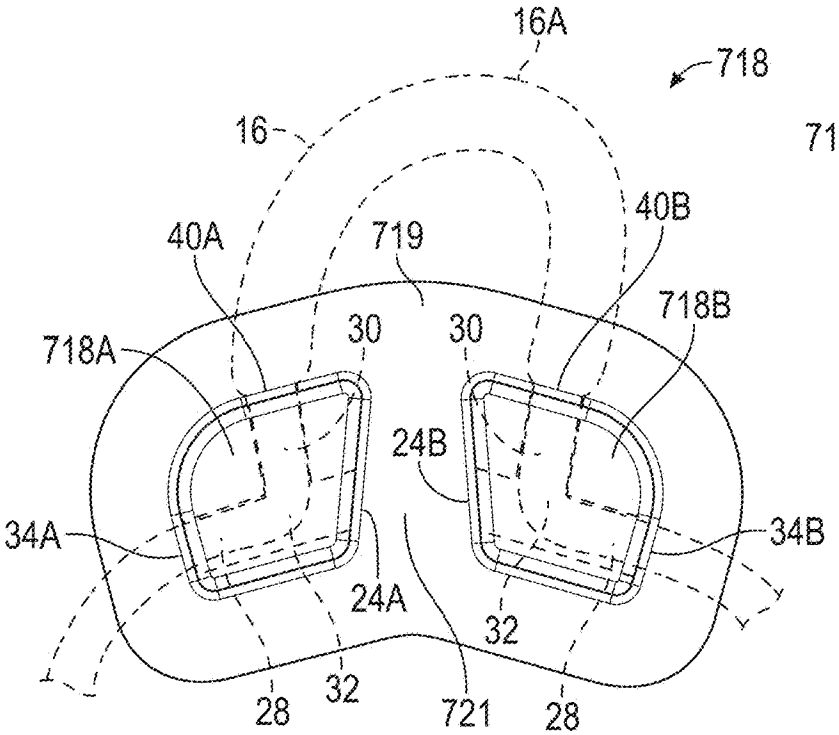
FIG. 24 is a front view of the cord lock of FIG. 23.
Figure 23:
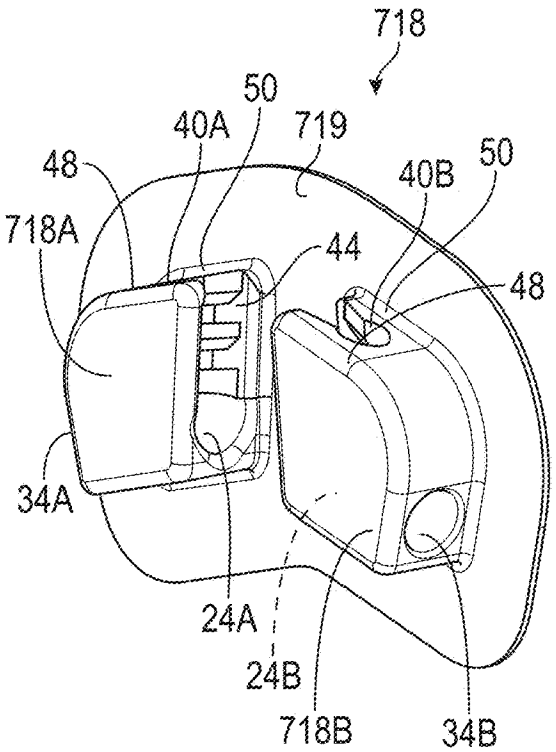
FIG. 23 is a side perspective view of another embodiment of a cord lock.

FIGS. 23-25 show another embodiment of a cord lock 718 having a first lock body 718A and a second lock body 718B integral with and configured symmetrically to the first lock body 718A. The bodies 718A and 718B are configured similarly to bodies 18A and 18B, and 218A, 218B, respectively, with like reference numbers indicating like features. The description of the like features of the bodies 18A, 18B and 218A, 218B and their functions is applicable and is not repeated with respect to the bodies 718A, 718B for efficiency.

The cord lock 718 includes a single mounting flange 719 to which both the first lock body 718A and the second lock body 718B are connected and which is configured to mount to a wearable article. Accordingly, the cord lock 718 including the first lock body 718A, the second lock body 718B, and the mounting flange 719 is a single, unitary one-piece component. The bodies 718A, 718B are configured with the entrance openings 34A, 34B further from the center portion 721 of the mounting flange 719 than are the first exit openings 24A, 24B. As shown in FIG. 24, the adjustment cord 16 would enter nearer the outer ends of the cord lock 718, with the loop portion 16A nearer the center portion 721 in the locked position.

Figure 26:
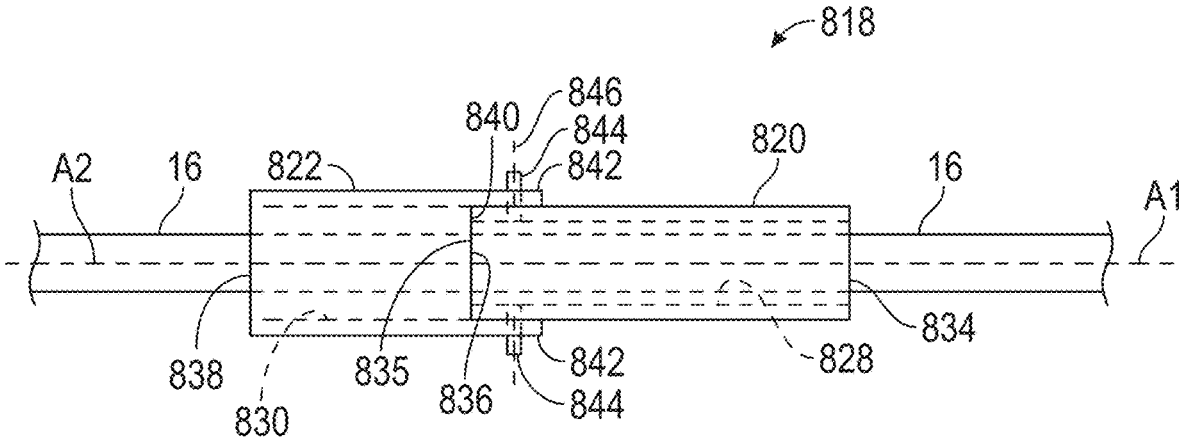
FIG. 26 is a top view of another embodiment of a cord lock in an unlocked position with an adjustment cord extending through the cord lock.
Figure 27:
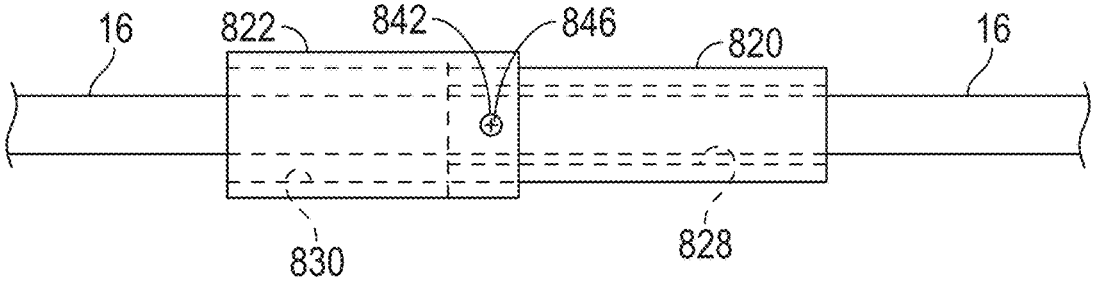
FIG. 27 is a side view of the cord lock of FIG. 26 with the adjustment cord extending through the cord lock.
Figure 28:
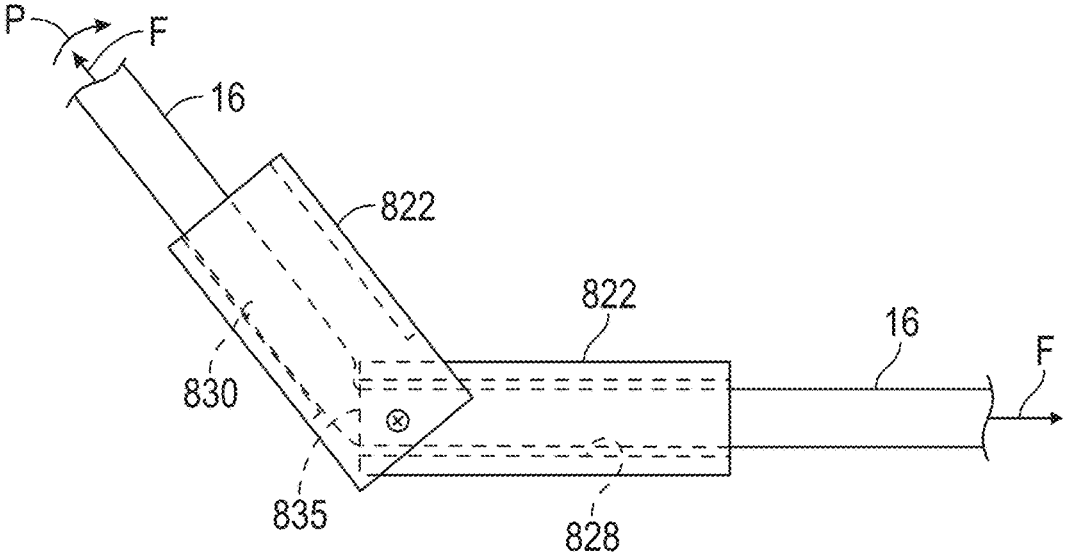
FIG. 28 is a side view of the cord lock of FIG. 27 in a locked position with the adjustment cord locked to the cord lock.

FIGS. 26-28 show an embodiment of an articulating cord lock 818, with the adjustment cord 16 shown extending through the cord lock 818. More specifically, the cord lock 818 includes a first body portion 820 and a second body portion 822. The body portions 820, 822 are elongated tubes with square cross-sections. The first body portion 820 includes a first passage 828 that extends completely through the first body portion 820 from an entrance opening 834 to an exit opening 835. The second body portion 822 includes a second passage 830 that extends completely through the second body portion 822 from an entrance opening 836 to an exit opening 838. The second passage 830 is a greater diameter than the first passage 828. The first passage 828 and the second passage 830 are both cylindrical and are of a greater diameter than the untensioned adjustment cord 16. As shown in the top view of FIG. 26, the end of the first body portion 820 is received within a notched end 840 of the second body portion 822 between side arms 842 of the second body portion 822. The side arms 842 are pivotably connected to the first body portion 820 with pivot pins 844 extending through or from the side arms 842 and into the walls of the first body portion 820, establishing a pivot axis 846 of the cord lock 818 so that the second body portion 822 is pivotably hinged to the first body portion 820 at the pivot axis 846.

When the body portions 820, 822 are arranged in an unlocked position shown in FIGS. 26 and 27, the exit opening 835 is adjacent to the entrance opening 836 and the first passage 828 is aligned with the second passage 830 (e.g., the longitudinal axis A1 of the first passage 828 is coaxial with the longitudinal axis A2 of the second passage 830) so that the adjustment cord 16 extends through the cord lock 818 and can slide in the passages 828, 830 relative to the cord lock 818.

To lock the adjustment cord 16 to the cord lock 818, the adjustment cord 16 may be tensioned by pulling the cord 16 along its longitudinal axis away from the cord lock 818 as shown by arrows F of FIG. 28. At least one end (as shown) of the cord 16 should be anchored. Simultaneously pivoting the cord 16 (as shown by pivot arrow P) while tensioning the cord 16 causes the second body portion 822 to pivot relative to the first body portion 820 at pivot axis 846 so that the second passage 830 is no longer coaxial with the first passage 828. The cord 16 is pinched against the inner surface of the second body portion 822 at the exit opening 835 of the first body portion 820. For example, the inner surface of the second body portion 822 may be narrowed at the exit opening 835, such as with side walls that extend toward one another, or with protrusions that extend into the second passage 830 from the inner surface similar to the side walls 48, 50 and protrusions 70 described with respect to the cord lock 18. A releasable one-way ratchet or other locking mechanism may be used to releasably lock the first body portion 820 and the second body portion 822 in the locked position shown in FIG. 28 to retain the tension in the portion of the adjustment cord 16 between the exit opening 835 and the anchored end of the adjustment cord 16.

Figure 29:
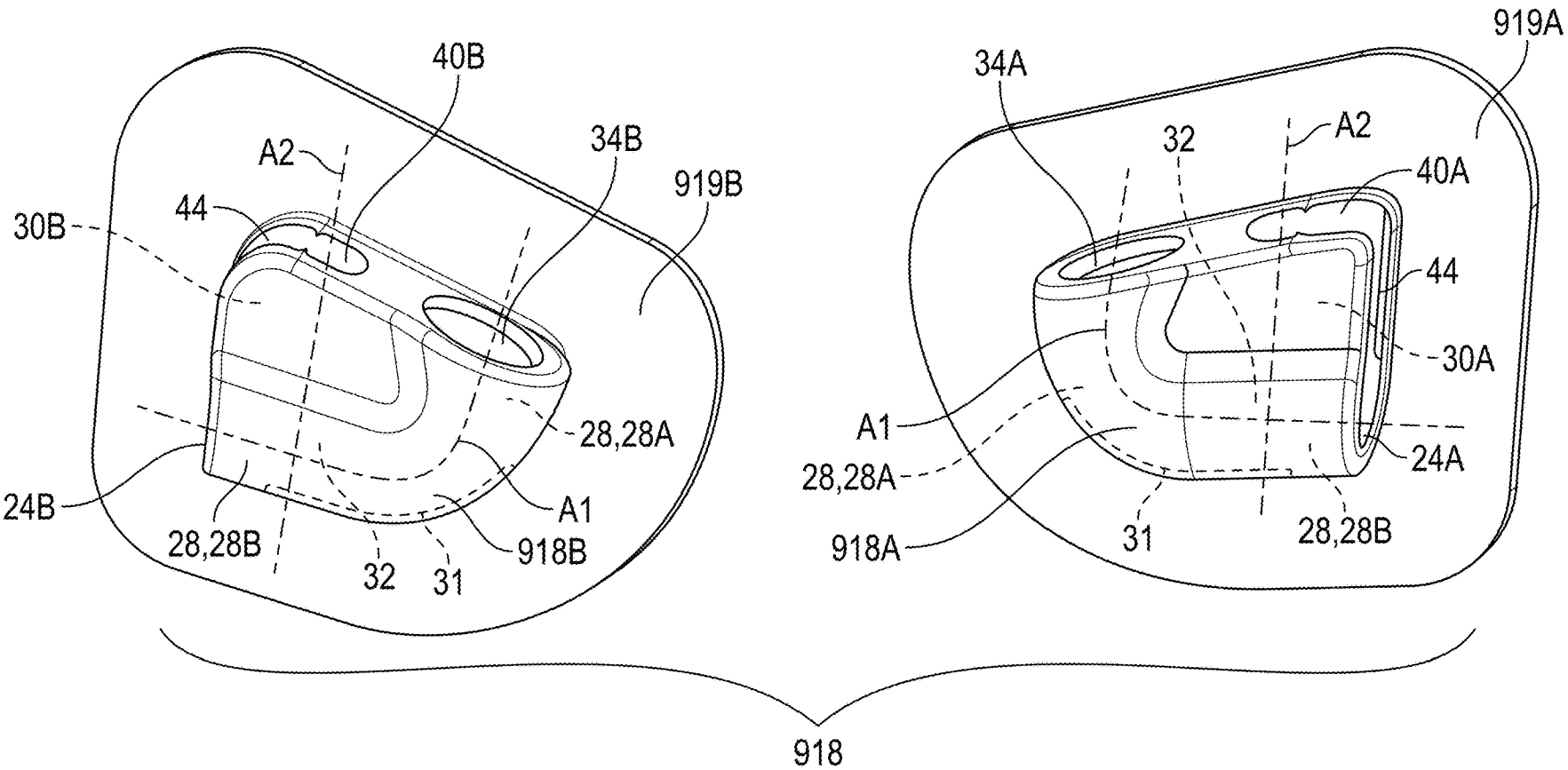
FIG. 29 is a front perspective view of another embodiment of a cord lock.
Figure 30:
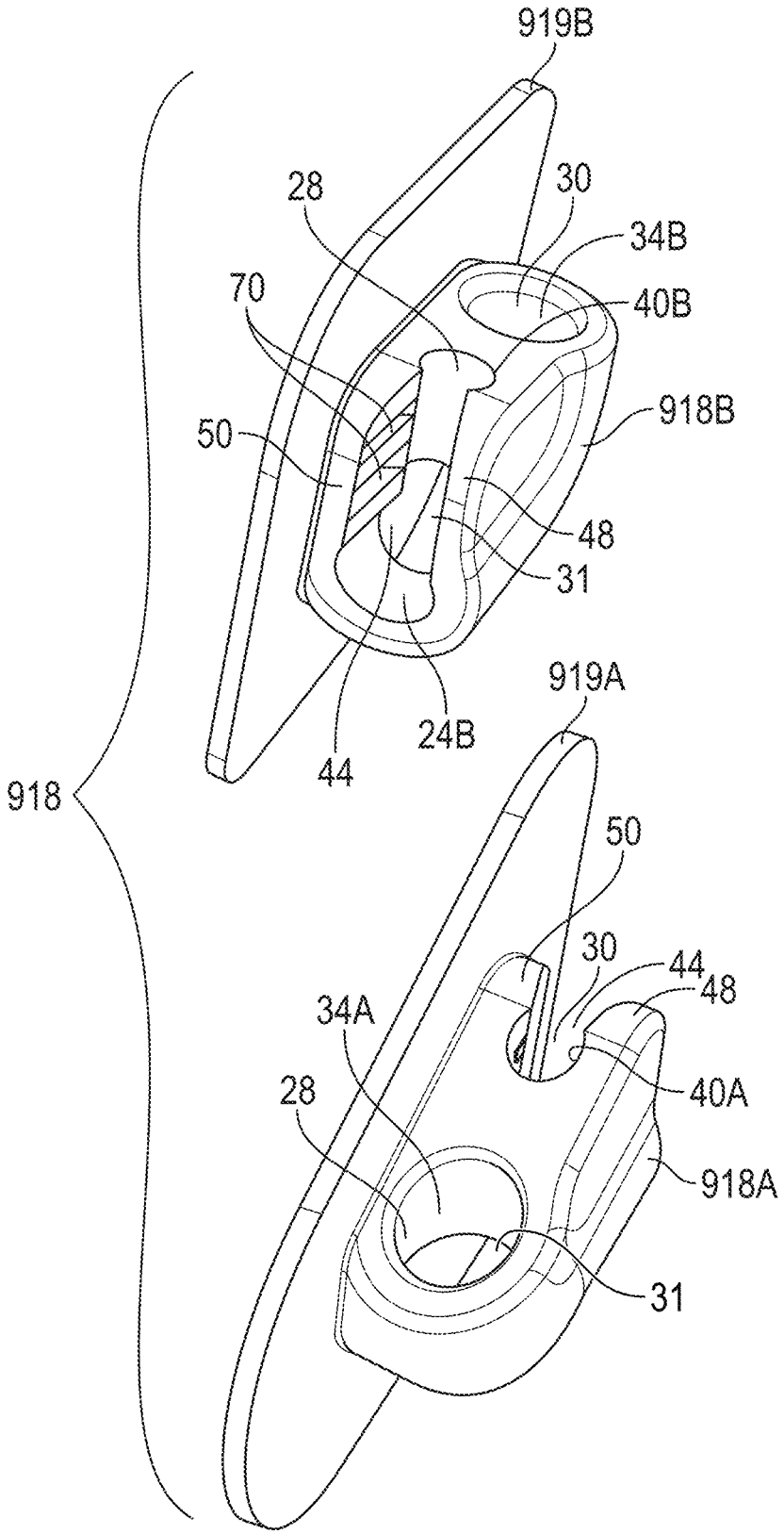
FIG. 30 is a top perspective view of the cord lock of FIG. 29.

FIGS. 29 and 30 show another embodiment of a cord lock 918 that includes a first lock body 918A and a second lock body 918B configured symmetrically to the first lock body 918A. The bodies 918A and 918B are configured similarly to bodies 18A and 18B, and 218A, 218B, respectively, with like reference numbers indicating like features. The description herein of the like features of the bodies 18A, 18B and 218A, 218B and their functions is applicable to and is not repeated with respect to the bodies 918A, 918B for efficiency.

FIG. 29 is a front perspective view and FIG. 30 is another perspective view showing the cord lock 918 from above. The lock bodies 918A, 918B are shown as separate (non-integral) lock bodies, each with its own respective mounting flange 919A, 919B. Alternatively, the lock bodies 918A, 918B could be integrated together on a single mounting flange. In FIG. 29, lock bodies 918A, 918B are not in the same relative positions as in the view of FIG. 30, nor in the same relative positions as when secured to the upper 112 of FIG. 31.

Instead of a straight first passage 28 as in the lock body 18A, each of the lock bodies 918A, 918B is configured with an arcuate first passage 28 (e.g., arcuate along its longitudinal axis A1) having a first segment 28A and a second segment 28B and turning approximately 90 degrees between the respective first entrance opening 34A, 34B and first exit opening 24A, 24B. The narrower second passage 30 extends from an intermediate portion 32 of the first passage 28 along the same face of the lock bodies 918A, 918B as the entrance openings 34A, 34B, respectively. The second passage 30 exits at exit openings 40A, 40B generally parallel with a first segment 28A of the first passage at the second exit opening 40A, 40B.

FIG. 30 shows that each lock body 918A, 918B defines a slot 44 extending from the first exit openings 24A, 24B to the second exit openings 40A, 40B, respectively. Protrusions 70 extend inward from angled side walls 48, 50 into the slot 44. A window 31 extends through the lock body 918A, 918B along portions of both the first passage 28 and the second passage 30, but does not extend completely to the entrance opening 34A, 34B or to the first exit opening 24A, 24B.

Figure 31:
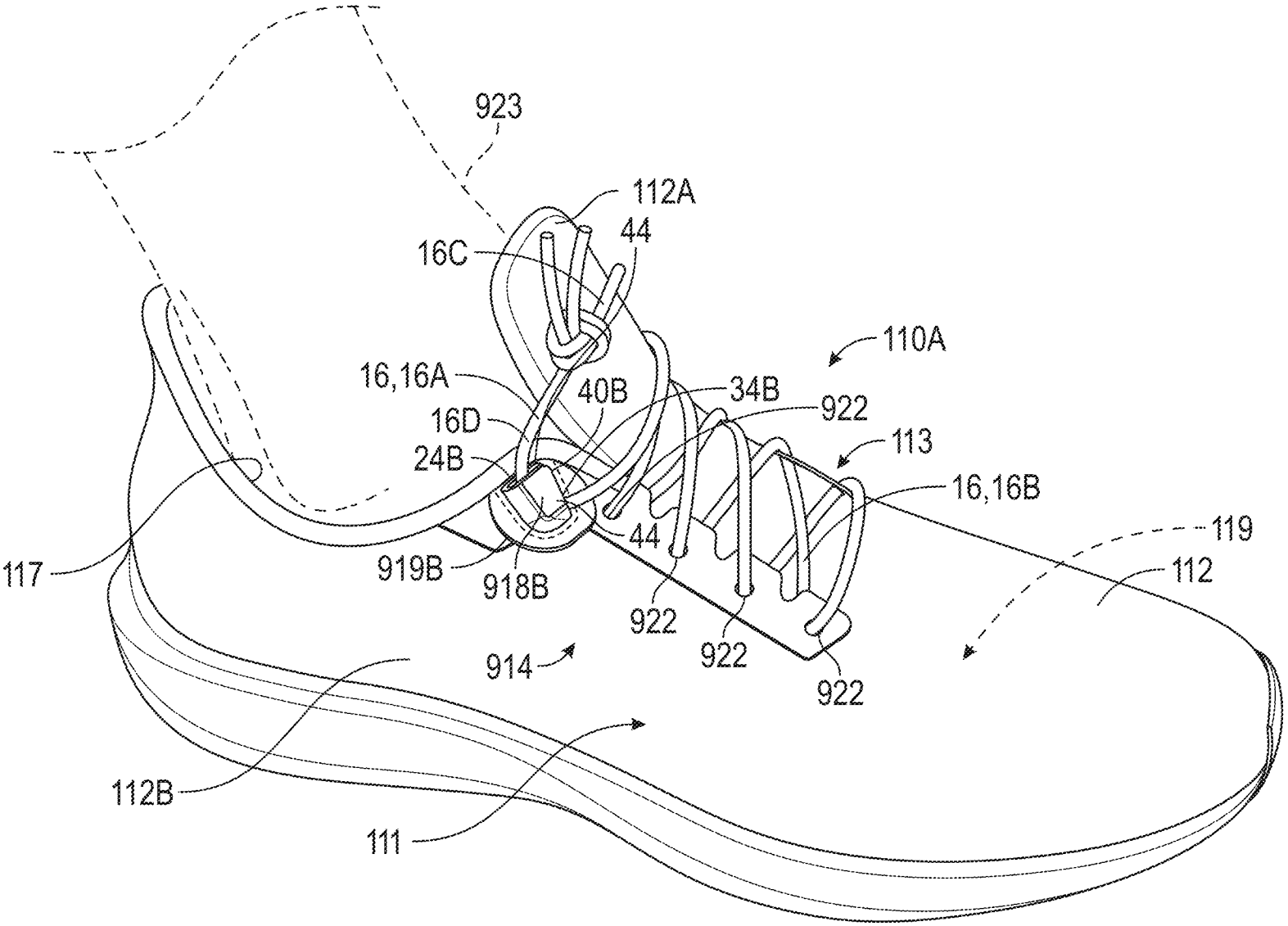
FIG. 31 is a lateral perspective view of an article of footwear including the cord lock of FIG. 29 and an adjustment cord in an untensioned state.

FIG. 31 is a lateral perspective view of an article of footwear 110A including a tensioning system 914 with the cord lock 918 of FIG. 29. The tensioning system 914 is secured to the upper 112 and cinches the upper 112 to adjust the size of the foot-receiving cavity 119, securing the upper 112 around a foot 923 therein. The tensioning system 914 includes the lock 918 of FIG. 29, the adjustment cord 16, and a plurality of cord guides configured as eyelets 922 extending through the upper 112. Only one row of eyelets is shown, but another row generally parallel with the row shown is at the medial side 113 of the upper 112. Only one of the lock bodies 918B is visible on the lateral side 111 of the upper 112 in FIG. 31. The lock body 918A is disposed on the medial side 113 of the upper 112 in a mirror arrangement to lock body 918B. The lock bodies 918A, 918B are secured to side walls 112B at the lateral and medial sides of the upper 112 rather than to the tongue region 112A as in FIGS. 7-8.

As best illustrated with respect to lock body 918B, the lock bodies 918A, 918B are secured to the upper 112 in alternate relative positions to one another than in FIGS. 29 and 30. More specifically, the slots 44 are disposed generally upward and inward (toward the centerline of the footwear 110A), with the first entrance openings 34A, 34B generally facing one another adjacent the eyelets 922 and the first exit openings 24A, 24B disposed generally upward and closer to the foot opening 117 than to the entrance openings 34A, 34B. The adjustment cord 16 is in an untensioned and unlocked state in FIG. 31. The loop portion 16A of the cord 16 is shown as two end portions 16C, 16D knotted together but could instead be formed as a continuous loop. Alternatively, the end portions 16C, 16D could be untied from one another to separately secure to the respective lock bodies 918A, 918B.

Figure 32:
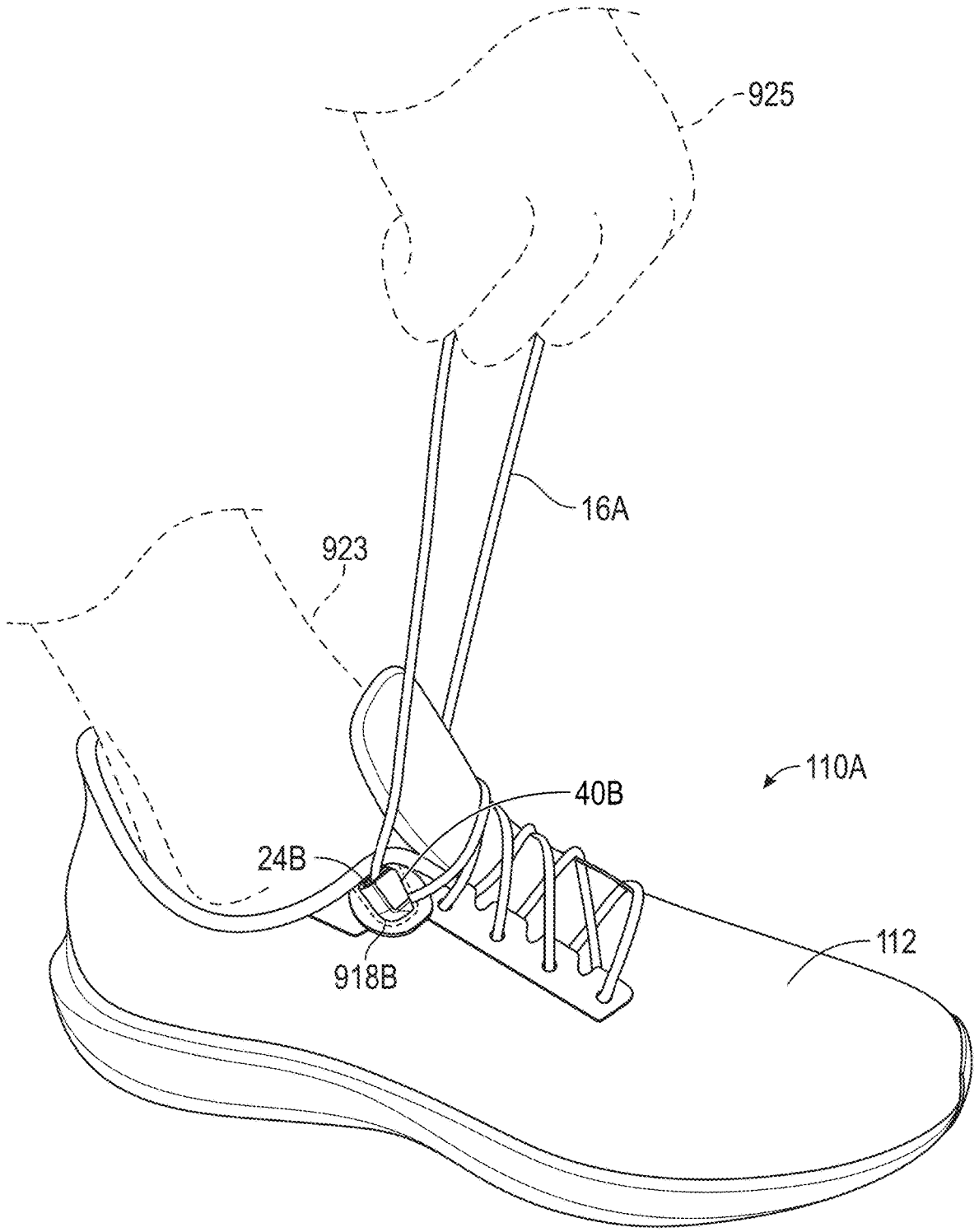
FIG. 32 is a lateral perspective view of the article of footwear of FIG. 31 showing the adjustment cord being tensioned.

FIG. 32 is a lateral perspective view of the article of footwear 110A of FIG. 31 showing the adjustment cord 16 being tensioned by a wearer using a hand 925 to manually pulling on the loop portion 16A. The loop portion 16A still exits from the first exit openings 24A, 24B during the tensioning step of FIG. 32. Tensioning of the adjustment cord 16 in this manner tightens the upper 112 over the foot 923. The loop portion 16A extends out of the respective second exit openings 40A, 40B. Only 40B is visible in FIG. 34.

Figure 33:
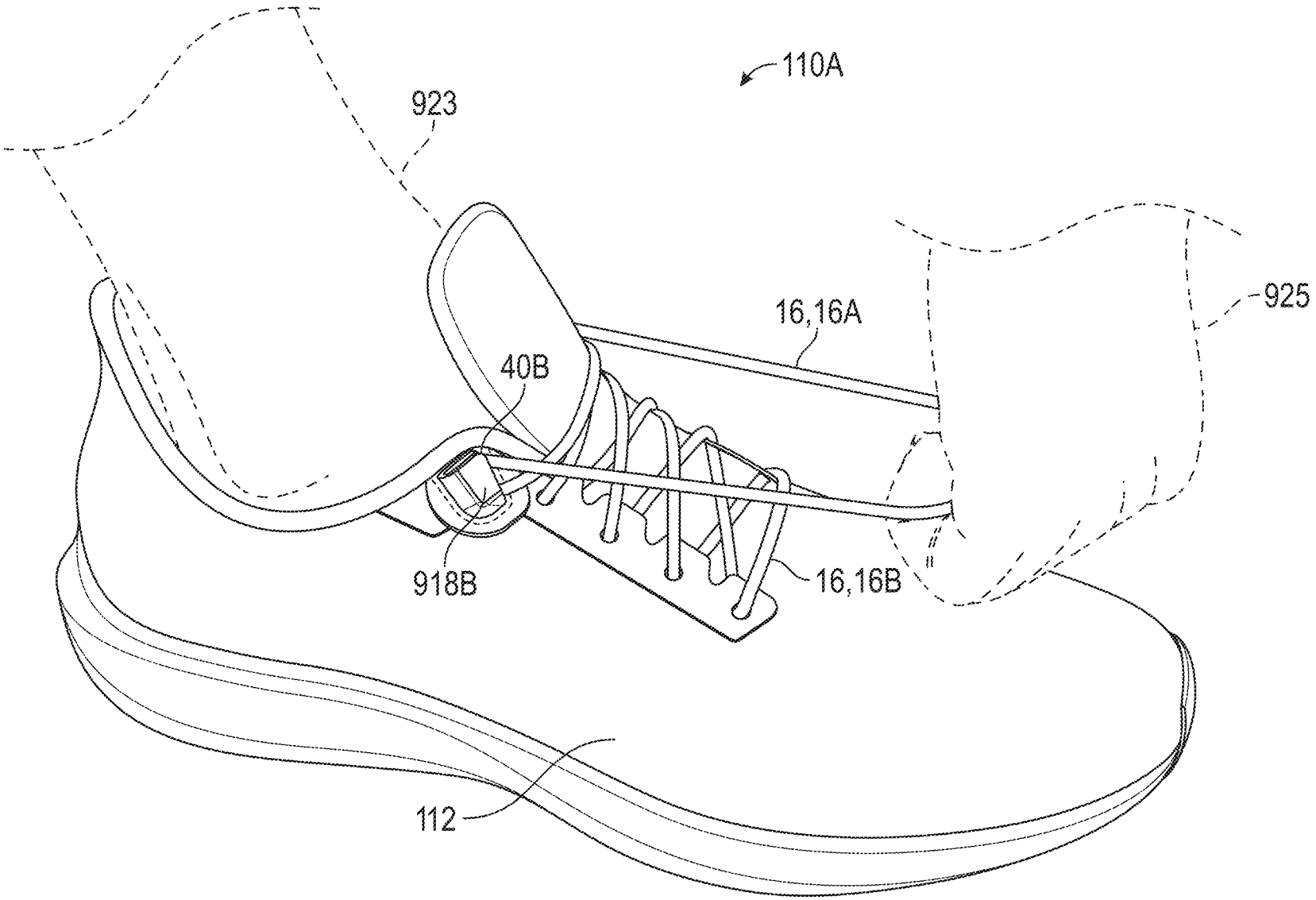
FIG. 33 is a lateral perspective view of the article of footwear of FIG. 32 with the adjustment cord being pivoted to a locked position.
Figure 34:
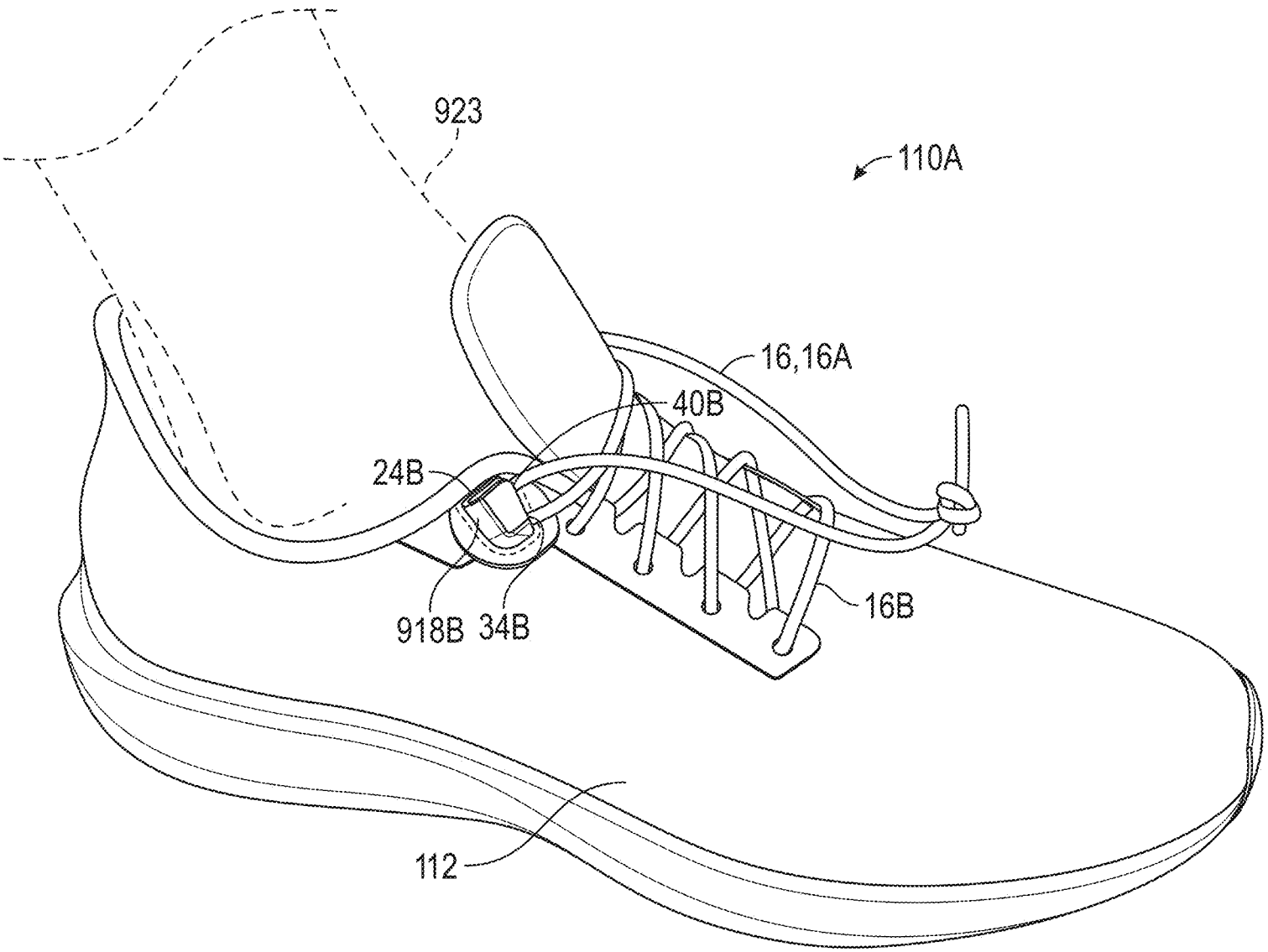
FIG. 34 lateral perspective view of the article of footwear of FIG. 33 with the adjustment cord in the locked position.

FIG. 33 is a lateral perspective view of the article of footwear 110A with the adjustment cord 16 being pivoted by hand 925 away from the first exit openings 24A, 24B (shown) to eventually exit the lock bodies 918A, 918B from the second exit openings 40A, 40B so that the loop portion 16A locks to the lock bodies 918A, 918B. FIG. 34 is a lateral perspective view of the article of footwear 110A with the adjustment cord 16 in the locked position and extending out of second exit openings 40A, 40B (shown) to maintain tension in the portion 16B and maintain the upper 112 tightened around the foot 923.

FIGS. 35-39 show another embodiment of a cord lock 1018 having a first lock body 1018A and a second lock body 1018B integral with and configured symmetrically to the first lock body 1018A. The lock bodies 1018A and 1018B are configured similarly in some aspects to lock bodies 18A and 18B, and 218A, 218B, respectively, with like reference numbers indicating like features. The description of the like features of the bodies 18A, 18B and 218A, 218B and their functions is applicable and is not repeated with respect to the lock bodies 1018A, 1018B for efficiency.

Figure 39:
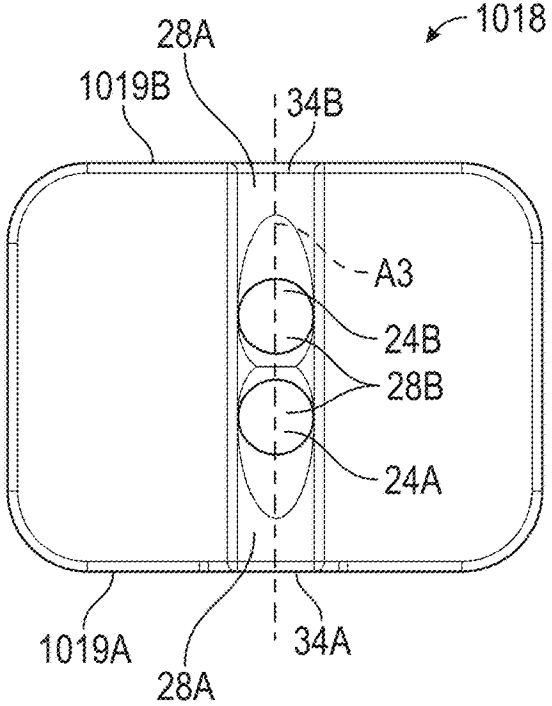
FIG. 39 is a bottom view of the cord lock of FIG. 35.
Figure 38:
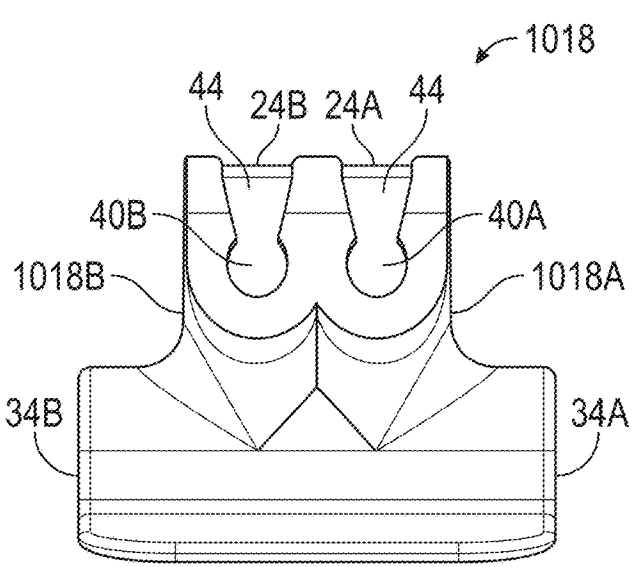
FIG. 38 is a front view of the cord lock of FIG. 35.

The cord lock 1018 includes a single mounting flange 1019 to which both the first lock body 1018A and the second lock body 1018B are connected and which is configured to mount to a wearable article. Accordingly, the cord lock 1018 including the first lock body 1018A, the second lock body 1018B, and the mounting flange 1019 is a single, unitary one-piece component. The lock bodies 1018A, 1018B are configured with the entrance openings 34A, 34B offset by 90 degrees from the first exit openings 24A, 24B. The entrance openings 34A, 34B are at first and second sides 1019A, 1019B of the mounting flange 1019, respectively, while the first exit openings 24A, 24B are disposed outward from a center of the mounting flange 1019. Additionally, the entrance openings 34A, 34B are aligned with one another and in communication with one another (as best shown in FIG. 39). More specifically, the first passage 28 of each of the lock bodies 1018A, 1018B, respectively, is arcuate, having a first longitudinal axis A1 that turns approximately 90 degrees between the entrance openings 34A, 34B and the first exit openings 24A, 24B.

Figure 37:
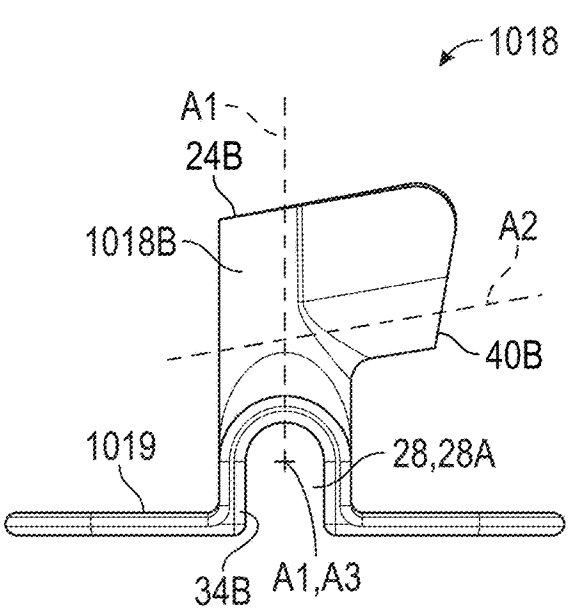
FIG. 37 is a side view of the cord lock of FIG. 35.

Each first passage 28 has a first segment 28A. also referred to as an entrance portion, disposed along a common longitudinal axis A3 (referred to herein as a third longitudinal axis) which is coincident with a first portion of the first longitudinal axis A1, as best shown in FIG. 37. Each first passage 28 also has a second segment 28B, referred to as an exit portion, disposed at approximately 90 degrees to the first segment 28A. Each first passage 28 also has an intermediate portion 32 from which the respective second passage 30A, 30B extends along the longitudinal axis A2. The lock bodies 1018A, 1018B define the second exit openings 40A, 40B, best shown in FIG. 38. Each lock body 1018A, 1018B defines a slot 44 extending from the first exit opening 24A, 24B to the second exit opening 40A, 40B, respectively. Accordingly, the adjustment cord 16 (shown in FIG. 40) enters from opposite sides (first side 1019A and second side 1019B, labelled in FIGS. 35 and 36) of the mounting flange 1019 at the entrance openings 34A, 34B, extends through the first passages 28, turning 90 degrees to extend along the axes A1 out of the first exit openings 24A, 24B, and then turns another 90 degrees when pivoted through the slots 44 to extend from the intermediate portions 32 of the first passages 28 through the second passages 30 and out of the second exit openings 40A. 40B. As best shown in FIGS. 37 and 39, the first segments 28A of the first passages 28 are open at the bottom of the cord lock 1018 and are closed off by the article to which the cord lock 1018 is attached, such as by the upper 112 in FIG. 40.

Figure 35:
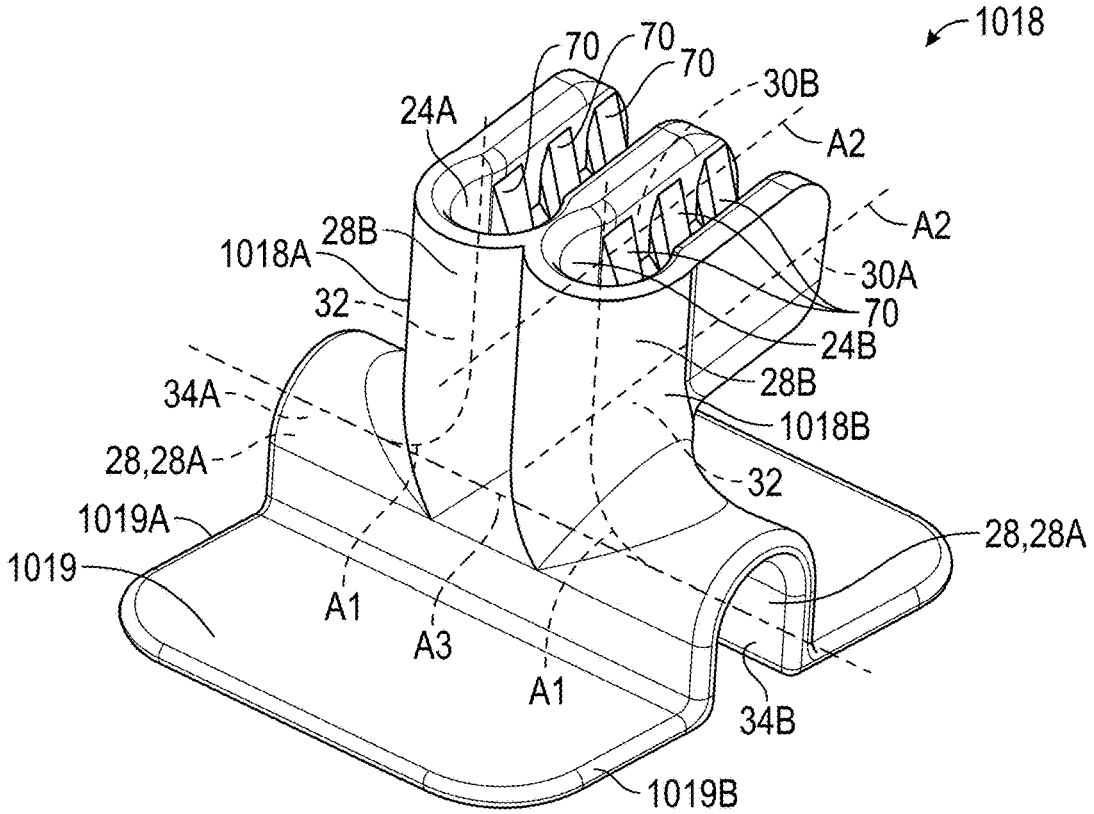
FIG. 35 is a rear perspective view of another embodiment of a cord lock.
Figure 36:
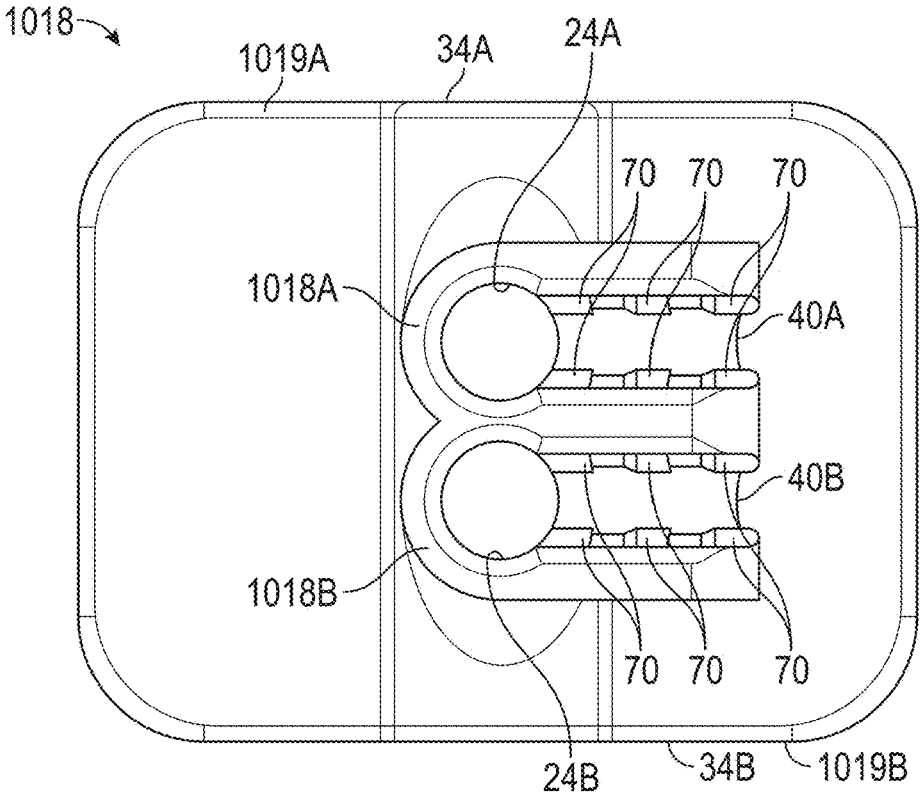
FIG. 36 is a top view of the cord lock of FIG. 35.
Figure 40:
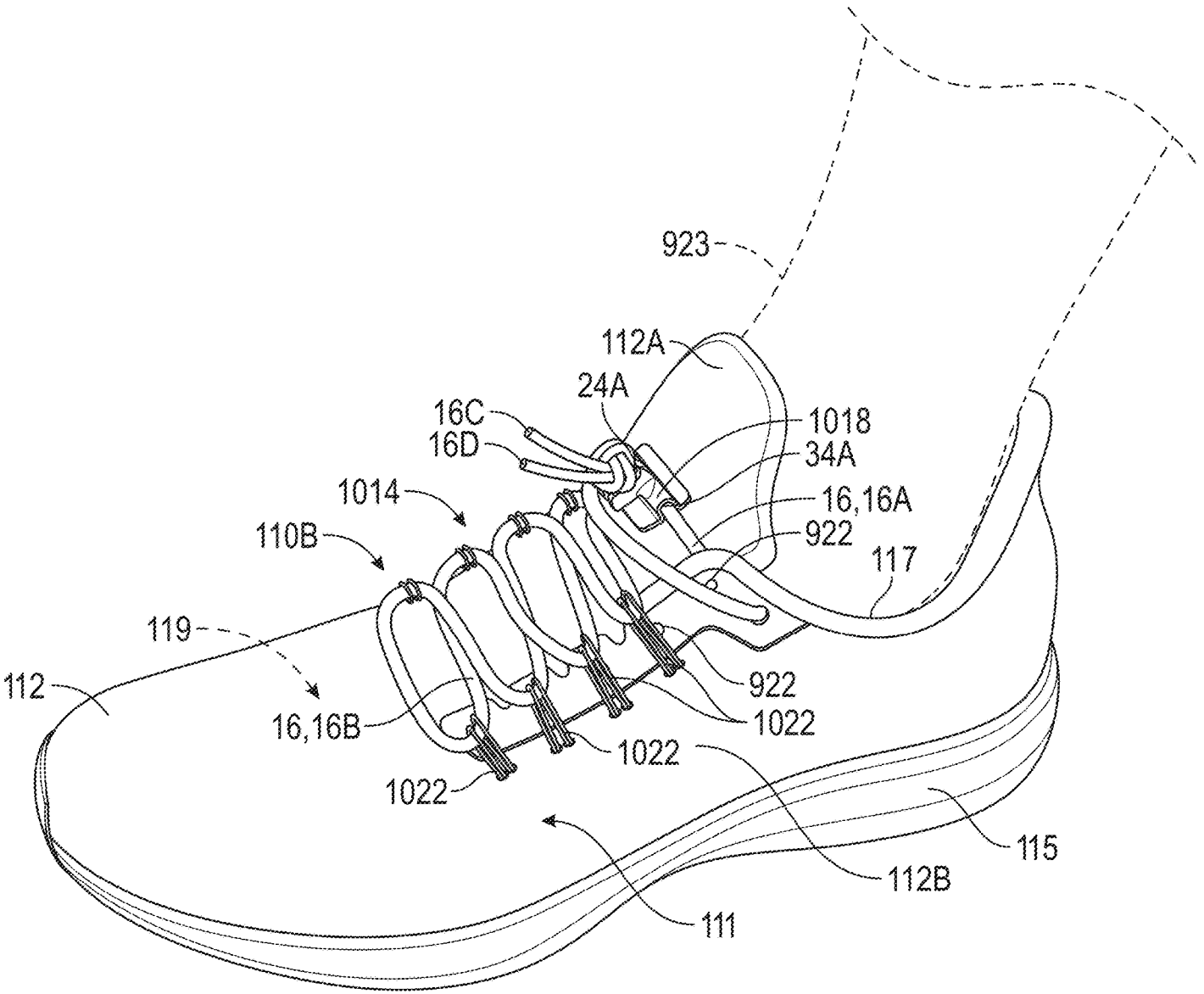
FIG. 40 is a lateral perspective view of an article of footwear including the cord lock of FIG. 35 and an adjustment cord in an untensioned state.

FIG. 40 is a lateral perspective view of an article of footwear 110B including a tensioning system 1014 with the cord lock 1018 of FIG. 35. It should be appreciated that the article of footwear 110B of FIG. 40 is configured for a left foot 923, while the article of footwear 110A of FIG. 31 is configured for a right foot. The tensioning system 1014 is secured to the upper 112 and cinches the upper 112 to adjust the size of the foot-receiving cavity 119, securing the upper 112 around a foot 923 therein. The tensioning system 1014 includes the cord lock 1018 of FIG. 35, the adjustment cord 16, and a plurality of cord guides 1022 configured as looped tensioning cables extending through the upper 112. The looped tensioning cables may be secured to the upper 112 or may extend through the upper 112 to the sole structure 115 where they are secured. Only one row of cord guides 1022 is shown, but another row generally parallel with the row shown is disposed at the medial side of the upper 112. Eyelets 922 may also be provided (some are shown). The cord 16 could also extend through the eyelets shown or could extend only through the eyelets instead of through the looped cord guides 1022, depending upon how the wearer chooses to thread the cord 16.

The cord lock 1018 is secured to the tongue region 112A of the upper rather than on side walls 112B at the lateral and medial sides. The slots 44 are disposed generally downward (away from the foot-receiving cavity 119) and the first exit openings 24A, 24B are disposed generally upward. The adjustment cord 16 is in an untensioned and unlocked state in FIG. 40. The loop portion 16A of the cord 16 is shown with two end portions 16C, 16D knotted together, but could instead be formed as a continuous loop. Alternatively, the end portions 16C, 16D could be untied from one another to separately secure to the respective lock bodies 1018A, 1018B.

Figure 41:
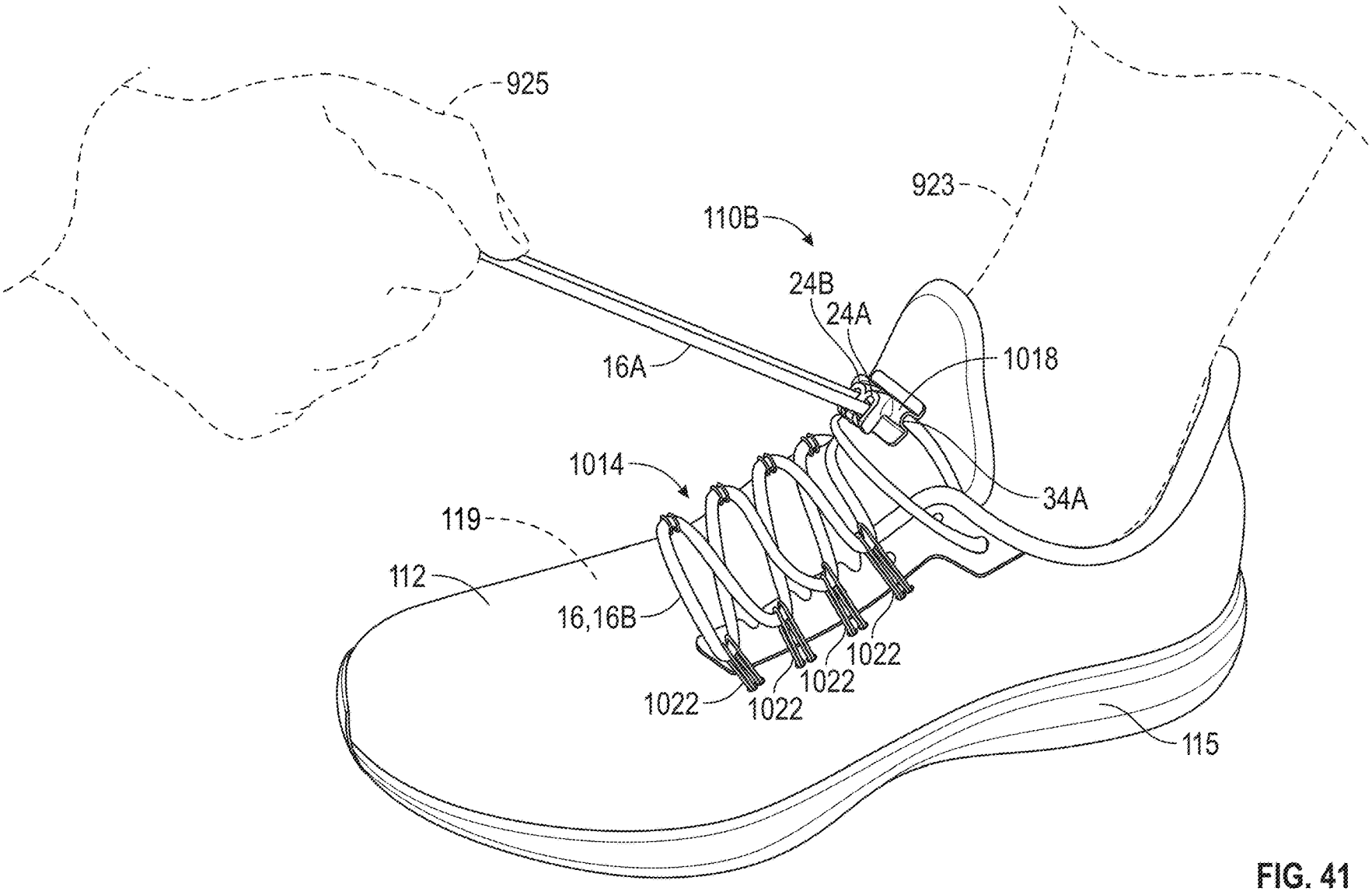
FIG. 41 is a lateral perspective view of the article of footwear of FIG. 40 showing the adjustment cord being tensioned.

FIG. 41 is a lateral perspective view of the article of footwear 110B of FIG. 40 showing the adjustment cord 16 being tensioned by a wearer using a hand 925 to manually pulling on the loop portion 16A, the loop portion 16A still exiting from the first exit openings 24A, 24B. Tensioning of the adjustment cord 16 in this manner may also tension the looped tensioning cables used as cord guides 1022 and tightens the upper 112 over the foot 923 in the foot-receiving cavity 119.

Figure 42:
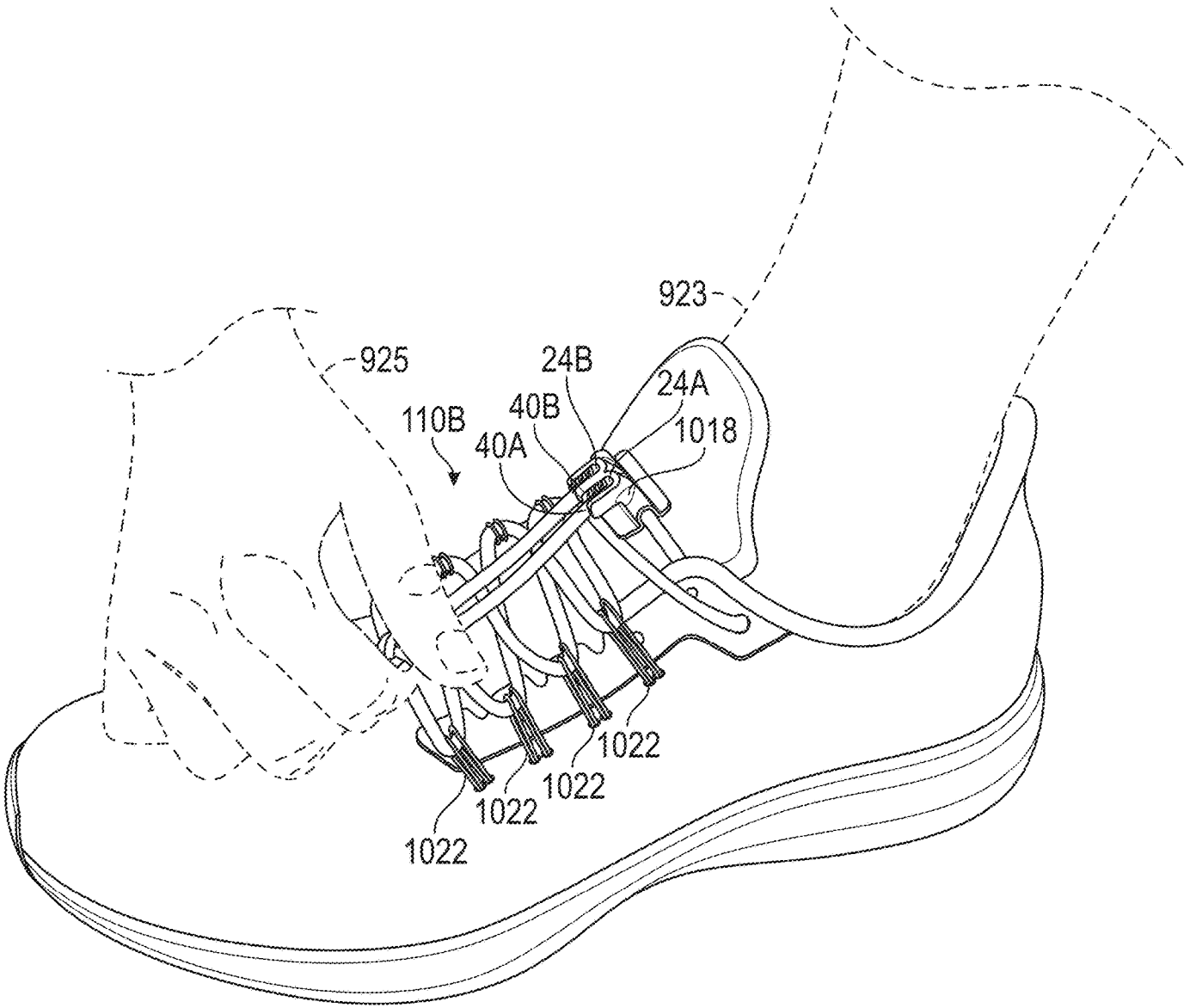
FIG. 42 is a lateral perspective view of the article of footwear of FIG. 41 with the adjustment cord being pivoted to a locked position.
Figure 43:
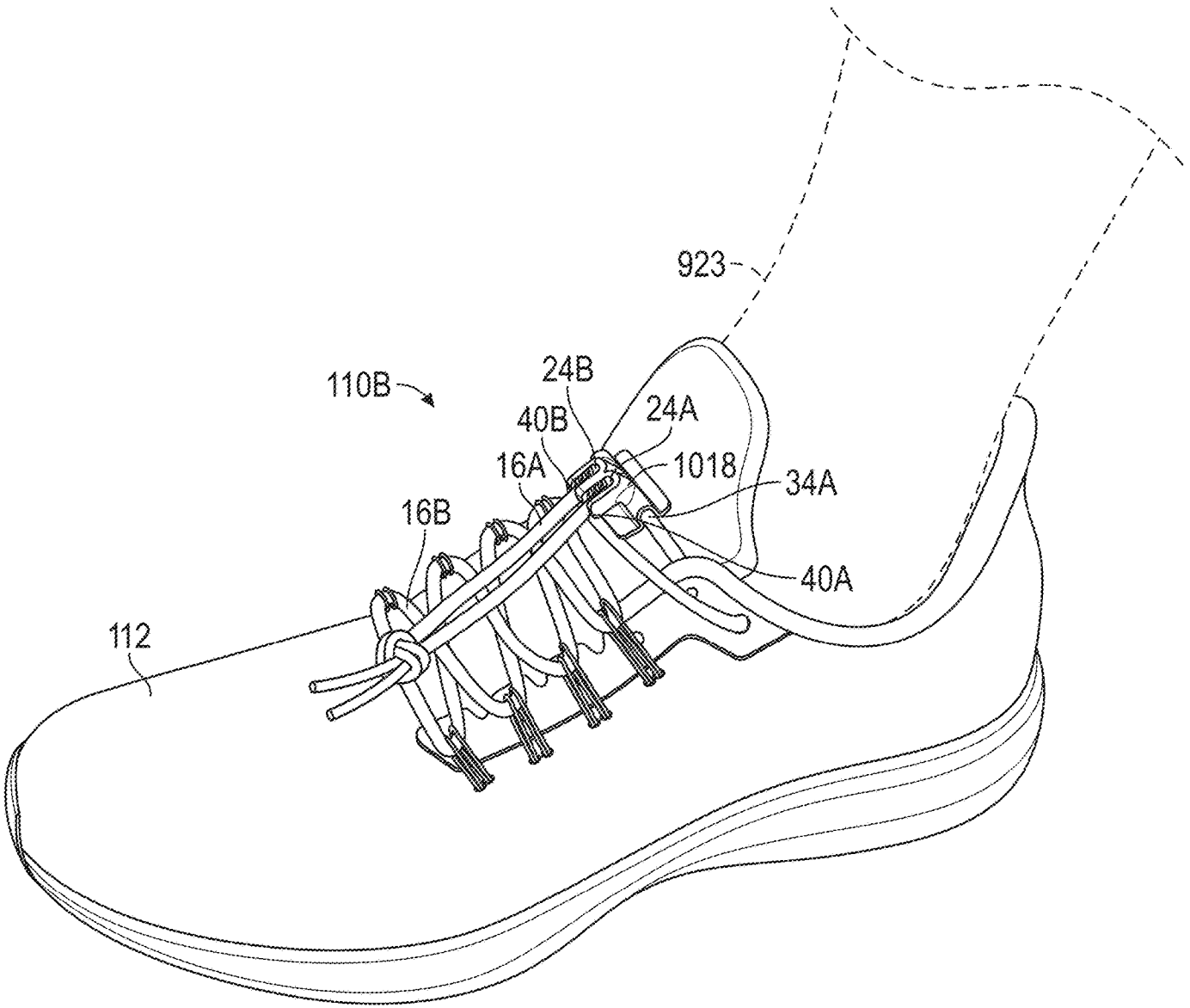
FIG. 43 lateral perspective view of the article of footwear of FIG. 42 with the adjustment cord in the locked position.

FIG. 42 is a lateral perspective view of the article of footwear 110B with the adjustment cord 16 being pivoted to exit the lock bodies 1018A, 1018B from the second exit openings 40A, 40B so that the loop portion 16A locks to the lock bodies 1018A, 1018B. FIG. 43 is a lateral perspective view of the article of footwear 110B with the adjustment cord 16 in the locked position to maintain tension in the portion 16B of the cord 16 and maintain the upper 112 tightened around the foot 923.

FIGS. 44-47 show another embodiment of a cord lock 1118 alike in all aspects to cord lock 1018 except that the first and second lock bodies 1118A, 1118B are configured so that the second passages 30 are disposed to extend above the first segment 28A of the first passages 28 with the second exit openings 40A, 40B adjacent to the entrance openings 34A, 34B, respectively, rather than offset by 90 degrees from the entrance openings 34A, 34B. The first lock body 1118A is integral with and configured symmetrically to the second lock body 1118B. The lock bodies 1118A and 1118B have some features configured similarly to corresponding features of lock bodies 18A, 18B, 218A, 218B, 1018A, and 1018B, respectively, with like reference numbers indicating like features. The description of the like features of the bodies 18A, 18B, 218A, 218B, 1018A, and 1018B and their functions is applicable and is not repeated with respect to the lock bodies 1118A, 1118B for efficiency.

Figure 46:
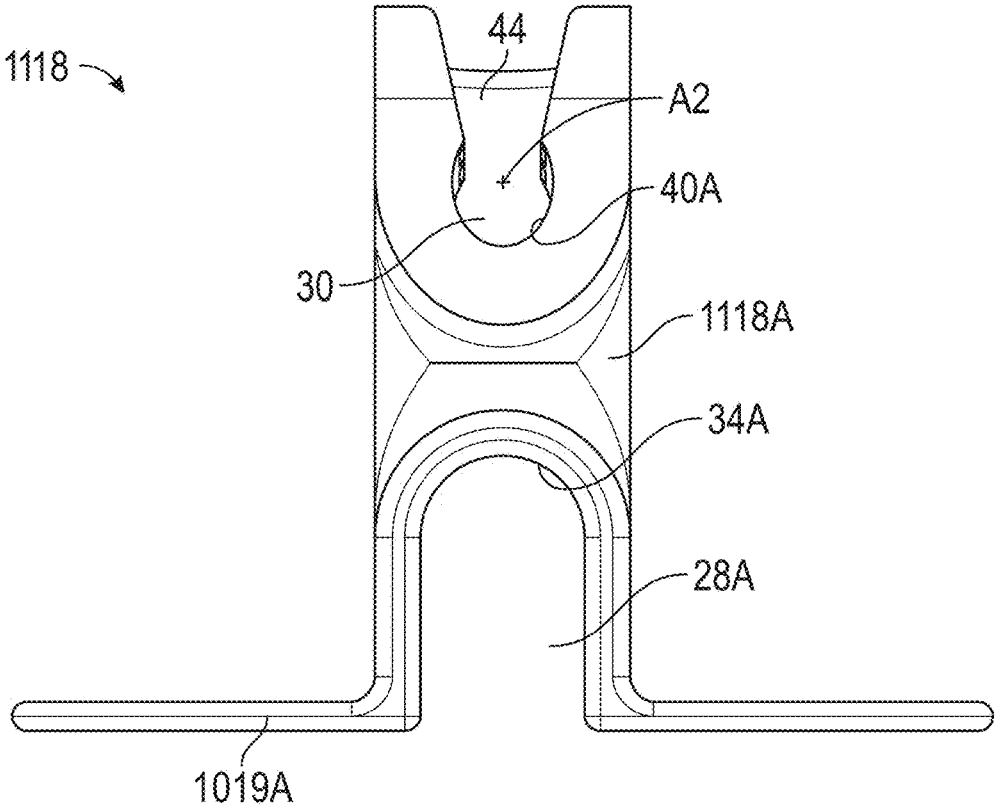
FIG. 46 is a side view of the cord lock of FIG. 44.
Figure 47:
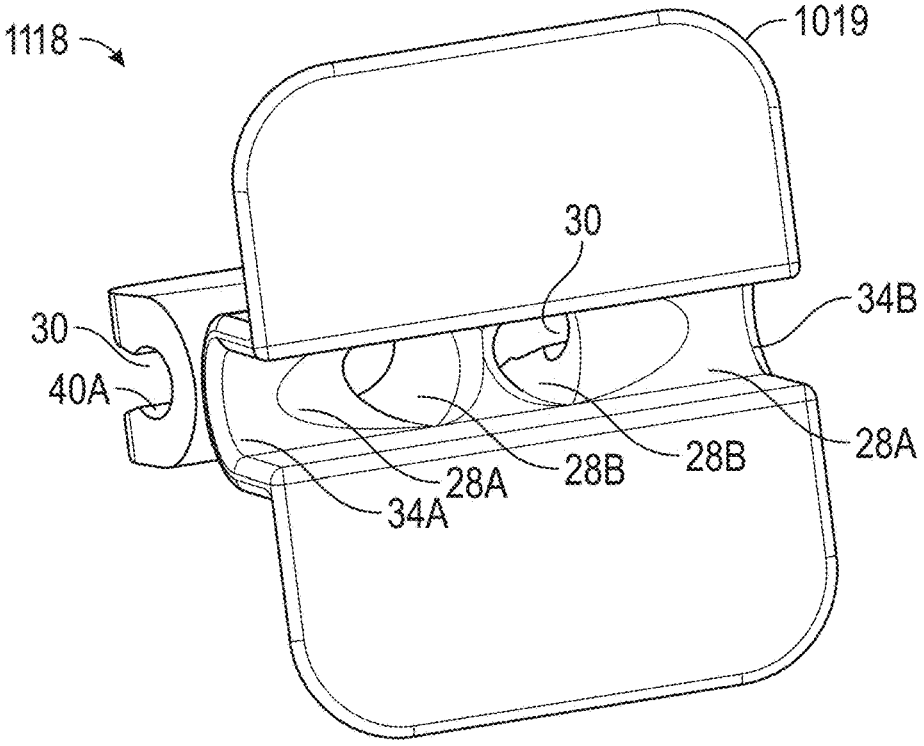
FIG. 47 is a bottom perspective view of the cord lock of FIG. 44.

Accordingly, the adjustment cord 16 would enter from opposite sides (e.g., first side 1019A and second side 1019B) of the mounting flange 1019 at the entrance openings 34A, 34B, extend through the first passages 28, turning approximately 90 degrees to extend along the axes A1 out of the first exit openings 24A, 24B, and then turn another 90 degrees when pivoted through the slots 44 to extend from the intermediate portions 32 of the first passages 28 through the second passages 30 and out of the second exit openings 40A, 40B. As best shown in FIGS. 46 and 47, the first segments 28A of the first passages 28 are open at the bottom of the cord lock 1118 and will be closed off by the article to which the cord lock 1118 is attached, such as by the upper 112 in FIG. 48.

Figure 44:
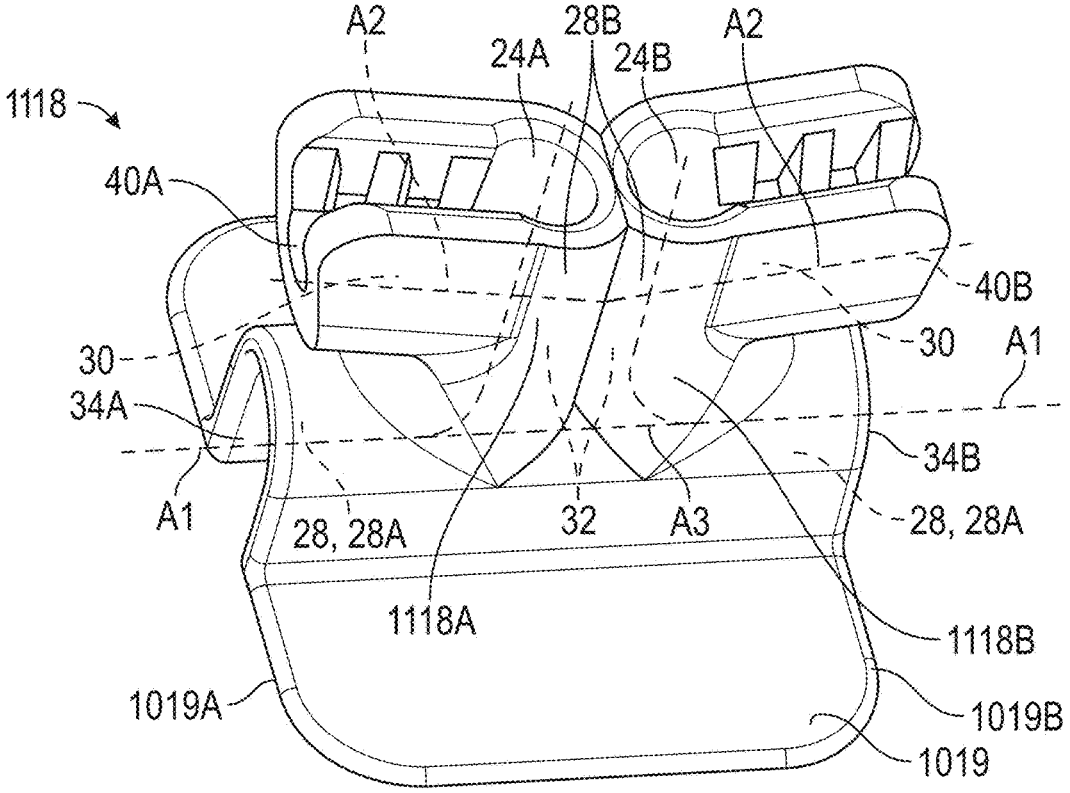
FIG. 44 is a side perspective view of another embodiment of a cord lock.
Figure 45:
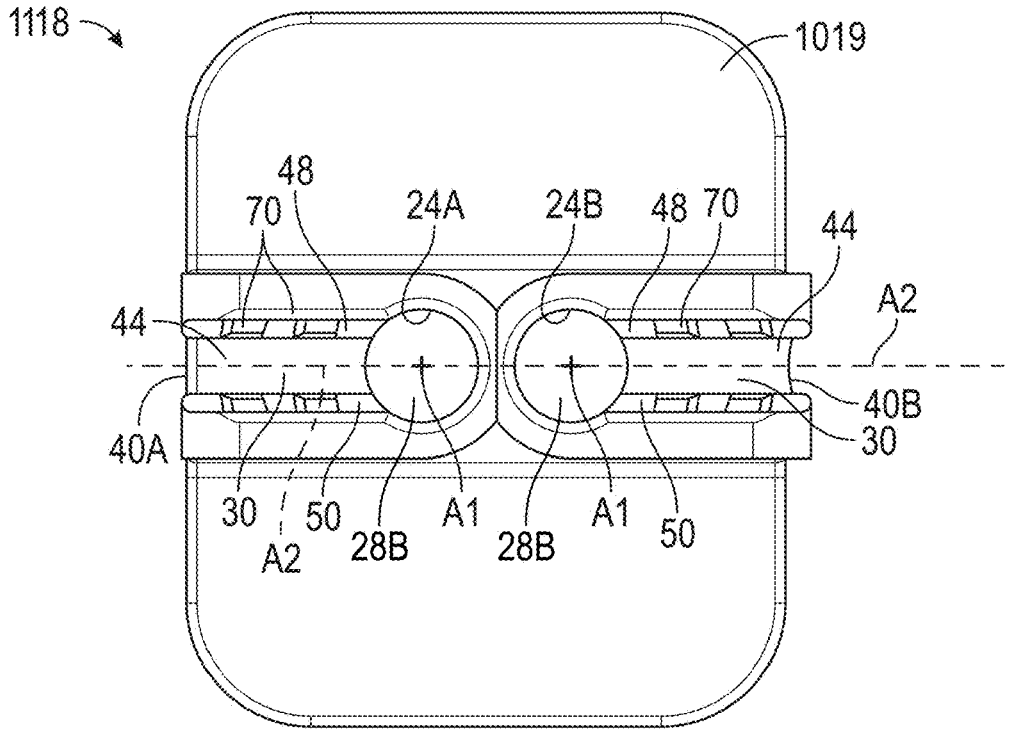
FIG. 45 is a top view of the cord lock of FIG. 44.

FIG. 45 is a top view of the cord lock 1118 of FIG. 44 showing protrusions 70 that extend into the slots 44 from the angled side walls 48, 50. FIG. 46 is a side view of the cord lock of FIG. 44. FIG. 47 is a bottom perspective view of the cord lock 1118 of FIG. 44. Both FIGS. 45 and 47 show the communication between the second segment 28B of the first passage 28 and the second passages 30.

Figure 48:
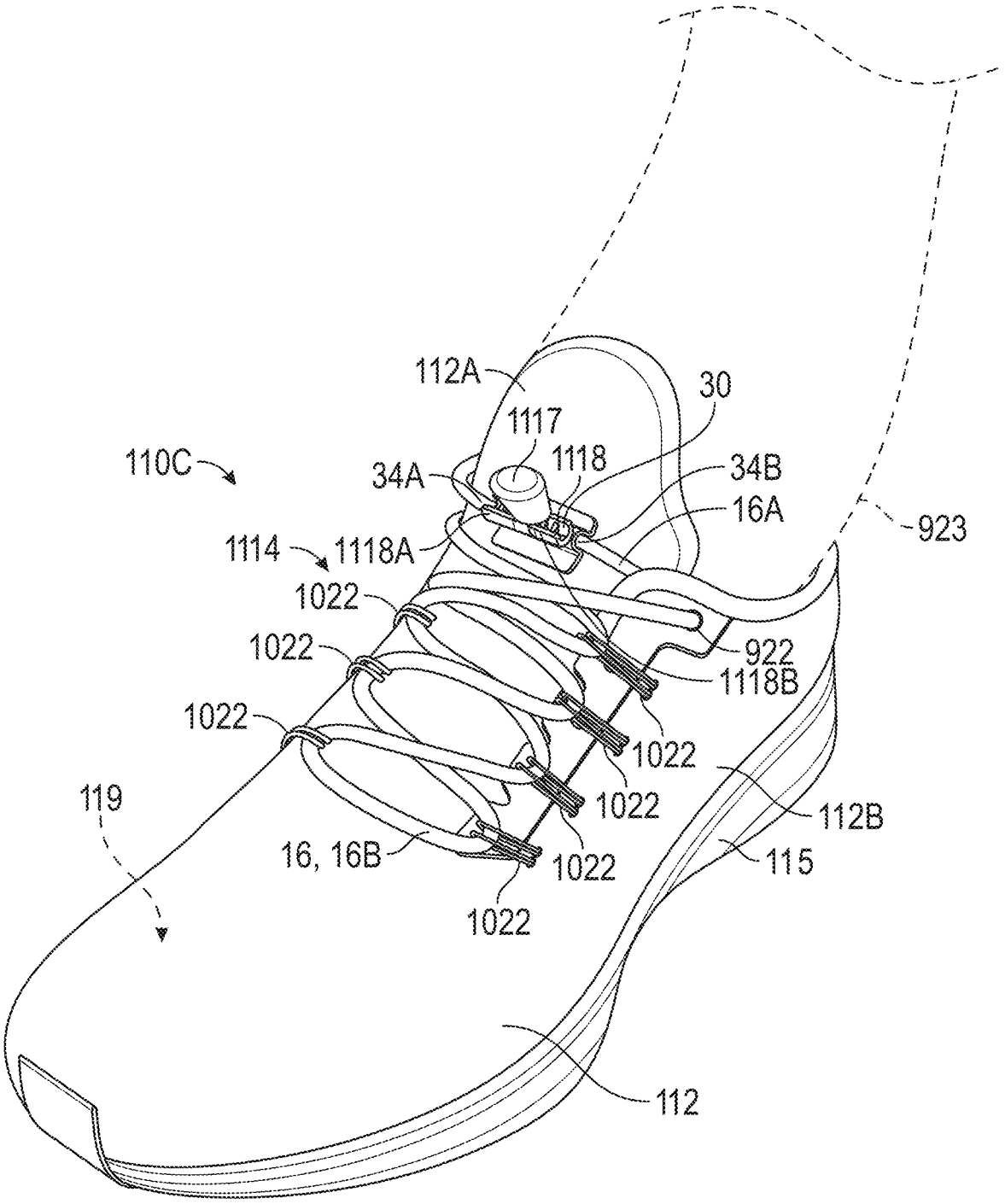
FIG. 48 is a lateral perspective view of an article of footwear including the cord lock of FIG. 44 and an adjustment cord in an untensioned state.

FIG. 48 is a lateral perspective view of an article of footwear 110C including a tensioning system 1114 with the cord lock 1118 of FIG. 44. The tensioning system 1114 is secured to the upper 112 and cinches the upper 112 to adjust the size of the foot-receiving cavity 119, securing the upper 112 around a foot 923 therein. The tensioning system 1114 includes the cord lock 1118 of FIG. 44, the adjustment cord 16, and a plurality of cord guides 1022 configured as looped tensioning cables extending through the upper 112 and secured to the upper 112 and/or the sole structure 115, as discussed with respect to FIG. 40. The cord 16 is shown extending both through the cord guides 1022, and through one or more eyelets 922.

The cord lock 1118 is secured to the tongue region 112A rather than to side walls 112B at the lateral and medial sides. The slots 44 and the first exit openings 24A, 24B are disposed generally upward (best shown in FIG. 49). The adjustment cord 16 is in an untensioned and unlocked state in FIG. 48. Two end portions of the cord 16 are held together by a connector 1117, or the connector 1117 is disposed on a continuous loop formed by the cord 16. Alternatively, the end portions 16C, 16D could be untied from one another to separately secure to the respective lock bodies 1118A, 1118B.

Figure 49:
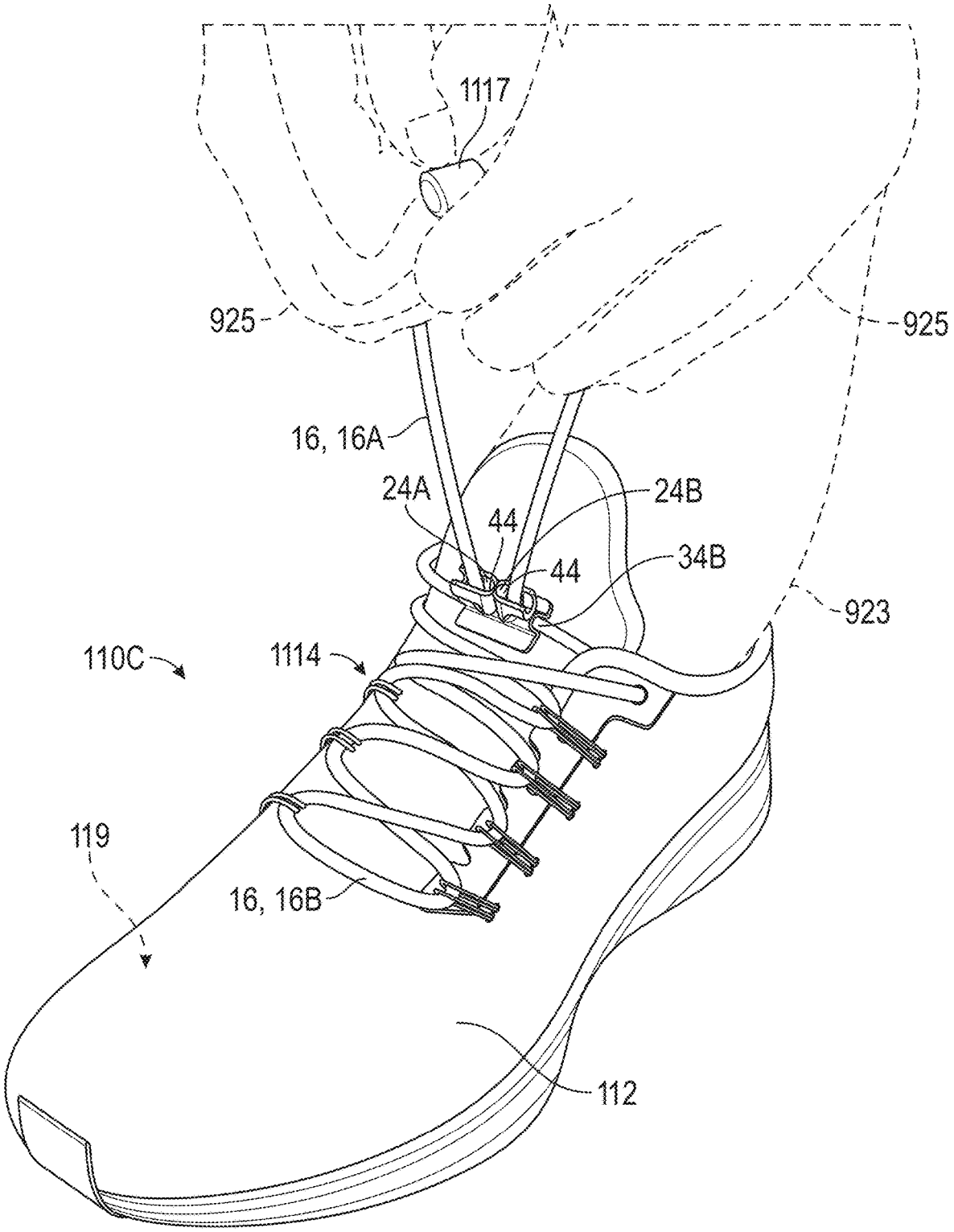
FIG. 49 is a lateral perspective view of the article of footwear of FIG. 48 showing the adjustment cord being tensioned.

FIG. 49 is a lateral perspective view of the article of footwear 110C of FIG. 48 showing the adjustment cord 16 being tensioned by a wearer using two hands 925 to manually pulling on the loop portion 16A, the loop portion 16A still exiting from the first exit openings 24A, 24B. Alternatively, the wearer could use just one hand 925 and pull on the connector 1117. Tensioning of the adjustment cord 16 in this manner may also tension the looped tensioning cables used as cord guides 1022 and tightens the upper 112 over the foot 923 in the foot-receiving cavity 119.

Figure 50:
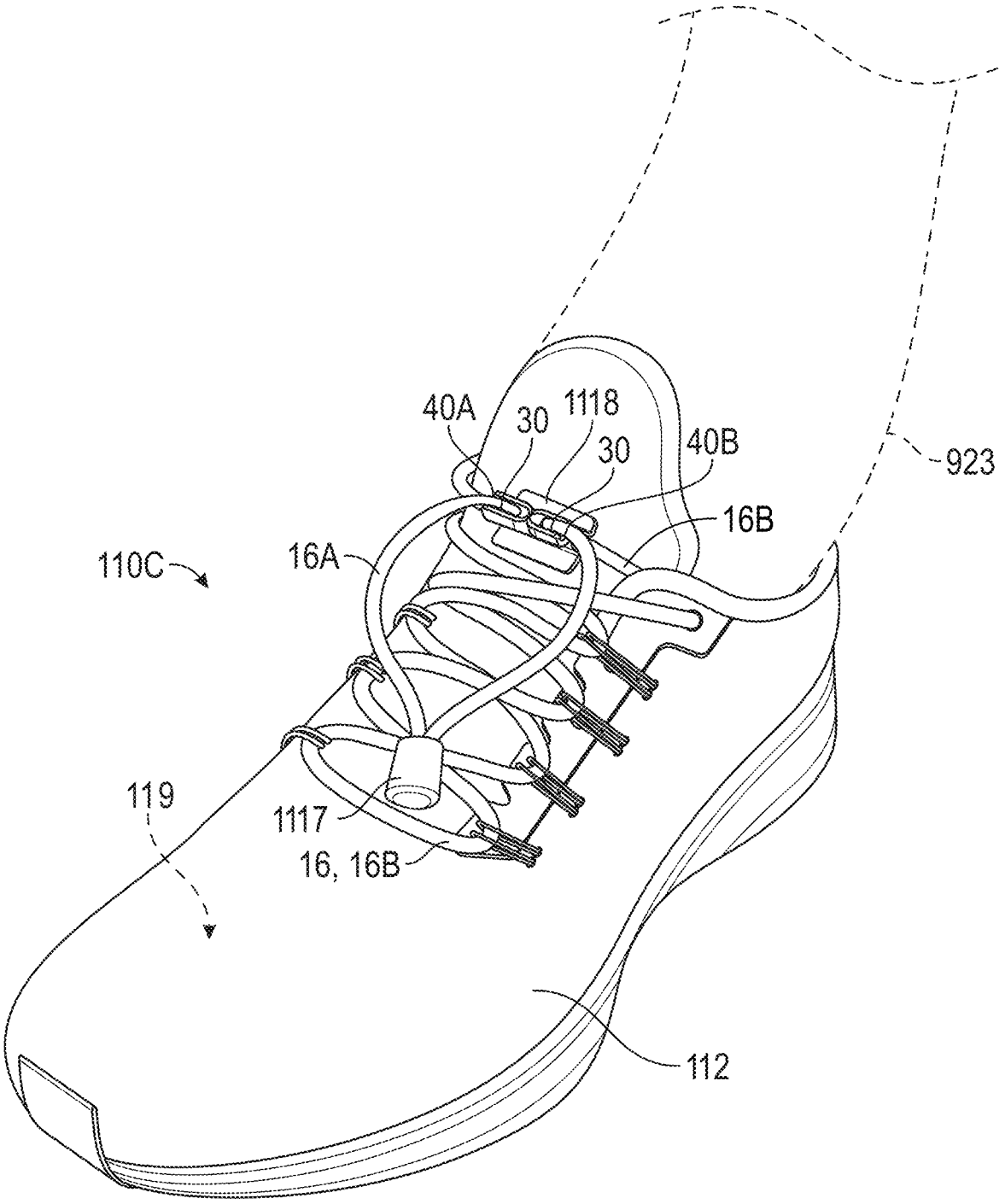
FIG. 50 is a lateral perspective view of the article of footwear of FIG. 48 with the adjustment cord pivoted to a locked position.

FIG. 50 is a lateral perspective view of the article of footwear 110C with the adjustment cord 16 pivoted to exit the lock bodies 1118A, 1118B from the second exit openings 40A, 40B so that the loop portion 16A locks to the lock bodies 1118A, 1118B. Segments of the loop portion 16A on either side of the connector 1117 are moved away from one another (e.g., transversely outward) so that the segments are disposed within the second passages 30 and exit from the second exit openings 40A, 40B. The adjustment cord 16 is in the locked position to maintain tension in the portion 16B of the cord 16 and maintain the upper 112 tightened around the foot 923.

Figure 51:
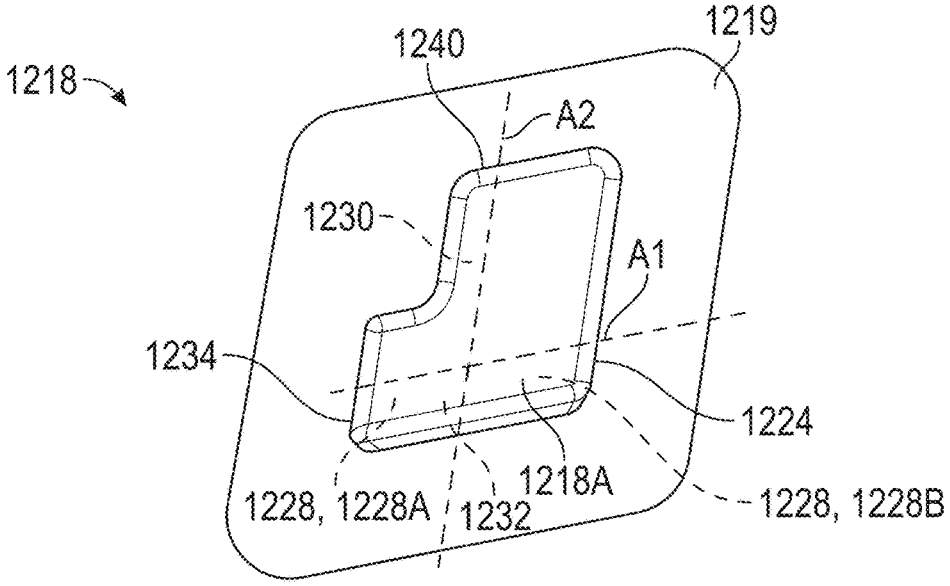
FIG. 51 is a side view of an alternative embodiment of a cord lock.

FIG. 51 is a side view of an alternative embodiment of a cord lock 1218. The cord lock 1218 shown has a lock body 1218A integrally formed with a mounting flange 1219 and may be used along with another lock body arranged as a minor image of the lock body 1218A as with other embodiments described herein to enable the cord 16 to tighten a wearable article. The lock body 1218A includes a first passage 1228 and a second passage 1230 configured in the same manner as the first passage 28 and second passage 30 of FIG. 3, respectively, except that the passages 1228 and 1230 are rectangular in respective cross-sections taken perpendicular to their longitudinal axes A1, A2. The second passage 1230 extends from an intermediate portion 1232 of the first passage 1228 similarly to the intermediate portion 32 of the cord lock 18 and has a smaller cross-sectional area taken perpendicular to its longitudinal axis A2 than the cross-sectional area of the first passage 1228 taken perpendicular to its longitudinal axis A1. The smaller cross-sectional area enables a cord 16 to be locked in the second passage 1230 when placed therein by the wearer as described herein.

The rectangular cross-sections of the passages 1228, 1230 enable a flat cord (e.g., a cord that is rectangular at a cross-section taken perpendicular to its longitudinal axis) to be repositionable by folding a portion of the cord along its longitudinal axis before or while pivoting the cord in the body 1218A through the slot 44 from a first position in which the adjustment cord enters through the entrance opening 1234 and extends through the first exit opening 1224 to a second position in which the adjustment cord extends from the entrance opening 1234 to the second exit opening 1240. By folding the flat cord as described, its thickness doubles, and because it is biased to return to the flat (unfolded) state, it becomes locked in the narrower second passage 1230 when the wearer releases the tensioning force.

Figure 52:
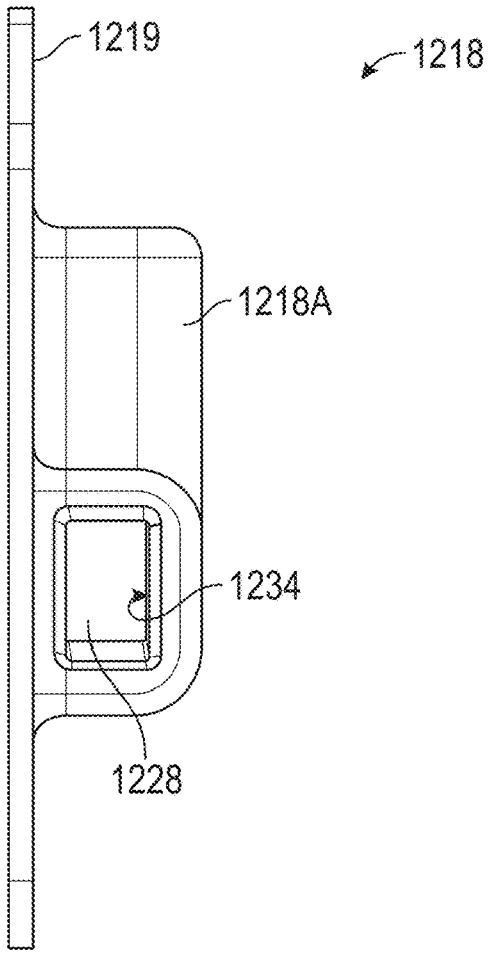
FIG. 52 is a rear view of the cord lock of FIG. 51.
Figure 53:
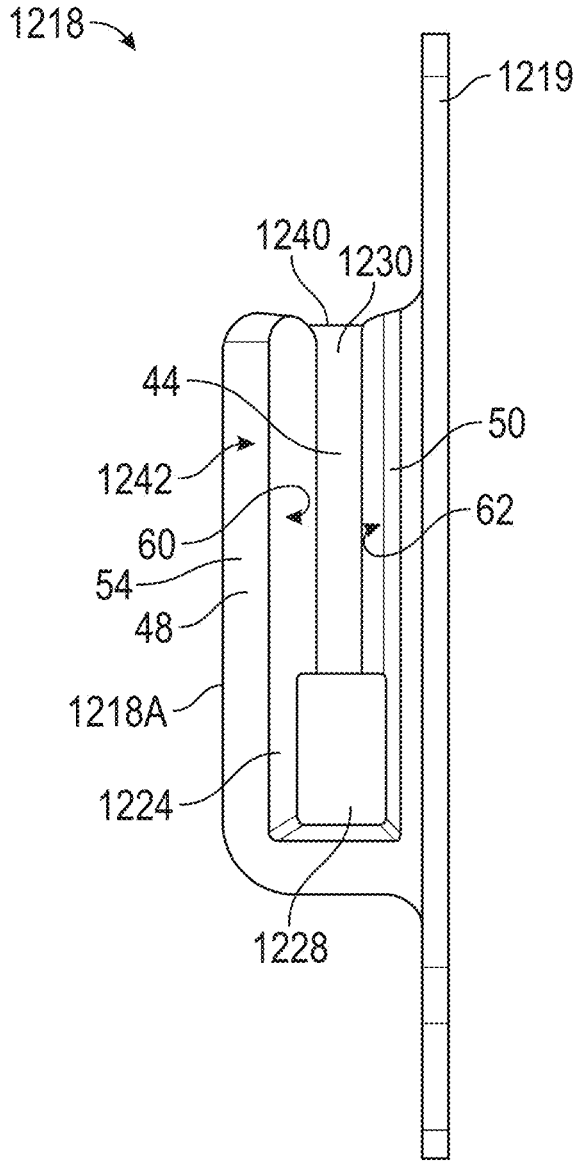
FIG. 53 is a front view of the cord lock of FIG. 51.

FIG. 52 is a rear view of the cord lock 1218 of FIG. 51 and shows that the first passage 1228 has a rectangular cross-sectional area. FIG. 53 is a front view of the cord lock 1218. As shown in FIG. 53, an exterior surface 1242 of the body 1218A defines a slot 44 that extends from the first exit opening 1224 to the second exit opening 1240. The slot 44 also extends inward from the exterior surface 1242 into the body 1218A along a segment 1228B (see FIG. 51) of the first passage 1228 and along the second passage 1230. The slot 44 does not extend along a segment 1228A of the first passage 1228 that is between the entrance opening 1234 and the beginning of the second passage 1230 (e.g., first segment 1228A). The slot 44 enables a flat cord (e.g., a cord that is rectangular at a cross-section taken perpendicular to its longitudinal axis) to be repositionable by folding the cord along its longitudinal axis and pivoting the cord 16 in the body 1218A through the slot 44 to extend out of the second exit opening 1240.

FIG. 53 shows the inner surface 60 of the first side wall 48 of the lock body 1218A angles inward (e.g., into the slot 44) toward the second side wall 50 from the exterior surface 1242 at the front 54 to the second passage 1230 to narrow the slot 44. The inner surface 62 of the second side wall 50 also angles inward toward the first side wall 48 in a similar manner.

Figure 54:
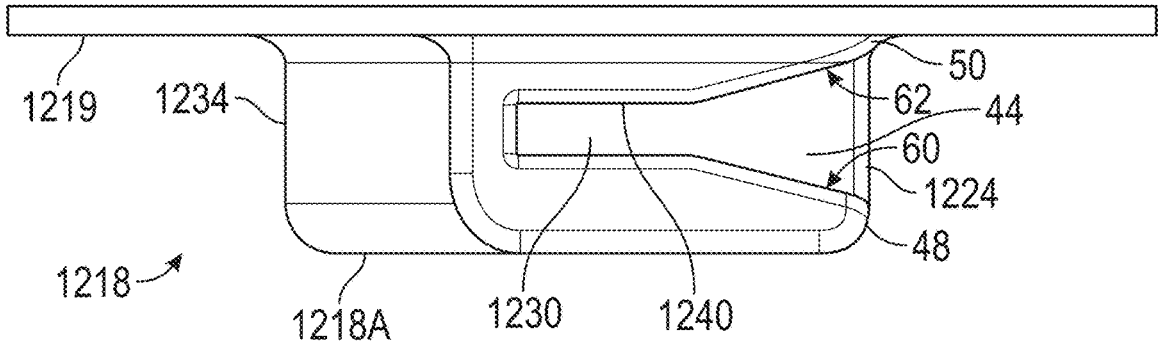
FIG. 54 is a top view of the cord lock of FIG. 51.

FIG. 54 is a top view of the cord lock of FIG. 51 and shows that the inner surfaces 60, 62 of the side walls 48, 50 are substantially smooth, without protrusions like protrusions 70 of the cord lock 18. The second passage 1230 is also substantially smooth without protrusions.

Figure 55:
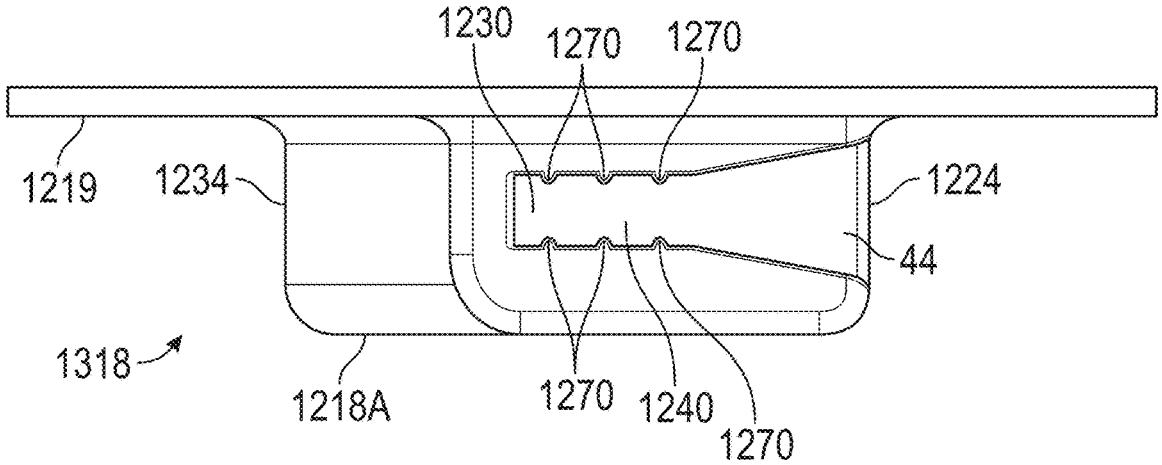
FIG. 55 is a top view of an alternative embodiment of a cord lock.

FIG. 55 is a top view of an alternative embodiment of a cord lock 1318 alike in all aspects to cord lock 1218 except that spaced protrusions 1270, also referred to as dimples, protrude at the inner surface of the lock body 1218A into the second passage 1230. The protrusions 1270 will extend into the surface of the folded flat cord and help to grip the folded flat cord when it is placed in the second passage 1230 to further retain it in the locked position.

Figure 56:
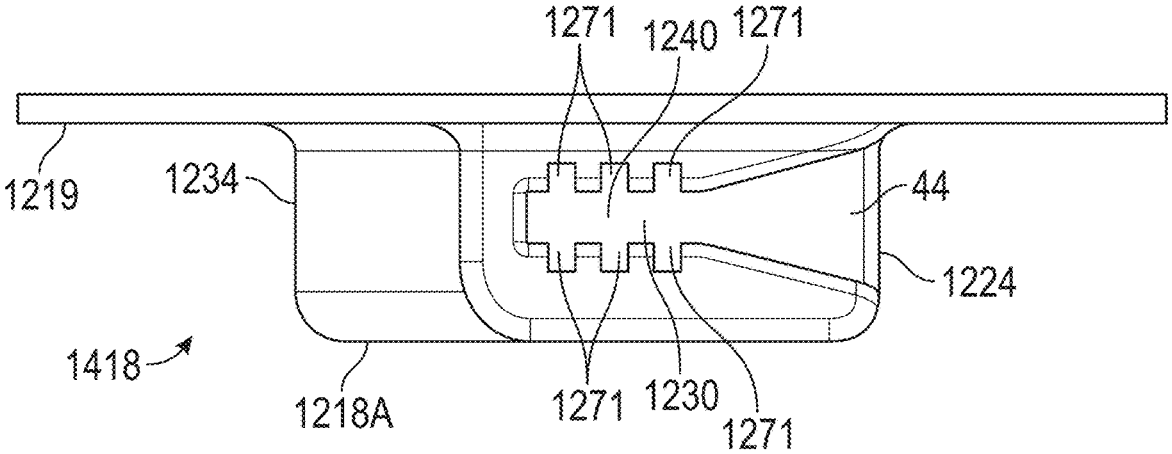
FIG. 56 is a top view of another alternative embodiment of a cord lock that has pivotable lock bodies.

FIG. 56 is a top view of another alternative embodiment of a cord lock 1418 alike in all aspects to cord lock 1218 except that grooves 1271 are formed at the inner surface of the lock body 1218A at the second passage 1230 recessing into the lock body 1218A. The folded flat cord will tend to expand into the grooves 1271 when placed in the second passage 1230 so that surface of the lock body 1218A in the grooves 1271 effectively grips the folded flat cord to further retain it in the locked position.

Figure 57:
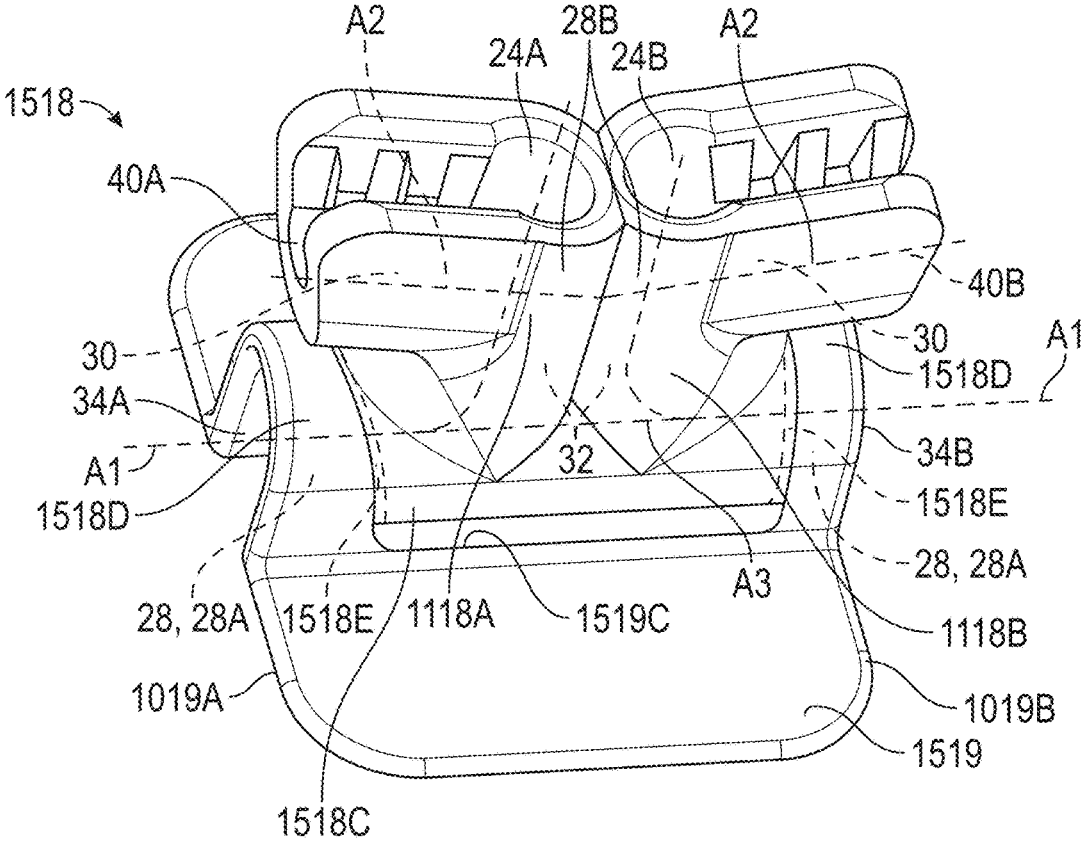
FIG. 57 is a side perspective view of another embodiment of a cord lock.

FIG. 57 is a side perspective view of another embodiment of a cord lock 1518. The cord lock 1518 includes the first and second lock bodies 1118A, 1118B described with respect to FIG. 44, except that a tubular portion 1518C of the lock bodies 1118A, 1118B defining the first segments 28A of the first passages 28 is pivotable about the axis A1 from the position shown in FIGS. 57 and 58 to a stowed position shown in FIGS. 59 and 60. Because the cord lock 1518 is configured with the first exit openings 24A, 24B disposed at a 90 degree turn from the first segments 28A, the cord lock 1518 extends relatively far above the upper 112 when in the position of FIG. 57, similar to cord lock 1118 in FIG. 44. In the stowed position, however, the lock bodies 1118A, 1118B do not extend as far above the mounting flange 1519 on which the lock bodies 1118A, 1118B are mounted. The mounting flange 1519 and the lock bodies 1118A, 1118B together define an opening 1519C that allows the tubular portion 1518C to pivot relative to the mounting flange 1519. Opposite ends of the tubular portion 1518C interfit with nonpivoting end portions 1518D of the lock bodies 1118A, 1118B. For example, the end portions 1518D may have a thin inner circular rim 1518E on which the tubular portion 1518C rotatably mounts.

Figure 58:
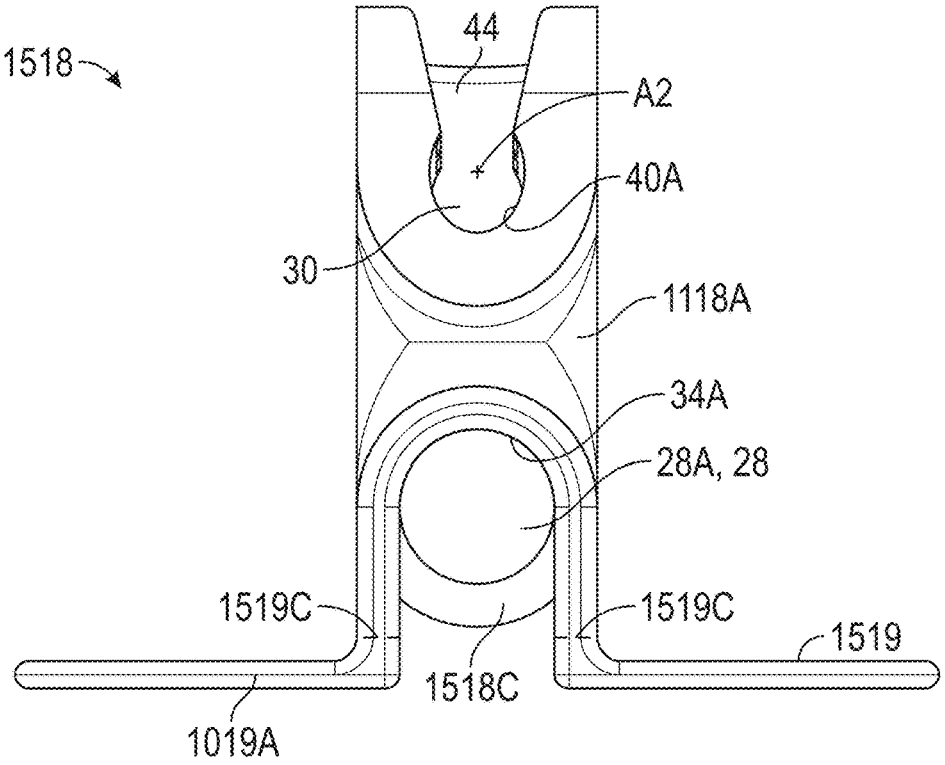
FIG. 58 is a side view of the cord lock of FIG. 57.
Figure 59:
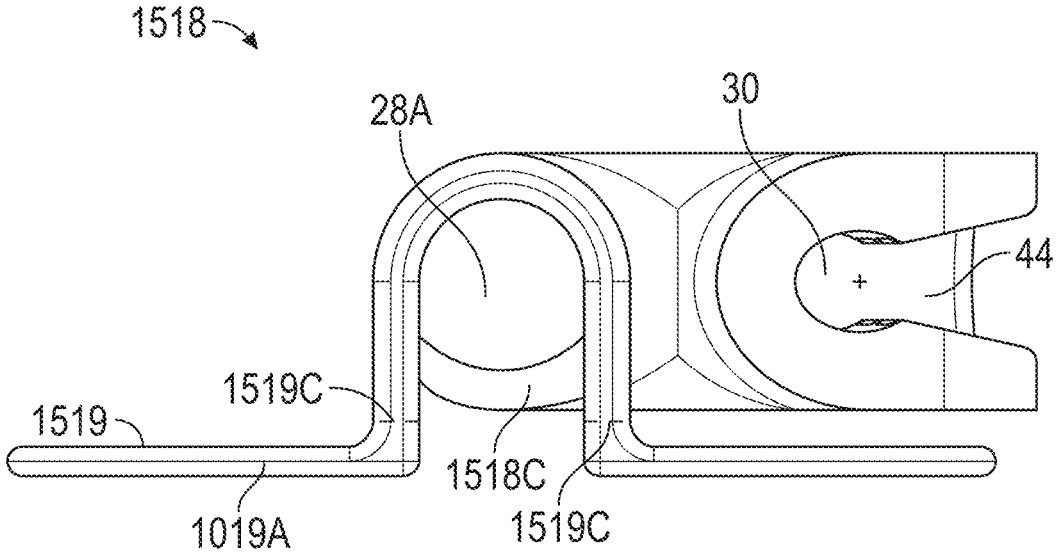
FIG. 59 is a side view of the cord lock of FIG. 57 with the lock bodies pivoted to a stowed position.
Figure 60:
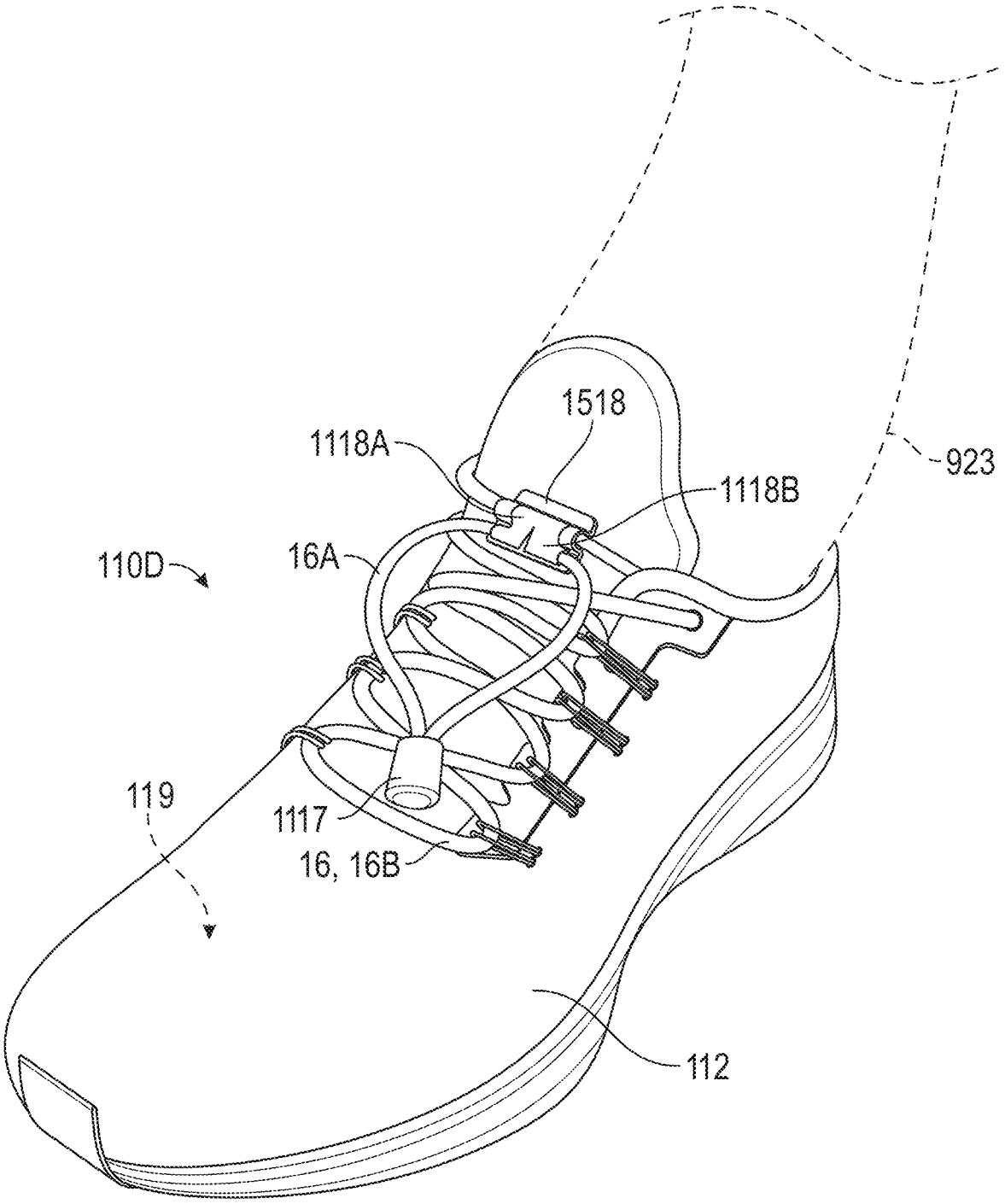
FIG. 60 is a lateral perspective view of an article of footwear with an adjustment cord pivoted to a locked position and the lock bodies pivoted to the stowed position.

FIG. 58 is a side view of the cord lock 1518 showing the tubular portion 1518C encircling the first segments 28A of the first passages 28. FIG. 59 is a side view of the cord lock of FIGS. 57 and 58 with the lock bodies 1118A, 1118B pivoted to the stowed position. The tubular portion 1518C may be configured to releasably secure in the stowed position. For example, there may be a protrusion on each of the circular rims 1518E that interfits with a notch at each end of the tubular portion 1518C to releasably lock the tubular portion in the stowed position. Alternatively, the lock bodies 1118A, 1118B may clip to interfitting structure of the mounting flange 1519 or may otherwise be releasably held in the stowed position. FIG. 60 is a lateral perspective view of an article of footwear 110D with a portion 16A of the adjustment cord 16 pivoted to a locked position and the lock bodies 1118A, 1118B pivoted to the stowed position.

Figure 61:
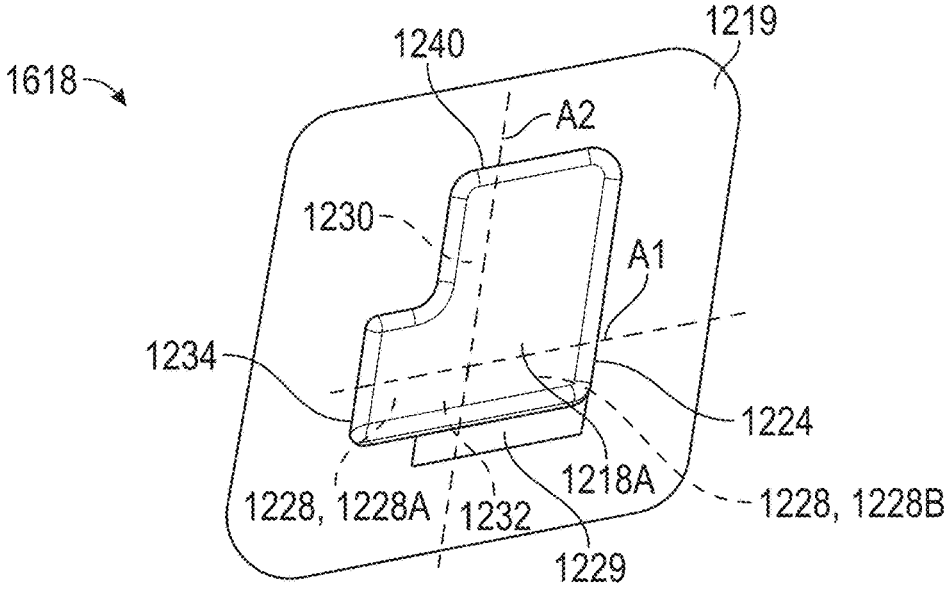
FIG. 61 is a side view of an alternative embodiment of a cord lock.
Figure 62:
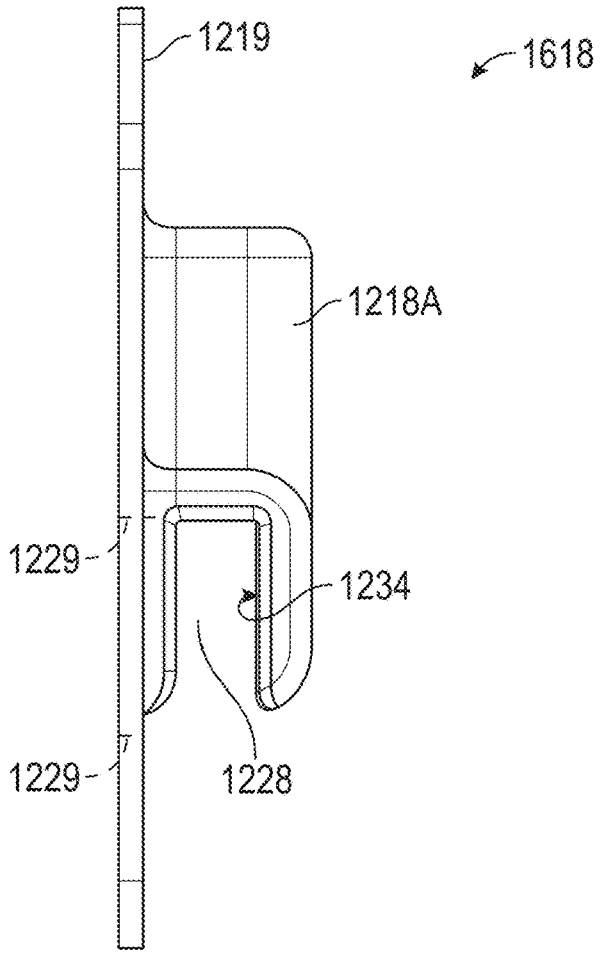
FIG. 62 is a rear view of the cord lock of FIG. 61.
Figure 63:
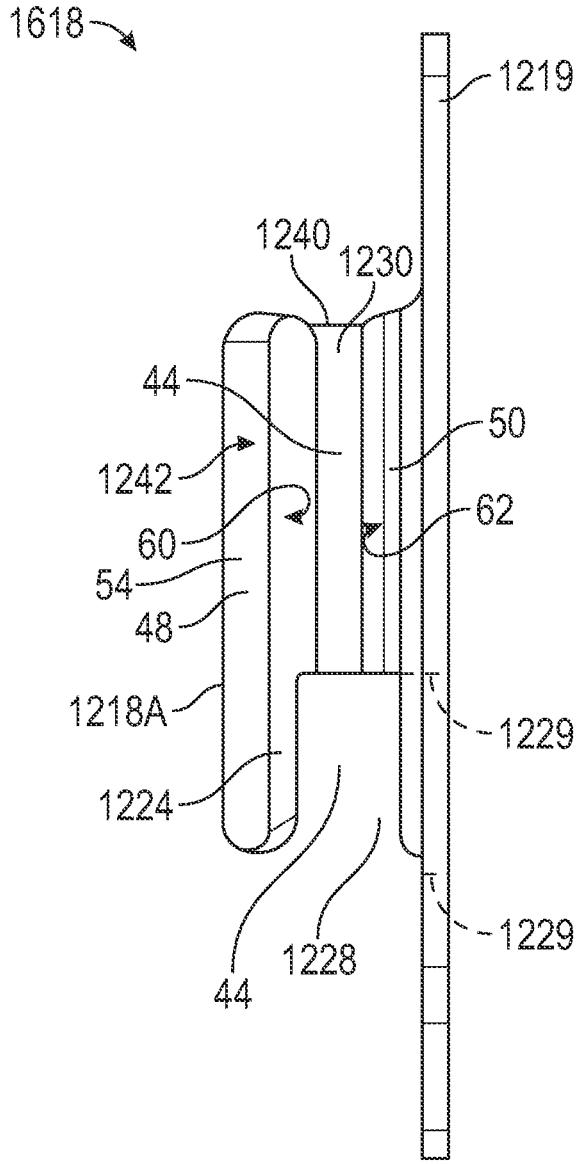
FIG. 63 is a front view of the cord lock of FIG. 61.
Figure 64:
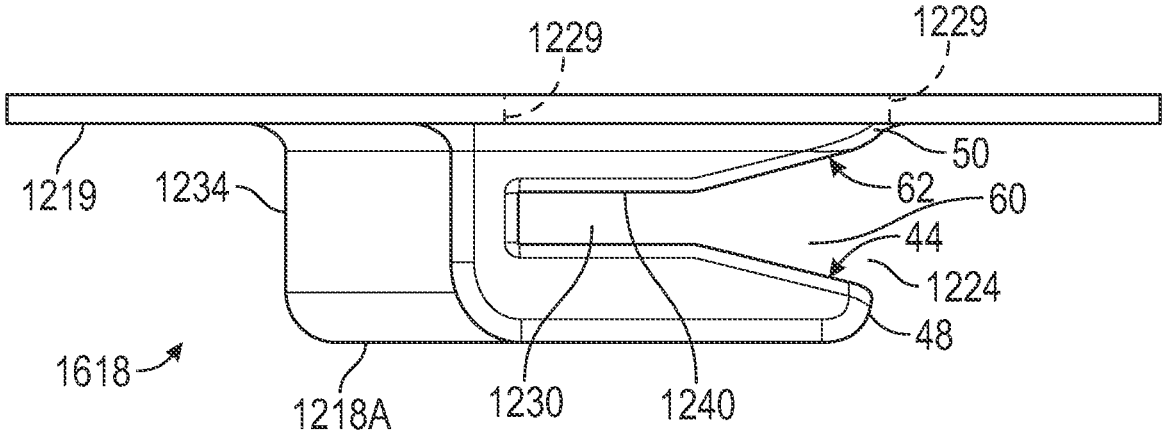
FIG. 64 is a top view of the cord lock of FIG. 61.

FIG. 61 is a side view of an alternative embodiment of a cord lock 1618. The cord lock 1618 is alike in many aspects to cord lock 1218 of FIG. 51 and like reference numbers are used for like features and the description of such features is not repeated. The cord lock 1618 is different from cord lock 1218 in that the lock body 1218A is open along the first passage 1228 from the entrance opening 1234 to the first exit opening 1224 as best viewed in FIG. 63. Stated differently, the slot 44 extends inward from the exterior surface 1242 of the body 1218A from the entrance opening 1234 around to the first exit opening 1224 and up to the second exit opening 1240. Unlike cord lock 1218, the slot 44 extends inward from the exterior surface 1242 into the body 1218A even along a segment 1228A of the first passage 1228 that is between the entrance opening 1234 and the beginning of the second passage 1230 (e.g., first segment 1228A). FIGS. 62-64 when taken together show the slot 44 extending from the entrance opening 1234 to the second exit opening 1240 in this manner.

When the slot 44 is configured in this manner, the tensioning cord 16 can be secured to the lock body 1618 in the same manner as described with respect to lock 1218 but has the added advantage of enabling the cord 16 to be completely released and detached from the lock body 1618 when the user does not desire to lock the cord 16 to the lock body 1618. Because of the extension of the slot 44 from the entrance opening 1234 to the second exit opening 1240, the cord 16 can be released by withdrawing it completely from the lock body 1618 out through the slot 44. Although the slot 44 is shown extending along the bottom of the lock body 1618 at the first passage 1228, the slot 44 could instead extend along the side of the lock body 1618 along the first passage 1228 (e.g., parallel with the first axis A1 and opposite from the flange 1219). The slot 44 enables a flat cord (e.g., a cord that is rectangular at a cross-section taken perpendicular to its longitudinal axis) to be repositionable by folding the cord along its longitudinal axis and pivoting the cord 16 in the body 1218A through the slot 44 to extend from the entrance opening 1234 and out of the second exit opening 1240.

The cord lock 1618 is also different from the cord lock 1218 in that there is a through hole 1229 in the flange 1219 adjacent to the first passage 1228. The through hole 1229 helps enable molding the lock body 1618 as a one-piece component and also decreases the overall weight of the lock body 1618.

Figure 65:
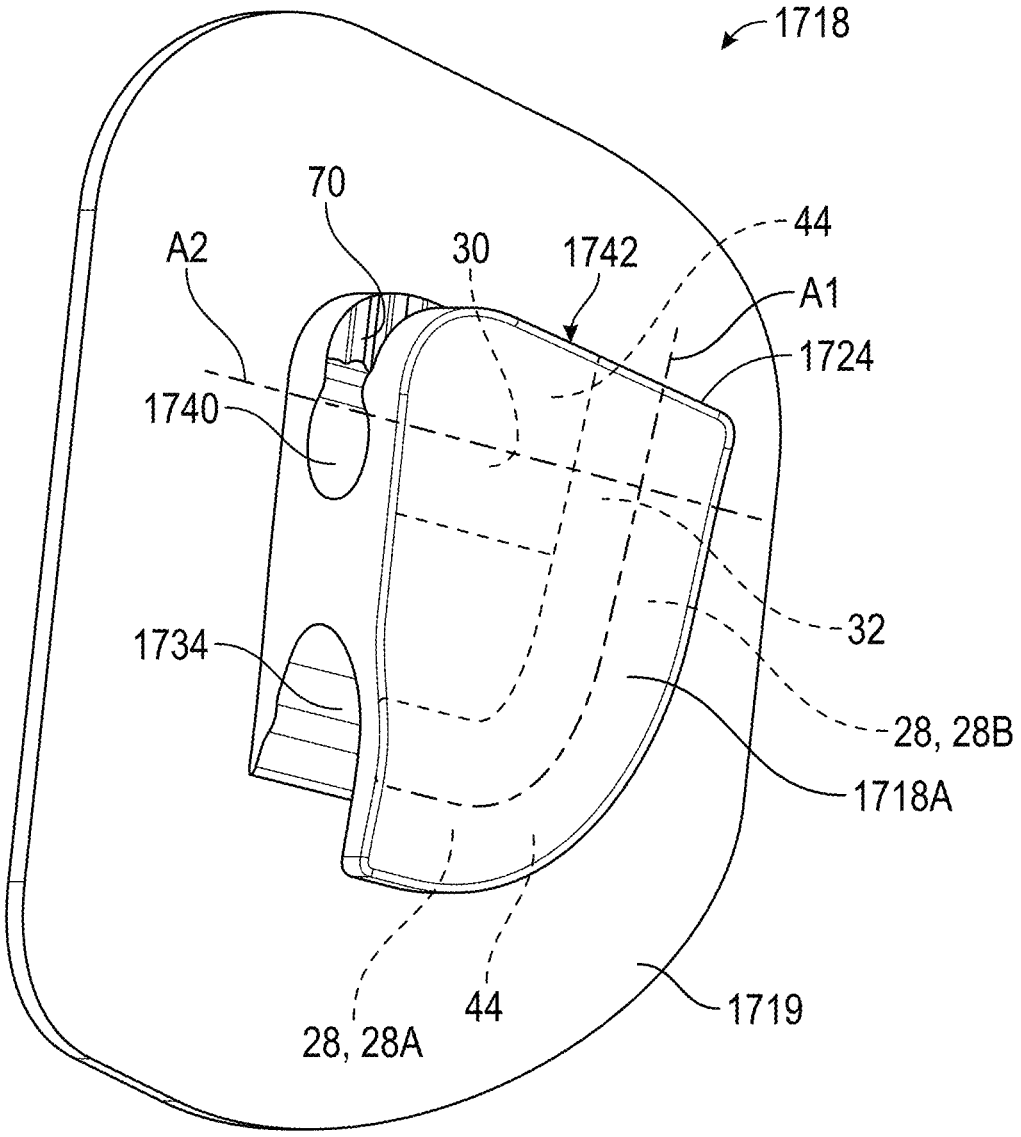
FIG. 65 is a side perspective view of an alternative embodiment of a cord lock showing one lock body.

FIG. 65 is a side perspective view of an alternative embodiment of a cord lock 1718 showing one lock body 1718A. A second lock body (not shown) is configured as a mirror image of the lock body 1718A, and may be secured to an article, such as the article of footwear 110E of FIG. 68, spaced apart from the lock body 1718A. A mounting flange 1719 is connected with the lock body 1718A and is configured to mount to the wearable article 110E. The lock body 1718A and the mounting flange 1719 are an integral, unitary, one-piece component in the embodiment shown, but could alternatively be separate components coupled to one another.

The cord lock 1718 is alike in many aspects to cord lock 1218 of FIG. 51 and the cord lock 1618 of FIG. 61 and like reference numbers are used for like features and the description of such features is not repeated. The lock body 1718A defines a first passage 28 extending through the lock body 1718A from an entrance opening 1734 to a first exit opening 1724. As in the embodiment of FIG. 29, the first passage 28 is arcuate along its longitudinal axis A1 having a first segment 28A and a second segment 28B, and turning approximately 90 degrees between the entrance opening 1734 and the first exit opening 1724. The lock body 1718A also defines a second passage 30 extending along a longitudinal axis A2 from an intermediate portion 32 of the first passage 28 to a second exit opening 1740 of the lock body 1718A. The intermediate portion 32 is in communication with the second passage 30. The narrower second passage 30 extends from the intermediate portion 32 of the first passage 28 along the same face of the lock bodies 1718A as the entrance opening 1734. The second passage 30 exits at exit opening 1740 generally parallel with the first segment 28A of the first passage 28 at the second exit opening 1740.

The second passage 30 is narrower than the first passage 28 as described with respect to FIG. 29, for example. For example, the first passage 28 may have a first cross-sectional area taken perpendicular to axis A1 and the second passage 30 may have a second cross-sectional area taken perpendicular to axis A2 and that is less than the first cross-sectional area. A portion of the adjustment cord 16 disposed in the segment of the first passage 28 is movable relative to the first passage 28 when tensioned and is selectively repositionable to the second passage 30 where the adjustment cord 16 locks to the lock body 1718A and retains tension.

Figure 66:
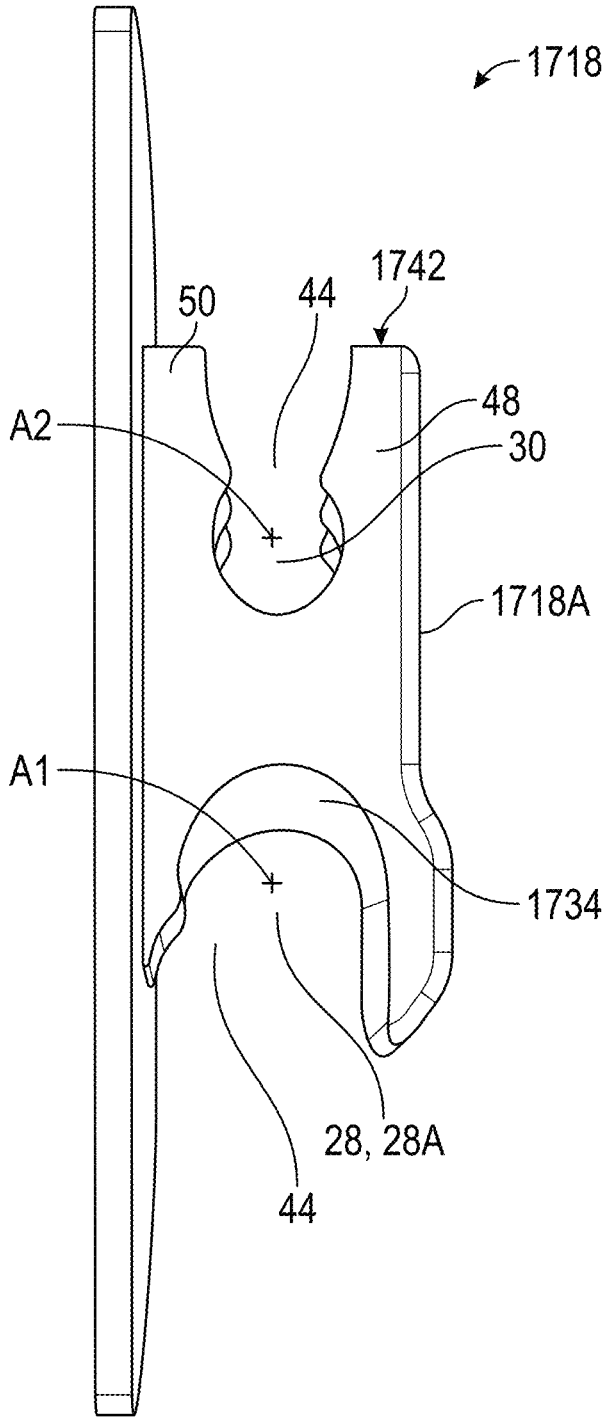
FIG. 66 is a front perspective view of the lock body of FIG. 65.
Figure 67:
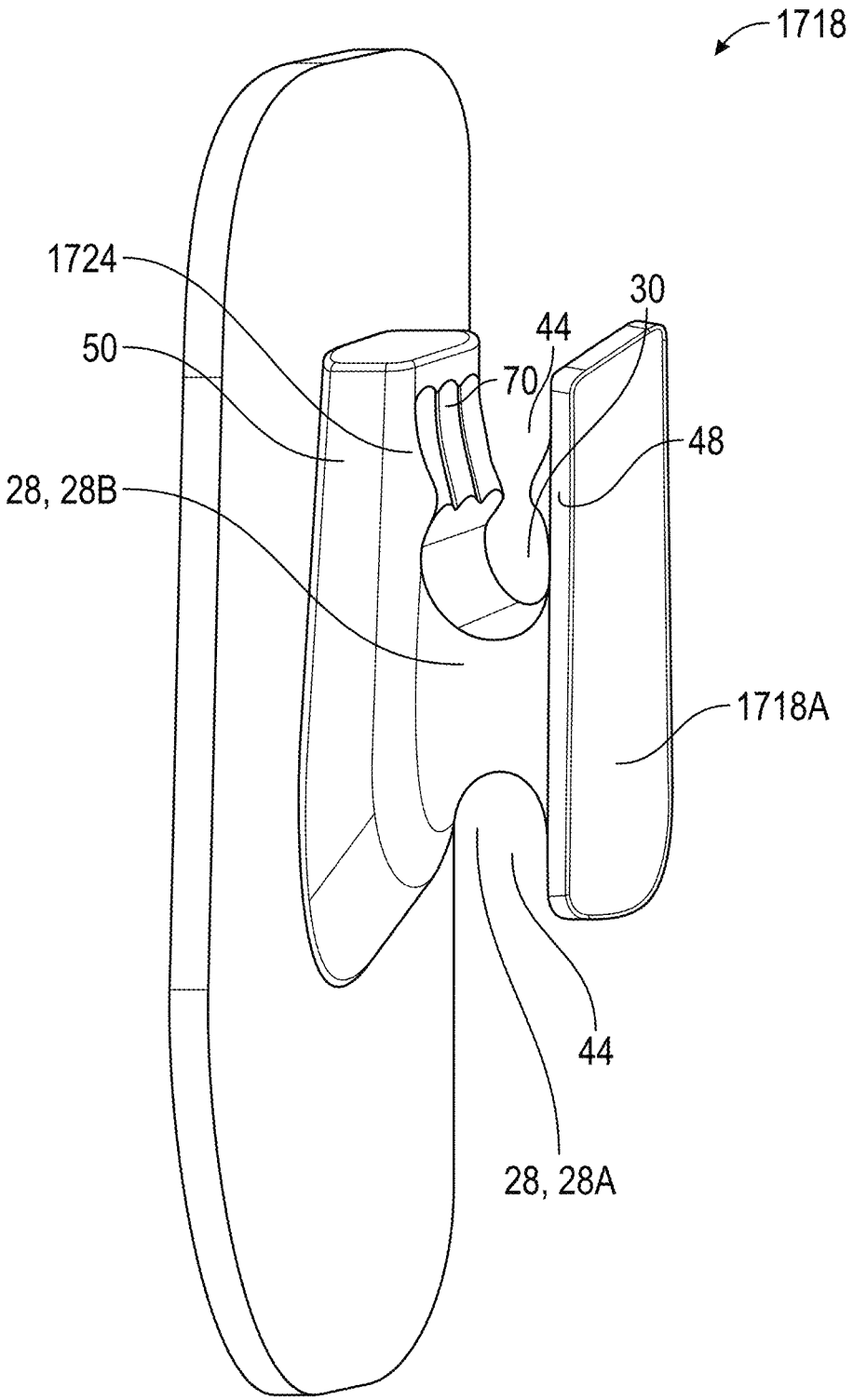
FIG. 67 is a back perspective view of the lock body of FIG. 65.
Figure 70:
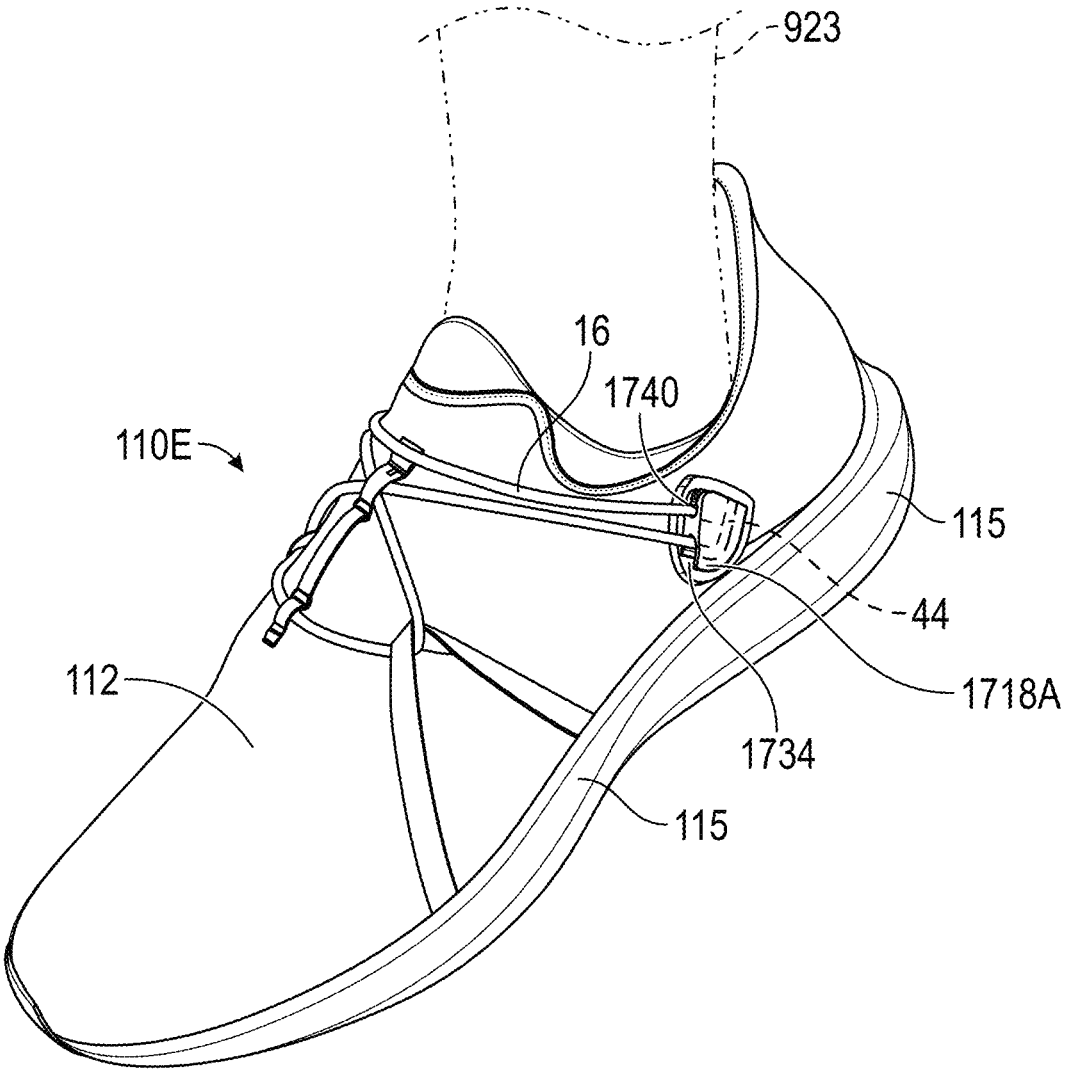
FIG. 70 is a fragmentary view of the article of footwear of FIG. 68 with the adjustment cord positioned to extend in the slot of the cord lock from a first entrance opening, through the first passage and through a second passage of the cord lock to exit from a second exit opening.

Like cord lock 1618, the lock body 1718A is open along the first passage 28 from the entrance opening 1734 to the first exit opening 1724 (best viewed in FIG. 67) as the slot 44 extends inward from the exterior surface 1742 of the body 1718A from the entrance opening 1734 around to the first exit opening 1724, and is also open along the second passage 30 as the from the first exit opening 1724 to the second exit opening 1740. Like cord lock 918 of FIG. 29, the second exit opening 1740 is disposed generally on the same side of the lock body 1718A as the entrance opening 1734 so that the cord 16 will wrap around and extend out generally parallel to the portion of the cord extending into the entrance opening 1734 when locked to the lock body 1718A, as shown in FIG. 70. The cord 16 is completely releasable from the cord lock 1718 when not locked at the second passage 30. Alternatively, the cord 16 could be rested in the first passage 28 but not manually pushed into the second passage 30. FIGS. 65-67 when taken together show the slot 44 extending from the entrance opening 1734 to the second exit opening 1240 in this manner.

As best shown in FIG. 66, the lock body 1718A has a first side wall 48 and a second side wall 50 spaced apart from the first side wall by the slot 44. The first side wall 48 and the second side wall 50 extend along the segment 28B of the first passage 28 as well as along the second passage 30. Protrusions 70 extend inward into the slot 44 from both the first side wall 48 and the second side wall 50 such that the slot 44 is narrowed at the protrusions 70. The width of the slot 44 at the protrusions is less than the width of the second passage 30, as best shown in FIGS. 66 and 67. The walls 48, 50 angle outward from the second passage 30 so that the slot 44 is narrower at the second passage 30 than at the exterior surface of the body. Stated differently, inner surfaces of the side walls 48, 50 angle toward one another from the exterior surface of the body 1718A.

Figure 68:
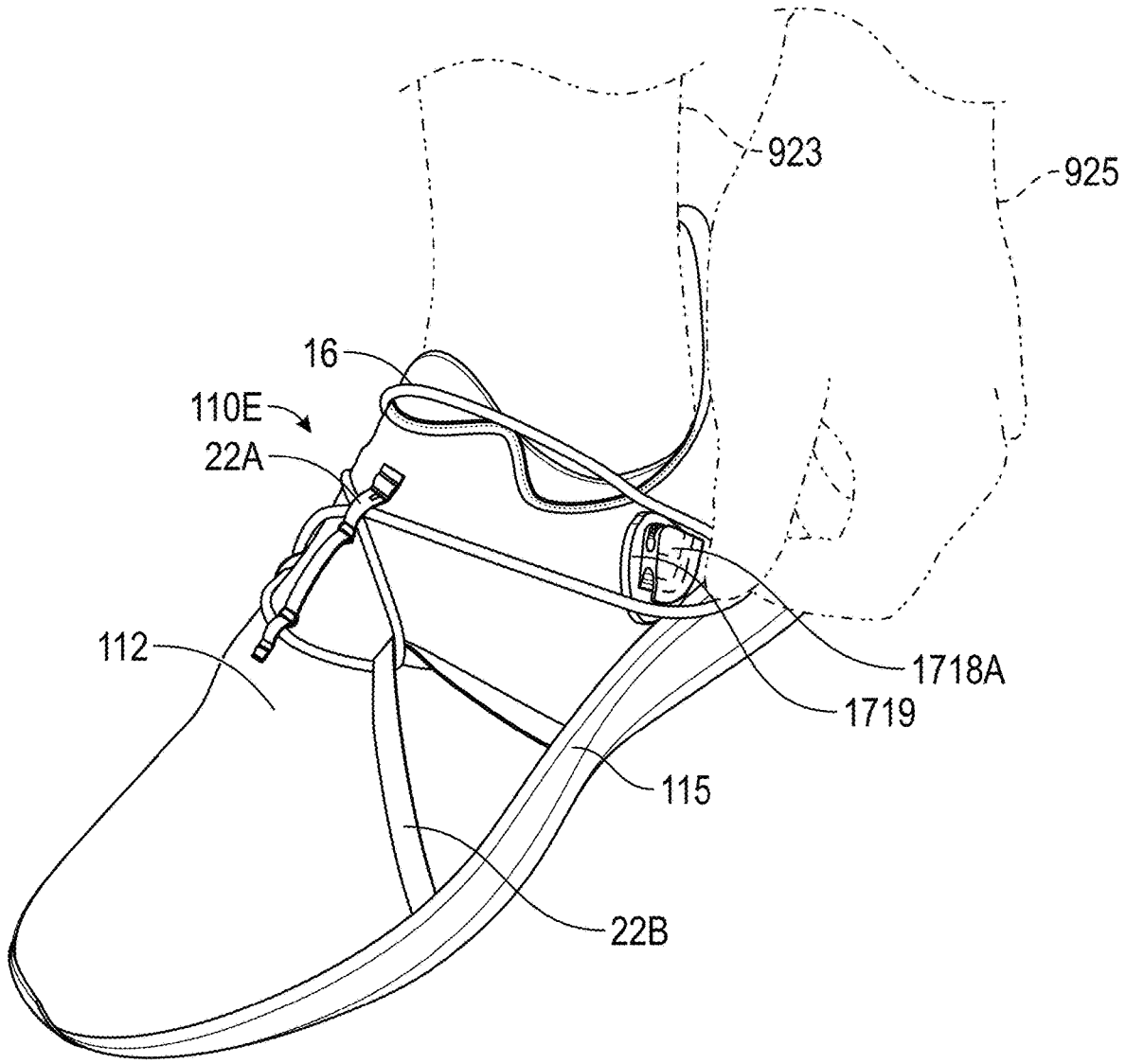
FIG. 68 is a fragmentary view of an article of footwear including the cord lock of FIG. 65 and an adjustment cord being pulled around the back of the cord lock.
Figure 69:
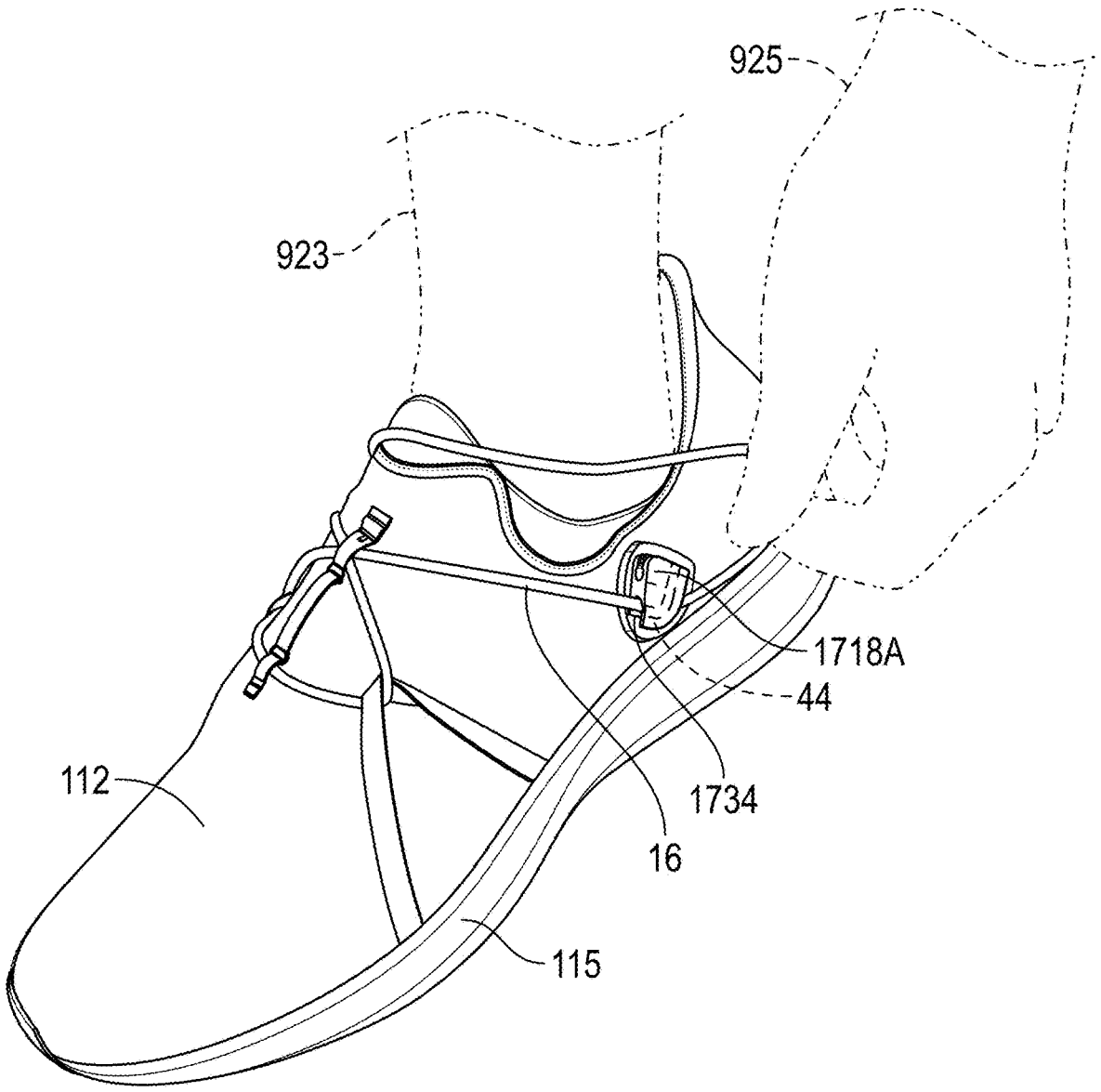
FIG. 69 is a fragmentary view of the article of footwear of FIG. 68 with the adjustment cord being positioned to extend in a first passage of the cord lock from an entrance opening and out of a slot in the cord lock at a first exit opening.

FIG. 68 shows the article of footwear 110E having an upper 112 and various cord guides 22A and 22B securing the cord 16 to the upper 112 and to the sole structure 115, respectively. The cord lock body 1718A is shown secured to the lateral side 111 via stitching extending through the flange 1719. A symmetrical second lock body (not shown) is secured to the medial side (not shown) generally opposite the first lock body 1718A. including the cord lock of FIG. 65 and an adjustment cord being pulled around the back of the cord lock. In FIG. 68, the hand 925 manually pulls the cord 16 rearward of the lock body 1718A to begin the process of securing the cord 16 to the lock body 1718A to tighten the upper 112 to the foot 723. In FIG. 68, it is apparent that the cord 16 is completely released from the lock body 1718A, which is made possible due to the open slot 44 extending from the exterior surface 1742 into the lock body 1718A from the entrance opening 1734 to the second exit opening 1740 shown in FIGS. 65-67 (e.g., along the entirely of the first passage 28 and the second passage 30, and extending into each passage 28, 30). FIG. 69 shows the hand 925 positioning the adjustment cord in the first passage 28 to extend from the entrance opening 1734 and shown partially wrapped around the slot 44 and in the first passage 28 (labelled in FIGS. 65-67). FIG. 70 shows the adjustment cord 16 after the hand 925 has completed positioning the cord 16 to extend in the slot 44 from the first entrance opening 1734, through the first passage 28 and through the second passage 30 labelled in FIG. 65, and exiting from the second exit opening 1740, thereby locking the cord 16 in the narrower second passage 30 until manually removed, and tensioning the cord 16 to tighten the upper 112 over the foot 923.

The following Clauses provide example configurations of a lock for an adjustment cord and of a wearable article disclosed herein.

Clause 1: A lock for an adjustment cord of a wearable article, the lock comprising: a body defining a first passage extending through the body from an entrance opening of the body to a first exit opening of the body, and the body defining a second passage extending from an intermediate portion of the first passage to a second exit opening of the body; wherein the body is configured with a segment of the first passage extending from the intermediate portion to the first exit opening in communication with the second passage; and at least a portion of the second passage is narrower than the first passage so that a portion of the adjustment cord disposed in the segment of the first passage is movable relative to the first passage when tensioned and is selectively repositionable to the second passage where the adjustment cord locks to the body and retains tension.

Clause 2: The lock of Clause 1, wherein an exterior surface of the body defines a slot extending from the first exit opening to the second exit opening, and extending into the body along the segment of the first passage and along the second passage so that the adjustment cord is repositionable in the body through the slot from a first position in which the adjustment cord extends through the first exit opening to a second position in which the adjustment cord extends through the second exit opening, the adjustment cord extending through the entrance opening in both the first position and the second position.

Clause 3: The lock of Clause 2, wherein the first passage has a first cross-sectional area and the second passage has a second cross-sectional area less than the first cross-sectional area.

Clause 4: The lock of Clause 2, wherein the body includes: a first side wall and a second side wall spaced apart from the first side wall by the slot, the first side wall and the second side wall extending along the segment of the first passage; at least one protrusion extending into the slot from one of the first side wall or the second side wall such that the slot is narrowed at the at least one protrusion; and a width of the slot at the at least one protrusion is less than a width of the second passage.

Clause 5: The lock of Clause 2, wherein the body includes: a first side wall and a second side wall spaced apart from the first side wall by the slot; wherein the first side wall and the second side wall are configured such that the slot is narrower at the second passage than at the exterior surface of the body.

Clause 6: The lock of Clause 5, wherein an inner surface of at least one of the first side wall and the second side wall angles toward the other of the first side wall and the second side wall from the exterior surface of the body.

Clause 7: The lock of Clause 2, wherein the slot further extends through the body along the first passage from the first passage from the entrance opening to the first exit opening.

Clause 8: The lock of any of Clauses 1-7, further comprising: a mounting flange connected with the body and configured to mount to the wearable article; wherein the body and the mounting flange are an integral, unitary, one-piece component.

Clause 9: The lock of any of Clauses 1-8, wherein the body is a first body, and the lock further comprising: a second body symmetrical to the first body so that the adjustment cord extends from the first exit opening of the first body to a respective first exit opening of the second body when the adjustment cord is disposed in the segment of the first passage of each body, and extends from the second exit opening of the first body to a respective second exit opening of the second body when the adjustment cord is disposed in the second passage of each body.

Clause 10: The lock of Clause 9, wherein the second body is separate and disconnected from the first body.

Clause 11: The lock of Clause 10, wherein the second body is integral with the first body as a single, unitary, one-piece component.

Clause 12: The lock of any of Clauses 1-11, wherein the adjustment cord is elastic.

Clause 13: The lock of any of Clauses 1-11, wherein the adjustment cord is inelastic.

Clause 14: A wearable article comprising: an adjustable covering; an adjustment cord operatively secured to the adjustable covering at an anchor location; a cord lock including a first body and a second body both secured to the adjustable covering and spaced apart from the anchor location, and each body defining: a first passage extending through the body from an entrance opening of the body to a first exit opening of the body; a second passage extending from an intermediate portion of the first passage to a second exit opening of the body; each body configured with a segment of the first passage extending from the intermediate portion to the first exit opening being in communication with the second passage; wherein the adjustment cord extends through the first passage of each of the first body and the second body from the entrance opening to the first exit opening, is movable along the segment of the first passage when tensioned, and is repositionable in each of the first body and the second body from the segment of the first passage to the second passage to exit through the second exit opening; and at least a portion of the second passage is narrower than the first passage to lock the adjustment cord to the first body in the second passage of the first body and to the second body in the second passage of the second body.

Clause 15: The wearable article of Clause 14, wherein a loop portion of the adjustment cord extends from the first exit opening of the first body to the first exit opening of the second body when the adjustment cord is in the segment of the first passage of each of the first body and the second body.

Clause 16: The wearable article of Clause 15, wherein the adjustment cord is tensioned when disposed in the first passage of each of the first body and the second body by pulling the loop portion away from the first body and the second body; and tension in the adjustment cord is retained when the adjustment cord is repositioned to the second passage of each of the first body and the second body to lock to the first body and the second body.

Clause 17: The wearable article of Clause 16, wherein the adjustment cord is moved to the second passage of each of the first body and the second body by pivoting the loop portion of the adjustment cord relative to the first body and the second body.

Clause 18: The wearable article of Clause 16, wherein each of the first body and the second body includes a first side wall, a second side wall spaced apart from the first side wall, and at least one protrusion extending inward from the first side wall or the second side wall, the first side wall and the second side wall extending along the segment of the first passage, and the at least one protrusion adjacent the second passage.

Clause 19: The wearable article of any of Clauses 14-18, wherein the adjustment cord pulls the adjustable covering at the anchor location when the adjustment cord is tensioned.

Clause 20: The wearable article of any of Clauses 14-19, further comprising: a cord guide secured to the adjustable covering; and wherein the adjustment cord engages the cord guide between the anchor location and the first body.

Clause 21: The wearable article of any of Clauses 14-20, wherein the wearable article is an article of footwear, and the adjustable covering is a footwear upper.

Clause 22: The wearable article of Clause 21, wherein the first body is disposed on a medial side of a tongue region of the footwear upper, and the second body is disposed on a lateral side of the tongue region of the footwear upper.

Clause 23: The wearable article of any of Clauses 21-22, wherein the anchor location is forward of the first body and the second body on the footwear upper.

Clause 24: The wearable article of any of Clauses 21-24, wherein: the first passage of each of the first body and the second body extends forward and upward from the entrance opening to the first exit opening, and the second passage of each of the first body and the second body extends rearward and upward from the intermediate portion to the second exit opening.

Clause 25: The wearable article of any of Clauses 21-24, further comprising: a first cord guide disposed on a medial side of the footwear upper and a second cord guide disposed on a lateral side of the footwear upper; wherein the adjustment cord engages the first cord guide between the anchor location and the first body, and engages the second cord guide between the anchor location and the second body.

Clause 26: The wearable article of any of Clauses 14-24, wherein the adjustment cord is elastic.

Clause 27: The wearable article of any of Clauses 14-24, wherein the adjustment cord is inelastic.

Clause 28: The lock of Clause 11, wherein the first body and the second body are configured to pivot relative to the upper to a stowed position.

To assist and clarify the description of various embodiments, various terms are defined herein. Unless otherwise indicated, the following definitions apply throughout this specification (including the claims). Additionally, all references referred to are incorporated herein in their entirety.

An "article of footwear", a "footwear article of manufacture", and "footwear" may be considered to be both a machine and a manufacture. Assembled, ready to wear footwear articles (e.g., shoes, sandals, boots, etc.), as well as discrete components of footwear articles (such as a midsole, an outsole, an upper component, etc.) prior to final assembly into ready to wear footwear articles, are considered and alternatively referred to herein in either the singular or plural as "article(s) of footwear".

"A", "an", "the", "at least one", and "one or more" are used interchangeably to indicate that at least one of the items is present. A plurality of such items may be present unless the context clearly indicates otherwise. All numerical values of parameters (e.g., of quantities or conditions) in this specification, unless otherwise indicated expressly or clearly in view of the context, including the appended claims, are to be understood as being modified in all instances by the term "about" whether or not "about" actually appears before the numerical value. "About" indicates that the stated numerical value allows some slight imprecision (with some approach to exactness in the value; approximately or reasonably close to the value; nearly). If the imprecision provided by "about" is not otherwise understood in the art with this ordinary meaning, then "about" as used herein indicates at least variations that may arise from ordinary methods of measuring and using such parameters. In addition, a disclosure of a range is to be understood as specifically disclosing all values and further divided ranges within the range.

The terms "comprising", "including", and "having" are inclusive and therefore specify the presence of stated features, steps, operations, elements, or components, but do not preclude the presence or addition of one or more other features, steps, operations, elements, or components. Orders of steps, processes, and operations may be altered when possible, and additional or alternative steps may be employed. As used in this specification, the term "or" includes any one and all combinations of the associated listed items. The term "any of is understood to include any possible combination of referenced items, including" any one of the referenced items. The term "any of" is understood to include any possible combination of referenced claims of the appended claims, including "any one of" the referenced claims.

For consistency and convenience, directional adjectives may be employed throughout this detailed description corresponding to the illustrated embodiments. Those having ordinary skill in the art will recognize that terms such as "above", "below", "upward", "downward", "top", "bottom", etc., may be used descriptively relative to the figures, without representing limitations on the scope of the invention, as defined by the claims.

The term "longitudinal" refers to a direction extending a length of a component. For example, a longitudinal direction of a shoe extends between a forefoot region and a heel region of the shoe. The term "forward" or "anterior" is used to refer to the general direction from a heel region toward a forefoot region, and the term "rearward" or "posterior" is used to refer to the opposite direction, i.e., the direction from the forefoot region toward the heel region. In some cases, a component may be identified with a longitudinal axis as well as a forward and rearward longitudinal direction along that axis. The longitudinal direction or axis may also be referred to as an anterior-posterior direction or axis.

The term "transverse" refers to a direction extending a width of a component. For example, a transverse direction of a shoe extends between a lateral side and a medial side of the shoe. The transverse direction or axis may also be referred to as a lateral direction or axis or a mediolateral direction or axis.

The term "vertical" refers to a direction generally perpendicular to both the lateral and longitudinal directions. For example, in cases where a sole is planted flat on a ground surface, the vertical direction may extend from the ground surface upward. It will be understood that each of these directional adjectives may be applied to individual components of a sole. The term "upward" or "upwards" refers to the vertical direction pointing towards a top of the component, which may include an instep, a fastening region and/or a throat of an upper. The term "downward" or "downwards" refers to the vertical direction pointing opposite the upwards direction, toward the bottom of a component and may generally point towards the bottom of a sole structure of an article of footwear.

The "interior" of an article of footwear, such as a shoe, refers to portions at the space that is occupied by a wearer's foot when the shoe is worn. The "inner side" of a component refers to the side or surface of the component that is (or will be) oriented toward the interior of the component or article of footwear in an assembled article of footwear. The "outer side" or "exterior" of a component refers to the side or surface of the component that is (or will be) oriented away from the interior of the shoe in an assembled shoe. In some cases, other components may be between the inner side of a component and the interior in the assembled article of footwear. Similarly, other components may be between an outer side of a component and the space external to the assembled article of footwear. Further, the terms "inward" and "inwardly" refer to the direction toward the interior of the component or article of footwear, such as a shoe, and the terms "outward" and "outwardly" refer to the direction toward the exterior of the component or article of footwear, such as the shoe. In addition, the term "proximal" refers to a direction that is nearer a center of a footwear component, or is closer toward a foot when the foot is inserted in the article of footwear as it is worn by a user. Likewise, the term "distal" refers to a relative position that is further away from a center of the footwear component or is further from a foot when the foot is inserted in the article of footwear as it is worn by a user. Thus, the terms proximal and distal may be understood to provide generally opposing terms to describe relative spatial positions.

While various embodiments have been described, the description is intended to be exemplary, rather than limiting and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

While several modes for carrying out the many aspects of the present teachings have been described in detail, those familiar with the art to which these teachings relate will recognize various alternative aspects for practicing the present teachings that are within the scope of the appended claims. It is intended that all matter contained in the above description or shown in the accompanying drawings shall be interpreted as illustrative and exemplary of the entire range of alternative embodiments that an ordinarily skilled artisan would recognize as implied by, structurally and/or functionally equivalent to, or otherwise rendered obvious based upon the included content, and not as limited solely to those explicitly depicted and/or described embodiments.

What is claimed is:

1. A wearable article comprising:

an adjustable covering;

an adjustment cord operatively secured to the adjustable covering at an anchor location; and a cord lock including a first body and a second body both secured to the adjustable covering and spaced apart from one another and from the anchor location, and each body defining:

a first passage extending through the body from an entrance opening of the body to a first exit opening of the body; and a second passage extending from an intermediate portion of the first passage to a second exit opening of the body;

wherein each body is configured with a segment of the first passage extending from the intermediate portion to the first exit opening being in communication with the second passage;

wherein the adjustment cord extends through the first passage of each of the first body and the second body from the entrance opening to the first exit opening, is movable along the segment of the first passage when tensioned, and is repositionable in each of the first body and the second body from the segment of the first passage to the second passage to exit through the second exit opening;

wherein at least a portion of the second passage is narrower than the first passage to lock the adjustment cord to the first body in the second passage of the first body and to the second body in the second passage of the second body; and wherein each of the first body and the second body includes a first side wall, a second side wall spaced apart from the first side wall, and at least one protrusion extending inward from the first side wall or the second side wall, the first side wall and the second side wall extending along the segment of the first passage, and the at least one protrusion adjacent the second passage.

2. The wearable article of claim 1, wherein the adjustment cord pulls the adjustable covering at the anchor location when the adjustment cord is tensioned.

3. The wearable article of claim 2, wherein the wearable article is an article of footwear, the adjustable covering is a footwear upper, the first body is disposed on a medial side of a tongue region of the footwear upper, and the second body is disposed on a lateral side of the tongue region of the footwear upper.

4. The wearable article of claim 2, wherein the wearable article is an article of footwear, the adjustable covering is a footwear upper, and the anchor location is forward of the first body and the second body on the footwear upper.

5. The wearable article of claim 2, wherein the wearable article is an article of footwear, the adjustable covering is a footwear upper, and the wearable article further comprising:

a first cord guide disposed on a medial side of the footwear upper and a second cord guide disposed on a lateral side of the footwear upper; and wherein the adjustment cord engages the first cord guide between the anchor location and the first body, and engages the second cord guide between the anchor location and the second body.

6. The wearable article of claim 1, wherein the adjustment cord is elastic.

7. The wearable article of claim 1, wherein the adjustment cord is inelastic.

8. An article of footwear comprising:

a footwear upper;

an adjustment cord operatively secured to the footwear upper at an anchor location; and a cord lock including a first body and a second body both secured to the footwear upper and spaced apart from one another and from the anchor location, and each body defining:

a first passage extending through the body from an entrance opening of the body to a first exit opening of the body; and a second passage extending from an intermediate portion of the first passage to a second exit opening of the body;

wherein each body is configured with a segment of the first passage extending from the intermediate portion to the first exit opening being in communication with the second passage;

wherein the adjustment cord extends through the first passage of each of the first body and the second body from the entrance opening to the first exit opening, is movable along the segment of the first passage when tensioned, and is repositionable in each of the first body and the second body from the segment of the first passage to the second passage to exit through the second exit opening;

wherein at least a portion of the second passage is narrower than the first passage to lock the adjustment cord to the first body in the second passage of the first body and to the second body in the second passage of the second body; and wherein the first passage of each of the first body and the second body extends forward and upward from the entrance opening to the first exit opening, and the second passage of each of the first body and the second body extends rearward and upward from the intermediate portion to the second exit opening.

9. The article of footwear of claim 8, wherein the first body is disposed on a lateral side of a tongue region of the footwear upper and the second body is disposed on a medial side of the tongue region.

10. The article of footwear of claim 8, wherein the anchor location is at a forefoot region of the article of footwear forward of the cord lock.

11. The article of footwear of claim 10, further comprising:

a first cord guide disposed rearward of and below the first lock body; and a second cord guide disposed rearward of and below the second lock body;

wherein the adjustment cord is routed through and engages the first cord guide and the second cord guide.

12. A wearable article comprising:

an adjustable covering;

an adjustment cord operatively secured to the adjustable covering at an anchor location; and a cord lock including a first body and a second body both secured to the adjustable covering and spaced apart from one another and from the anchor location, and each body defining:

a first passage extending through the body from an entrance opening of the body to a first exit opening of the body; and a second passage extending from an intermediate portion of the first passage to a second exit opening of the body;

wherein each body is configured with a segment of the first passage extending from the intermediate portion to the first exit opening being in communication with the second passage;

wherein the adjustment cord extends through the first passage of each of the first body and the second body from the entrance opening to the first exit opening, is movable along the segment of the first passage when tensioned, and is repositionable in each of the first body and the second body from the segment of the first passage to the second passage to exit through the second exit opening;

wherein at least a portion of the second passage is narrower than the first passage to lock the adjustment cord to the first body in the second passage of the first body and to the second body in the second passage of the second body; and wherein the first body and the second body are configured to pivot relative to the adjustable covering to a stowed position.

13. The wearable article of claim 12, wherein:

the cord lock includes a mounting flange mounted to the adjustable covering; and the first and second lock bodies include a tubular portion pivotable relative to the mounting flange to the stowed position.

14. The wearable article of claim 13, wherein the mounting flange and the first and second lock bodies define an opening in which the tubular portion pivots relative to the mounting flange.

15. The wearable article of claim 13, wherein the first and second lock bodies have nonpivoting end portions that interfit with opposite ends of the tubular portion.

16. The wearable article of claim 15, wherein each of the nonpivoting end portions includes a rim on which the tubular portion rotatably mounts.

17. The wearable article of claim 13, wherein the tubular portion releasably secures in the stowed position.

18. The wearable article of claim 13, wherein:

the wearable article is an article of footwear that includes a footwear upper; and the adjustable covering is the footwear upper.

19. The wearable article of claim 18, wherein the cord lock is secured at a tongue region of the footwear upper.

* * * * *